US010134231B2

(12) United States Patent
Takeda

(10) Patent No.: US 10,134,231 B2
(45) Date of Patent: Nov. 20, 2018

(54) FRAUD ANALYSIS SYSTEM FOR A WAGERING-TYPE GAMING MACHINE

(71) Applicant: Universal Entertainment Corporation, Koto-ku, Tokyo (JP)

(72) Inventor: Kengo Takeda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 15/464,595

(22) Filed: Mar. 21, 2017

(65) Prior Publication Data

US 2017/0278349 A1 Sep. 28, 2017

(30) Foreign Application Priority Data

Mar. 23, 2016 (JP) ..... 2016-057942

(51) Int. Cl.

| | |
|---|---|
| ***G07F 17/00*** | (2006.01) |
| ***G07F 17/32*** | (2006.01) |
| ***G07F 17/34*** | (2006.01) |

(52) U.S. Cl.

CPC ..... *G07F 17/3241* (2013.01); *G07F 17/3213* (2013.01); *G07F 17/3227* (2013.01); *G07F 17/3288* (2013.01); *G07F 17/34* (2013.01)

(58) Field of Classification Search

CPC ..... G07F 17/32

See application file for complete search history.

*Primary Examiner* — Reginald Renwick

(74) *Attorney, Agent, or Firm* — Simpson & Simpson, PLLC; S. Peter Konzel, Esq.

(57) ABSTRACT

It is made possible to detect abnormality caused on a gaming machine.

An analysis system includes: a storage device for storing a bet amount and a payout amount which are transmitted from a gaming machine; and an information processing device being operable to calculate a winning ratio based on the bet amount and the payout amount which are stored in the storage device, and the information processing device detects that abnormality has been caused on the gaming machine, when a winning ratio after increasing the bet amount is greater than or equal to a threshold value.

14 Claims, 66 Drawing Sheets

FIG. 9

SYMBOL COMBINATION TABLE

| SYMBOL COMBINATION | | | | | PAY-OUT NUMBER | WINNING COMBINATION |
|---|---|---|---|---|---|---|
| 1st REEL | 2nd REEL | 3rd REEL | 4th REEL | 5th REEL | | |
| RED | RED | RED | RED | RED | 15 | RED |
| APPLE | APPLE | APPLE | APPLE | APPLE | 12 | APPLE |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE3 |
| CHERRY | CHERRY | CHERRY | (ANY) | (ANY) | 2 | CHERRY2 |
| ORANGE | ORANGE | ORANGE | (ANY) | (ANY) | 2 | ORANGE2 |
| CHERRY | (ANY) | (ANY) | (ANY) | (ANY) | 1 | CHERRY1 |
| ORANGE | (ANY) | (ANY) | (ANY) | (ANY) | 1 | ORANGE1 |

FIG. 17

OPERATION FORMS OF GAME INFORMATION ANALYSIS SYSTEM

| | |
|---|---|
| ONLINE (SMALL-SCALE HALL STORE) | ・REAL TIME ACCESS TO A HALL MANAGEMENT SERVER<br>・SLOT MACHINES OF 1,000 OR LESS |
| ONLINE (LARGE-SCALE HALL STORE) | ・REAL TIME ACCESS TO A HALL MANAGEMENT SERVER<br>・MORE THAN 1,000 SLOT MACHINES<br>・CAN BE SHARED LOADS AMONG A PLURALITY OF ANALYSIS SERVERS |
| OFFLINE | ・NON-REAL-TIME |
| (OPTION) | ・A PLURALITY OF SITES<br>・A SIMPLE OPERATION (INCLUDING A SIMPLE AUTHENTICATION-COMPLIANT OPERATION)<br>・USE OF A MOBILE TERMINAL<br>・LINKAGE AMONG SYSTEMS |

ANALYSIS OF A PLURALITY OF HALL STORES

SIMPLE AUTHENTICATION OF CLIENT TERMINAL

SOFTWARE CONFIGURATION EXAMPLE
OF GAME INFORMATION ANALYSIS SYSTEM

FIG. 25

MAIN FUNCTIONS AND FEATURES OF GAME INFORMATION ANALYSIS SYSTEM

| | |
|---|---|
| DIAGNOSIS OF A BALANCE BETWEEN CUSTOMER PSYCHOLOGY AND ADMINISTRATION | ・CUSTOMER PSYCHOLOGY ANALYSIS<br>・DIAGNOSIS OF A BALANCE BETWEEN SALES AND CUSTOMER PSYCHOLOGY |
| ANALYSIS OF ATTRIBUTES OF MACHINES | ・ANALYSIS OF ATTRIBUTES OF MACHINES<br>・ANALYSIS OF ATTRIBUTES OF PLAYERS<br>・DIAGNOSIS OF MATCHING OF ATTRIBUTES OF MACHINES AND CUSTOMERS |
| DETECTING POTENTIAL RISKS AND TREND CHANGES | ・ANALYSIS OF MACHINE OPERATION AND PROFITABILITY<br>・FRAUDULENT ACT ANALYSIS<br>・FAILURE ANALYSIS<br>・POPULARITY ANALYSIS BASED ON MACHINE CLASSIFICATION AND CUSTOMER CLASSIFICATION |
| FUTURE PREDICTION AND SIMULATION OF PROFITABILITY | ・SETTING SALES TARGETS AND PREDICTION<br>・SIMULATION OF PROMOTION EFFECT |

FIG. 26

ANALYSIS OF SUSPECTED MACHINE AND SUSPECTED PLAYER

DETERMINATION RESULT OF PLAYER A

| NUMBER | FRAUDULENT ACT DETERMINATION METHOD | DETERMINATION RESULT |
|---|---|---|
| 1 | DETERMINATION BASED ON LARGE BET PER GAME | OK |
| 2 | DETERMINATION BASED ON MACHINE FAILURE | OK |
| 3 | DETERMINATION BASED ON TAKING-IN-AND-OUT OF BILLS | OK |
| 4 | DETERMINATION BASED ON WINNING RATIO UPON CHANGING A BET | OK |

DETERMINATION RESULT OF PLAYER B

| NUMBER | FRAUDULENT ACT DETERMINATION METHOD | DETERMINATION RESULT |
|---|---|---|
| 1 | DETERMINATION BASED ON LARGE BET PER GAME | OK |
| 2 | DETERMINATION BASED ON MACHINE FAILURE | OK |
| 3 | DETERMINATION BASED ON TAKING-IN-AND-OUT OF BILLS | OK |
| 4 | DETERMINATION BASED ON WINNING RATIO UPON CHANGING A BET | NG |

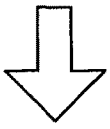

EXTRACT A CAUTION-NEEDED PLAYER

CONFIGURATION OF CLIENT TERMINAL

CONFIGURATION OF ANALYSIS SERVER

CONFIGURATION OF HALL MANAGEMENT SERVER

FUNCTIONAL BLOCKS OF CLIENT TERMINAL

FUNCTIONAL BLOCKS OF ANALYSIS SERVER

FUNCTIONAL BLOCKS OF HALL MANAGEMENT SERVER

FIG. 39

| REAL TIME MONITORING | FUNCTIONS AND OBJECTIVES OF REPORTS |
| --- | --- |
| ・SESSION | ・A STORE VISITING STATE OF A PLAYER AND AN ALERT RELATING CAUTION-NEEDED SESSIONS |
| ・EVENT | ・MACHINE STATUSES (STACKER, JACKPOT, HAND PAY, AND MAINTENANCE) |
| ・METER | ・DETECTING A CAUTION-NEEDED MACHINE BY METER DATA |
| ・TEMPERATURE | ・DISTRIBUTION OF MACHINE TEMPERATURES |
| ・HUMIDITY | ・DISTRIBUTION OF MACHINE HUMIDITY |
| ・VOLTAGE | ・DISTRIBUTION OF MACHINE VOLTAGES |
| ・PHONE CALL | ・PHONE CALL STATUSES |
| ・CAMERA ANGLE (OPTION) | ・MONITORING CAMERA AND RANGES OF VISION |
| ・TEMPERATURE EVALUATION (OPTION) | ・TEMPERATURE MAP OF THE WHOLE FLOOR |
| ・PHONE CALL LINE (OPTION) | ・IMAGE OF PHONE CALL LINES |

FIG. 41

| FRAUDULENT ACT ANALYSIS | FUNCTIONS AND OBJECTIVES OF REPORT |
| --- | --- |
| · FRAUDULENT ACT ANALYSIS REPORT | · MONTHLY SUSPICIOUS SESSION LIST, MONTHLY SUSPICIOUS MACHINE LIST, AND MONTHLY SUSPICIOUS MEMBER LIST |

FIG. 42

| SUPPOSED USERS OF GAME INFORMATION ANALYSIS SYSTEM | USE CASE |
| --- | --- |
| OWNER (OPERATIONAL MANAGEMENT OF A HALL STORE) | ・MANAGEMENT OF OPERATION INDICES<br>・SALES RISK MANAGEMENT<br>・ADMINISTRATION BALANCE DIAGNOSIS |
| MACHINE KEEPER (OPERATIONAL MANAGEMENT OF MACHINES) | ・UNDERSTANDING MACHINE POPULARITY TRENDS<br>・MAINTENANCE MANAGEMENT<br>・FRAUDULENT ACT COUNTERMEASURES |
| MARKETER (ENSURING OF CUSTOMERS (SALES PROMOTION)) | ・UNDERSTANDING CUSTOMERS' TRENDS<br>・PLANNING PROMOTION PROJECTS<br>・MARKETING RESEARCH |
| OPERATOR (OPERATION WORK) | ・MONITORING OPERATION INDICES<br>・MONITORING VISITING STATES OF CUSTOMERS<br>・MONITORING MACHINE OPERATIONS |

USE CASE RELATING MACHINE KEEPER

FIG. 45

BASIC INDICES

| INDEX NAME | DESCRIPTION | OBTAINMENT AND TOTALIZATION METHOD |
|---|---|---|
| INPUT MONEY AMOUNT (IN) | A MONEY AMOUNT INPUTTED BY A PLAYER | OBTAIN FROM A HALL MANAGEMENT SERVER |
| PAY-OUT MONEY AMOUNT (OUT) | A MONEY AMOUNT THAT A SLOT MACHINE PAYS OUT | OBTAIN FROM A HALL MANAGEMENT SERVER |
| JACKPOT MONEY AMOUNT (JP) | A MONEY AMOUNT THAT A SLOT MACHINE PAYS OUT AS A JACKPOT | OBTAIN FROM A HALL MANAGEMENT SERVER |
| PLAY SALES MONEY AMOUNT (Winloss) | SALES MONEY AMOUNT BASED ON A DIFFERENCE BETWEEN AN INPUT MONEY AMOUNT AND A PAY-OUT MONEY AMOUNT | IN-(OUT+JP) |
| NUMBER OF GAMES (Games) | A NUMBER OF GAMES | OBTAIN FROM A HALL MANAGEMENT SERVER OR CALCULATE FROM INFORMATION OBTAINED FROM A HALL MANAGEMENT SERVER |
| PLAYING TIME PERIOD | A TIME PERIOD FROM GAME START TO GAME TERMINATION | CALCULATE FROM TIME INFORMATION OBTAINED FROM A HALL MANAGEMENT SERVER |
| NUMBER OF SESSIONS | A NUMBER OF SESSIONS | CALCULATE FROM IDENTIFICATION INFORMATION OBTAINED FROM A HALL MANAGEMENT SERVER |

FIG. 46

MACHINE BASIC INDICES

| INDEX NAME | DESCRIPTION | OBTAINMENT AND TOTALIZATION METHOD |
|---|---|---|
| OPERATION RATIO | A MACHINE OPERATION RATIO | A PLAYING TIME PERIOD/ BUSINESS HOURS |
| STOPPING TIME | A SERVICE STOPPING TIME OTHER THAN A FAILURE STOPPING TIME | SUBSTRACT STOP EVENT OCCURRING TIME FROM RESTART EVENT OCCURRING TIME |
| FAILURE TIME | A SERVICE STOPPING TIME BY MACHINE FAILURE | SUBSTRACT FAIRURE EVENT OCCURRING TIME FROM FAILURE RECOVERY EVENT OCCURRING TIME (OR SESSION START TIME) |
| HAND PAY TIME | A MANUAL HAND PAY TIME | SUBSTRACT A MANUAL HAND PAY OCCURRING TIME FROM A MANUAL HAND PAY TERMINATION TIME |
| OTHER STOPPING TIME | A STOPPING TIME EXCLUDING A FAILURE TIME AND A HAND PAY TIME | SUBSTRACT A FAILURE TIME AND A HAND PAY TIME FROM A STOPPING TIME |
| NUMBER OF OPERATION DAYS/MACHINES | A NUMBER OF VALID INSTALLED MACHINES | OBTAIN FROM A HALL MANAGEMENT SERVER |
| NUMBER OF MACHINES (REGISTERED NUMBER) | A NUMBER OF REGISTERED MACHINES | |
| ACTUALLY MEASURED PO | A PO RATIO IN A TIME PERIOD OR A GAME SECTION | (OUT+JP)/IN×100 |
| AVERAGE BET PER GAME | A BET AMOUNT PER GAME | BET/Games |
| NUMBER OF TIMES OF A FAILURE EVENT | A NUMBER OF TIMES OF A FAILURE EVENT | A PREDETERMINED RECORD NUMBER OBTAINED FROM THE HALL MANAGEMENT SERVER |
| NUMBER OF TIMES OF A NON-FAILURE EVENT | A NUMBER OF TIMES OF A NON-FAILURE EVENT | A NUMBER OF TIMES OF EVENTS WHICH ARE NOT FAILURE EVENTS |
| HOLD RATIO (HOLD (%)) | A HOLD RATIO (HOLD(%)) | (1-(OUT+JP)/IN)×100 |

FIG. 47

PLAYER BASIC INDICES

| INDEX NAME | DESCRIPTION | OBTAINMENT AND TOTALIZATION METHOD |
|---|---|---|
| NUMBER OF MEMBERS | A NUMBER OF MEMBERS | |
| NUMBER OF TIMES OF STORE VISITING | A NUMBER OF TIMES OF STORE VISITING | |
| INTERVALS OF STORE VISITING | A NUMBER OF DAYS AT AN INTERVAL OF STORE VISITING | A NUMBER OF DAYS AT AN INTERVAL OF STORE VISITING = A NUMBER OF TIMES OF STORE VISITING / (A NUMBER OF DAYS BETWEEN THE INITIAL STORE VISITING DAYAND THE LATEST STORE VISITING DAY) (VALID IN A CASE WHERE A NUMBER OF DAYS ELAPSED FROM THE LASET STORE VISITING DAY IS A GHOST MEMBER THRESHOLD VALUE OR LESS) |
| NUMBER OF DAYS ELAPSED FROM THE LATEST STORE VISITING DAY | A NUMBER OF DAYS ELAPSED FROM THE LATEST STORE VISITING DAY | A NUMBER OF DAYS BETWEEN THE INITIAL STORE VISITING DAYS AND THE LATEST STORE VISITING DAY |
| NUMBER OF STORE VISITING MEMBERS | A NUMBER OF MEMBERS VISITING THE STORE | |
| MEMBER RATIO (%) | A PERCENTAGE(RATIO) OF A NUMBER OF MEMBERS TO A TOTAL NUMBER OF PLAYERS IN A HALL STORE BASED ON BASIC INDEX VALUES | A NUMBER OF MEMBERS / A TOTAL NUMBER OF PLAYERS IN A HALL STORE ×100 |
| CUSTOMER SATISFACTION DEGREE SCORE | A CUSTOMER SATISFACTION DEGREE SCORE (MONTHLY) | |

FIG. 48

MACHINE CATEGORY 1

| INDEX NAME | CLASSIFICATION DEFINITION | REMARKS |
|---|---|---|
| DENOMINATION | DENOMINATIONS | FROM A HALL MANAGEMENT SERVER |
| THEME | THEMES | FROM A HALL MANAGEMENT SERVER |
| VENDOR | VENDORS | FROM A HALL MANAGEMENT SERVER |
| LOCATION | LOCATIONS | FROM A HALL MANAGEMENT SERVER |
| SET PAY-OUT RATIO (%) | SET POs | FROM A HALL MANAGEMENT SERVER |
| LATEST OPERATION DAY | THE FINAL DAY WITH DATA | |
| GAME TYPE CLASS (GAME KIND) | SLOT(NONE), TABLE(T-CA-BAC, T-RO-RO, etc.) | |
| GAME TYPE CLASS (WITH AND WITHOUT LINKS) | STAND-ALONE(ST), LINK(LI), MULTIPLE(MUL) | |
| GAME TYPE CLASS (WITH AND WITHOUT PROGRESSIVE) | NON-PROGRESSIVE(NONE), PROGRESSIVE(PRO) | |
| GAME TYPE CLASS (DISPLAY CONFIGURATION) | NON-VIDEO(MC), VIDEO(VI) | |
| GAME TYPE CLASS (NUMBER OF REELS) | ONE REEL(1R), THREE REELS(3R), FIVE REELS(5R), etc. | |
| GAME TYPE CLASS (NUMBER OF LINES) | S(SMALL), M(MEDIUM), L(LARGE) | S: 30 LINES OR LESS<br>M: 30 TO 60 LINES<br>L: 61 LINES OR MORE |
| GAME TYPE CLASS (NUMBER OF BETS PER LINE) | S(SMALL), M(MEDIUM), L(LARGE) | S: 10 BETS OR LESS<br>M: 11 TO 24 BETS<br>L: 25 LINES OR MORE |
| GAME TYPE CLASS (BONUS ATTRIBUTES) | NON-LARGE-WINS(NONE), LARGE-WINS(LW) | |
| GAME TYPE CLASS (TABLE GAME KIND) | ROULETTE, CARD GAMES(BACCARAT), etc. | |

FIG. 49

MACHINE CATEGORY 2

| INDEX NAME | CLASSIFICATION DEFINITION | REMARKS |
|---|---|---|
| GAME TYPE CLASS | SYNTHESIZING | FROM A HALL MANAGEMENT SERVER |
| JACKPOT INTERVAL CLASS (INTERVAL BETWEEN JACKPOTS OF 100 TIMES OR MORE) | LONG INTERVAL BONUS<br>MIDDLE INTERVAL BONUS<br>SHORT INTERVAL BONUS | REFER TO WAVE MOTION ATTRIBUTE INDICES |
| JACKPOT AVERAGE MULTIPLIER CLASS (AVERAGE MULTIPLIERS OF 100 TIMES OR MORE) | HIGH VOLATILITY<br>MEDIUM VOLATILITY<br>LOW VOLATILITY | REFER TO WAVE MOTION ATTRIBUTE INDICES |
| LOW MUPLTIPLIER PO CLASS (POS EXCLUDING POS OF JACKPOTS OF 100 TIMES OR MORE) | LATE PROFIT<br>NORMAL PROFIT<br>FAST PROFIT | REFER TO WAVE MOTION ATTRIBUTE INDICES |
| FEATURE HIT INTERVAL CLASS | LONG INTERVAL FEATURE<br>MIDDLE INTERVAL FEATURE<br>SHORT INTERVAL FEATURE | REFER TO WAVE MOTION ATTRIBUTE INDICES |
| FEATURE AVERAGE MULTIPLIER CLASS | HIGH VOLATILITY FEATURE<br>MEDIUM VOLATILITY FEATURE<br>LOW VOLATILITY FEATURE | REFER TO WAVE MOTION ATTRIBUTE INDICES |
| NORMAL PO CLASS | HIGH NORMAL PO<br>MIDDLE NORMAL PO<br>LOW NORMAL PO | REFER TO WAVE MOTION ATTRIBUTE INDICES |
| MACHINE USER DEFINITION | ARBITRARY SETTING ON AN EDIT SCREEN | REFER TO ATTRIBUTE INDICES |
| FRAUDULENT ACT IDENTIFIER | A FRAUDULENT ACT IS COMITTED WITH OR WITHOUT A POSSIBILITY OF COMMITTING A FRAUDULENT ACT | SET WHEN A FRAUDULENT ACT IS DETECTED |

FIG. 50

PLAYER CATEGORY

| INDEX NAME | CLASSIFICATION DEFINITION | REMARKS |
|---|---|---|
| PLAYER TYPE (MEMBERS/NON-MEMBERS) | MEMBERS/NON-MEMBERS | FROM A HALL MANAGEMENT SERVER, etc. |
| PLAYER RANK | PLAYER RANKS | FROM A HALL MANAGEMENT SERVER, etc. |
| SEX | SEX | FROM A HALL MANAGEMENT SERVER, etc. |
| NATIONALITY | NATIONALITIES | FROM A HALL MANAGEMENT SERVER, etc. |
| AGE | CLASSIFY BY EACH 10 YEARS BASED ON DATES OF BIRTH (20'S, 30'S, etc.) | |
| LATEST OPERATION DAY | THE FINAL DAY WITH DATA | |
| MEMBER CLASSIFICATION | ACTIVE MEMBERS<br>DORMANT MEMBERS<br>GHOST MEMBERS | ACTIVE MEMBER: A MEMBER WHO VISITED A HALL STORE ONE TIME OR MORE WITHIN THE PAST SIX MONTHS<br>DORMANT MEMBER: A MEMBER WHO DID NOT VISIT A HALL STORE EVEN ONE TIME WITHIN THE PAST SIX MONTHS<br>GHOST MEMBER: A MEMBER WHO HAS NO PLAY HISTORY OF EVEN ONE TIME |
| GAME TYPE | GOOD MEMBERS<br>HIGHLY BETTING MEMBERS<br>HIGHLY FREQUENTLY STORE VISITING MEMBERS<br>ESTRANGED MEMBERS<br>NEW MEMBERS | GOOD MEMBER: A MEMBER WHOSE AVERAGE BET AMOUNT PER A VISIT IS 30,000 OR MORE AND WHOSE STORE VISITING FREQUENCY IS ONE TIME OR MORE PER A MONTH<br>HIGHLY BETTING MEMBER: A MEMBER WHOSE AVERAGE BET AMOUNT PER A VISIT IS 30, 000 OR MORE<br>HIGHLY FREQUENCY STORE VISITING MEMBER: A MEMBER WHOSE STORE VISITING FREQUENCY IS ONE TIME OR MORE PER A MONTH<br>ESTRANGED MEMBER: A MEMBER WHOSE AVERAGE BET AMOUNT PER A VISIT IS LESS THAN 30,000 AND WHOSE STORE VISITING FREQUENCY IS LESS THAN ONE TIME PER A MONTH |
| MEMBER USER DEFINITION | ARBITRARY SETTING ON AN EDIT SCREEN | |
| FRAUDULENT ACT IDENTIFIER | A FRAUDULENT ACT IS COMMITTED WITH OR WITHOUT THE POSSIBILITY OF COMMITTING A FRAUDULENT ACT | |

FIG. 52

| START DATE AND TIME | TERMINATION DATE AND TIME | PLAYER ID | MACHINE ID | INPUT MONEY AMOUNT | PAY-OUT MONEY AMOUNT | WINNING RATIO PER INPUT MONEY AMOUNT |
|---|---|---|---|---|---|---|
| 2016/03/07 20:18:32 | 2016/03/07 20:18:37 | 0723 | 0923 | 1 | 0 | 0% |
| 2016/03/07 20:18:37 | 2016/03/07 20:18:42 | 0723 | 0923 | 1 | 0 | 0% |
| 2016/03/07 20:18:42 | 2016/03/07 20:18:47 | 0723 | 0923 | 1 | 0 | 0% |
| 2016/03/07 20:18:47 | 2016/03/07 20:18:52 | 0723 | 0923 | 1 | 1 | 25% |
| 2016/03/07 20:18:52 | 2016/03/07 20:18:57 | 0723 | 0923 | 1 | 1 | 40% |
| 2016/03/07 20:18:57 | 2016/03/07 20:19:02 | 0723 | 0923 | 1 | 0 | 33% |
| 2016/03/07 20:19:02 | 2016/03/07 20:19:07 | 0723 | 0923 | 1 | 1 | 43% |
| 2016/03/07 20:19:07 | 2016/03/07 20:19:12 | 0723 | 0923 | 1 | 0 | 38% |
| 2016/03/07 20:19:12 | 2016/03/07 20:19:17 | 0723 | 0923 | 1 | 0 | 33% |
| 2016/03/07 20:19:17 | 2016/03/07 20:19:22 | 0723 | 0923 | 1 | 1 | 40% |
| 2016/03/07 20:19:22 | 2016/03/07 20:19:27 | 0723 | 0923 | 1 | 1 | 45% |
| 2016/03/07 20:19:27 | 2016/03/07 20:19:32 | 0723 | 0923 | 1 | 0 | 42% |
| 2016/03/07 20:19:32 | 2016/03/07 20:19:37 | 0723 | 0923 | 1 | 2 | 46% |
| 2016/03/07 20:19:37 | 2016/03/07 20:19:42 | 0723 | 0923 | 1 | 12 | 50% |
| 2016/03/07 20:19:42 | 2016/03/07 20:19:47 | 0723 | 0923 | 1 | 0 | 47% |
| 2016/03/07 20:19:47 | 2016/03/07 20:19:52 | 0723 | 0923 | 1 | 0 | 44% |
| 2016/03/07 20:19:52 | 2016/03/07 20:19:57 | 0723 | 0923 | 1 | 0 | 41% |
| 2016/03/07 20:19:57 | 2016/03/07 20:20:02 | 0723 | 0923 | 1 | 4 | 44% |
| 2016/03/07 20:20:02 | 2016/03/07 20:20:07 | 0723 | 0923 | 1 | 5 | 47% |
| 2016/03/07 20:20:07 | 2016/03/07 20:20:12 | 0723 | 0923 | 1 | 0 | 45% |
| 2016/03/07 20:20:12 | 2016/03/07 20:20:17 | 0723 | 0923 | 1 | 1 | 48% |
| 2016/03/07 20:20:17 | 2016/03/07 20:20:22 | 0723 | 0923 | 1 | 1 | 50% |
| 2016/03/07 20:20:22 | 2016/03/07 20:20:27 | 0723 | 0923 | 1 | 0 | 48% |
| 2016/03/07 20:20:27 | 2016/03/07 20:20:32 | 0723 | 0923 | 1 | 0 | 46% |
| 2016/03/07 20:20:32 | 2016/03/07 20:20:37 | 0723 | 0923 | 1 | 0 | 44% |
| 2016/03/07 20:20:37 | 2016/03/07 20:20:42 | 0723 | 0923 | 1 | 1 | 46% |
| 2016/03/07 20:20:42 | 2016/03/07 20:20:47 | 0723 | 0923 | 1 | 0 | 44% |
| 2016/03/07 20:20:47 | 2016/03/07 20:20:52 | 0723 | 0923 | 1 | 0 | 43% |
| 2016/03/07 20:20:52 | 2016/03/07 20:20:57 | 0723 | 0923 | 1 | 0 | 41% |
| 2016/03/07 20:20:57 | 2016/03/07 20:21:02 | 0723 | 0923 | 1 | 1 | 43% |
| 2016/03/07 20:21:02 | 2016/03/07 20:21:07 | 0723 | 0923 | 1 | 0 | 42% |
| 2016/03/07 20:21:07 | 2016/03/07 20:21:12 | 0723 | 0923 | 1 | 0 | 41% |
| 2016/03/07 20:21:12 | 2016/03/07 20:21:17 | 0723 | 0923 | 1 | 0 | 39% |
| 2016/03/07 20:21:17 | 2016/03/07 20:21:22 | 0723 | 0923 | 1 | 0 | 38% |

FIG. 53

| NO. | START DATE AND TIME | TERMINATION DATE AND TIME | PLAYER ID | MACHINE ID | INPUT MONEY AMOUNT | PAY-OUT MONEY AMOUNT | WINNING RATIO PER INPUT MONEY AMOUNT |
|---|---|---|---|---|---|---|---|
| 35 | 2016/03/07 20:21:32 | 2016/03/07 20:21:37 | 0723 | 0923 | 100 | 0 | 0% |
| 36 | 2016/03/07 20:21:37 | 2016/03/07 20:21:42 | 0723 | 0923 | 100 | 200 | 50% |
| 37 | 2016/03/07 20:21:42 | 2016/03/07 20:21:47 | 0723 | 0923 | 100 | 100 | 67% |
| 38 | 2016/03/07 20:21:47 | 2016/03/07 20:21:52 | 0723 | 0923 | 100 | 200 | 75% |
| 39 | 2016/03/07 20:21:52 | 2016/03/07 20:21:57 | 0723 | 0923 | 100 | 1500 | 80% |
| 40 | 2016/03/07 20:21:57 | 2016/03/07 20:22:02 | 0723 | 0923 | 100 | 100 | 83% |
| 41 | 2016/03/07 20:22:02 | 2016/03/07 20:22:07 | 0723 | 0923 | 100 | 0 | 71% |
| 42 | 2016/03/07 20:22:07 | 2016/03/07 20:22:12 | 0723 | 0923 | 100 | 200 | 75% |
| 43 | 2016/03/07 20:22:12 | 2016/03/07 20:22:17 | 0723 | 0923 | 100 | 1000 | 78% |
| 44 | 2016/03/07 20:22:17 | 2016/03/07 20:22:22 | 0723 | 0923 | 100 | 200 | 80% |
| 45 | 2016/03/07 20:22:22 | 2016/03/07 20:22:27 | 0723 | 0923 | 100 | 800 | 82% |
| 46 | 2016/03/07 20:22:27 | 2016/03/07 20:22:32 | 0723 | 0923 | 100 | 100 | 83% |
| 47 | 2016/03/07 20:22:32 | 2016/03/07 20:22:37 | 0723 | 0923 | 100 | 0 | 77% |
| 48 | 2016/03/07 20:22:37 | 2016/03/07 20:22:42 | 0723 | 0923 | 100 | 200 | 79% |
| 49 | 2016/03/07 20:22:42 | 2016/03/07 20:22:47 | 0723 | 0923 | 100 | 500 | 80% |
| 50 | 2016/03/07 20:22:47 | 2016/03/07 20:22:52 | 0723 | 0923 | 100 | 1200 | 81% |
| 51 | 2016/03/07 20:22:52 | 2016/03/07 20:22:57 | 0723 | 0923 | 100 | 100 | 82% |
| 52 | 2016/03/07 20:22:57 | 2016/03/07 20:23:02 | 0723 | 0923 | 100 | 100 | 83% |
| 53 | 2016/03/07 20:23:02 | 2016/03/07 20:23:07 | 0723 | 0923 | 100 | 0 | 79% |
| 54 | 2016/03/07 20:23:07 | 2016/03/07 20:23:12 | 0723 | 0923 | 100 | 400 | 80% |
| 55 | 2016/03/07 20:23:12 | 2016/03/07 20:23:17 | 0723 | 0923 | 100 | 300 | 81% |
| 56 | 2016/03/07 20:23:17 | 2016/03/07 20:23:22 | 0723 | 0923 | 100 | 1500 | 82% |
| 57 | 2016/03/07 20:23:22 | 2016/03/07 20:23:27 | 0723 | 0923 | 100 | 100 | 83% |
| 58 | 2016/03/07 20:23:27 | 2016/03/07 20:23:32 | 0723 | 0923 | 100 | 100 | 83% |

FIG. 57

| NO. | START DATE AND TIME | TERMINATION DATE AND TIME | IDENTIFICATION ID | PLAYER ID | MACHINE ID | | WINNING RATIO | CAUTION-NEEDED RANK |
|---|---|---|---|---|---|---|---|---|
| 1 | 2014/10/03 00:54:40 | 2014/10/03 01:04:08 | 2259759 | | 0217 | | 80% | 0.72 |
| 2 | 2014/10/03 00:54:53 | 2014/10/03 01:21:01 | 2259760 | 0123 | 0015 | | 36% | |
| 3 | 2014/10/03 00:55:06 | 2014/10/03 00:56:14 | 2259761 | 0550 | 0154 | | 23% | |
| 4 | 2014/10/03 00:55:19 | 2014/10/03 02:24:47 | 2259762 | | 0445 | | 39% | |
| 5 | 2014/10/03 00:55:32 | 2014/10/03 01:21:40 | 2259763 | | 0884 | | 41% | |
| 6 | 2014/10/03 00:55:45 | 2014/10/03 02:23:33 | 2259764 | 8546 | 0906 | | 30% | |
| 7 | 2014/10/03 00:55:58 | 2014/10/03 01:08:46 | 2259765 | | 0723 | ... | 21% | |
| 8 | 2014/10/03 00:56:11 | 2014/10/03 02:35:39 | 2259766 | 4433 | 0923 | | 85% | 1.23 |
| 9 | 2014/10/03 00:56:24 | 2014/10/03 00:57:20 | 2259767 | 0007 | 0406 | | 50% | |
| 10 | 2014/10/03 00:56:37 | 2014/10/03 00:57:45 | 2259768 | | 4545 | | 31% | |
| 11 | 2014/10/03 00:56:50 | 2014/10/03 00:56:58 | 2259769 | | 4454 | | 32% | |
| 12 | 2014/10/03 00:57:03 | 2014/10/03 02:31:31 | 2259770 | | 8610 | | 34% | |
| 13 | 2014/10/03 00:57:16 | 2014/10/03 06:23:24 | 2259771 | 0554 | 0458 | | 23% | |
| 14 | 2014/10/03 00:57:29 | 2014/10/03 04:10:17 | 2259772 | | 0004 | | 38% | |
| 15 | 2014/10/03 00:57:42 | 2014/10/03 16:36:30 | 2259773 | 0354 | 0046 | | 36% | |
| 16 | 2014/10/03 00:57:55 | 2014/10/03 01:00:43 | 2259774 | 6014 | 0058 | | 45% | |
| 17 | 2014/10/03 00:58:10 | 2014/10/03 01:02:28 | 2259775 | | 4436 | | 28% | |
| 18 | 2014/10/03 00:58:25 | 2014/10/03 01:54:33 | 2259776 | | 0687 | | 31% | |
| 19 | 2014/10/03 00:58:40 | 2014/10/03 01:00:18 | 2259777 | | 0623 | | 36% | |
| 20 | 2014/10/03 00:58:55 | 2014/10/03 00:59:39 | 2259778 | 0816 | 8687 | | 41% | |

FIG. 59

FRAUDULENT ACT ANALYSIS REPORT <VIEW>

STATISTICS OF CAUTION-NEEDED SESSIONS

| | CAUTION-NEEDED SESSIONS |
|---|---|
| NUMBER OF SESSIONS | 59 |
| TOTAL OF BETS | 3,450, 801.00 |
| Winloss | -633, 987.00 |

CAUTION-NEEDED SESSIONS LIST | CAUTION-NEEDED MACHINES LIST | CAUTION-NEEDED MEMBERS LIST

CAUTION-NEEDED SESSIONS LIST

| START DATE AND TIME | TERMINATION DATE AND TIME | IDENTIFI-CATION ID | PLAYER ID | MACHINE ID | PLAYING TIME PERIOD (h) | TOTAL OF BETS | Winloss | BET/ Game | WINNING RATIO |
|---|---|---|---|---|---|---|---|---|---|
| 2014-10-09 7:31:42 | 2014-10-09 8:00:29 | 2276533 | | 0202 | 0.43 | 285,275.00 | -79,050.00 | 973.63 | 89% |
| 2014-10-09 6:03:41 | 2014-10-09 6:23:38 | 2276911 | | 0011 | 0.33 | 246,950.00 | -69,950.00 | 976.09 | 91% |
| 2014-10-09 6:25:00 | 2014-10-09 6:42:36 | 2276413 | | 0012 | 0.29 | 96,750.00 | -43,760.00 | 948.53 | 83% |
| 2014-10-15 4:41:56 | 2014-10-15 4:50:01 | 2282920 | | 0160 | 0.13 | 20,325.00 | -41,975.00 | 290.36 | 80% |
| 2014-10-08 10:38:17 | 2014-10-08 12:18:55 | 2275316 | | 0231 | 1.67 | 331,345.00 | -31,737.00 | 2,808.01 | 82% |
| 2014-10-16 4:41:27 | 2014-10-16 4:52:43 | 2288765 | | 0159 | 0.19 | 12,000.00 | -24,225.00 | 203.39 | 85% |
| 2014-10-08 10:05:23 | 2014-10-08 10:34:19 | 2275310 | | 0231 | 0.48 | 94,405.00 | -24,002.00 | 2,776.62 | 85% |
| 2014-10-08 14:28:53 | 2014-10-08 15:10:31 | 2275970 | | 0230 | 0.69 | 74,650.00 | -17,003.00 | 1,555.21 | 83% |
| 2014-10-10 7:02:11 | 2014-10-10 10:52:40 | 8838 | 179 | 0210 | 3.84 | 512,948.00 | -17,000.00 | 223.21 | 81% |
| 2014-10-03 0:54:40 | 2014-10-03 1:04:08 | 2259759 | | 0217 | 0.16 | 21,050.00 | -15,388.00 | 228.80 | 80% |
| 2014-10-07 10:48:22 | 2014-10-07 17:22:07 | 8838 | 179 | 0202 | 6.56 | 885,303.00 | -14,500.00 | 220.94 | 95% |

FIG. 60

FRAUDULENT ACT ANALYSIS REPORT <VIEW>

STATISTICS OF CAUTION-NEEDED MACHINES

| | CAUTION-NEEDED MACHINES |
|---|---|
| NUMBER OF MACHINES | 96 |
| Winloss | -633, 987.00 |

CAUTION-NEEDED SESSIONS LIST | CAUTION-NEEDED MACHINES LIST | CAUTION-NEEDED MEMBERS LIST

CAUTION-NEEDED MACHINES LIST

| MACHINE ID | VENDOR | THEME | Winloss |
|---|---|---|---|
| 0202 | COMPANY A | A1 | -93,550.00 |
| 0011 | COMPANY A | A3 | -69,950.00 |
| 0231 | COMPANY C | C1 | -55,739.00 |
| 0012 | COMPANY A | A2 | -43,760.00 |
| 0160 | COMPANY B | B1 | -41,975.00 |
| 0159 | COMPANY B | B3 | -24,225.00 |
| 0230 | COMPANY C | C1 | -17,003.00 |
| 0210 | COMPANY A | A1 | -17,000.00 |
| 0217 | COMPANY A | A4 | -15,388.00 |
| 0288 | COMPANY D | D4 | -11,562.00 |

FIG. 61

FRAUDULENT ACT ANALYSIS REPORT <VIEW>

STATISTICS OF CAUTION-NEEDED MEMBERS

| | CAUTION-NEEDED MEMBERS |
|---|---|
| NUMBER OF MEMBERS | 4 |
| Winloss | -62, 700.00 |

CAUTION-NEEDED SESSIONS LIST | CAUTION-NEEDED MACHINES LIST | CAUTION-NEEDED MEMBERS LIST

CAUTION-NEEDED MEMBERS LIST

| PLAYER ID | SEX | NATION-ALITY | AGE | Winloss |
|---|---|---|---|---|
| 179 | M | 420 | 20 | −31,500.00 |
| 923 | F | 392 | 40 | −11,500.00 |
| 723 | M | 392 | 30 | −10,200.00 |
| 406 | M | 392 | 60 | −9,500.00 |

FRAUDULENT ACT ANALYSIS REPORT <RELATIONSHIP BETWEEN A BET CHANGE AND A WINNING RATIO>

FRAUD ANALYSIS SYSTEM FOR A WAGERING-TYPE GAMING MACHINE

CROSS-REFERENCE TO RELATED APPLICATION

This application claims the benefit of Japanese Patent Application No. 2016-057942, filed on Mar. 23, 2016, which application is incorporated herein by reference in its entirety.

FIELD OF THE INVENTION

The present invention relates to an analysis system.

BACKGROUND OF THE INVENTION

In recent years, in order to reduce a loss inflicted by a fraudulent act or the like caused on gaming machines installed in a game facility such as a casino, a game facility side has been conducting the examination and introduction of gaming machines for which countermeasures thereagainst have been taken.

For example, a gaming machine capable of reducing a risk of fraudulent intrusion into the gaming machine from the outside is disclosed (refer to U.S. Unexamined Patent Application Publication No. 2016/0005266).

However, on the above-mentioned gaming machine, if some measure is taken and replacement with a fraudulent ROM or the like is made, when abnormality on the gaming machine, which is caused by the replacement, cannot be detected, it is likely to continue suffering losses by conducting the subsequent games.

Therefore, in view of the above-described problem, the present invention has been made. An object of the present invention is to provide an analysis system which is operable to detect the abnormality caused on a gaming machine.

It is to be noted that an object, problems, and effects of the present invention are to be comprehended from the description in the scope of claims and shall not be unjustly construed from the below description.

BRIEF SUMMARY OF THE INVENTION

An analysis system according to the present invention includes:

a storage device for storing a bet amount and a payout amount which are transmitted from a gaming machine; and an information processing device being operable to calculate a winning ratio based on the bet amount and the payout amount which are stored in the storage device, and the information processing device detects that abnormality caused on the gaming machine, when a winning ratio after increasing the bet amount is greater than or equal to a threshold value.

The present inventors have focused attention on the situation in which a loss becomes large when a bet amount is increased. Therefore, in the above-described configuration, the abnormality caused on the gaming machine is detected when the winning ratio upon increasing the bet amount is greater than or equal to the threshold value.

By adopting the above-described configuration, since based on the change in the bet amount and the winning ratio, the abnormality caused on the gaming machine is detected, even in a case where the replacement with a fraudulent ROM or the like is made or in other case, it is made possible to detect the abnormality caused on the gaming machine.

In the present analysis system, further, the information processing device detects that abnormality is caused on the gaming machine, when a winning ratio after changing the bet amount to a maximum is greater than or equal to a threshold value.

In the present configuration, even in a case where the bet amount is increased so as to increase a payout amount paid out at one time and a fraudulent act or the like is efficiently committed, the abnormality caused on the gaming machine is detected.

By adopting the above-described configuration, it is made possible to more efficiently detect the abnormality caused on the gaming machine.

In the present analysis system, further, the information processing device detects that abnormality is caused on the gaming machine, when a number of times at which the winning ratio after increasing the bet amount is determined to be greater than or equal to the threshold value reaches a predetermined number of times.

By adopting the above-described configuration, since when the number of times at which the winning ratio after increasing the bet amount is determined to be greater than or equal to the threshold value has reached the predetermined number of times, the abnormality caused on the gaming machine is detected, it is made possible to more accurately detect the abnormality caused on the gaming machine.

In the present analysis system, further, the information processing device detects that abnormality is caused on the gaming machine, when a past winning ratio pattern being similar to a current winning ratio pattern is present.

By adopting the above-described configuration, since when the current winning ratio pattern(s) is or are similar to the past winning ratio pattern(s), the abnormality caused on the gaming machine is detected, it is made possible to more accurately detect the abnormality caused on the gaming machine.

According to the present invention, the abnormality caused on the gaming machine can be detected.

BRIEF DESCRIPTION OF THE DRAWINGS

FIG. 9 is a diagram showing an example of a symbol combination table which the slot machine includes;

FIG. 17 is a diagram showing variations of operation forms of the game information analysis system;

FIG. 25 is a diagram explaining outlines of main functions and features of the game information analysis system;

FIG. 26 is a diagram showing an example in which with respect to a fraudulent act analysis, suspected machines, suspected players, and suspected sessions are analyzed in the game information analysis system;

FIG. 39 is a diagram explaining the real time monitoring of the menu screen displayed in the game information analysis system;

FIG. 41 is a diagram explaining a fraudulent act analysis of the menu screen displayed in the game information analysis system;

FIG. 42 is a diagram explaining representative use cases of supposed users of the game information analysis system;

FIG. 45 is a table organized as a list explaining basic indices in the game information analysis system;

FIG. 46 is a table organized as a list explaining machine basic indices in the game information analysis system;

FIG. 47 is a table organized as a list explaining player basic indices in the game information analysis system;

FIG. 48 is a table organized as a list explaining machine categories in the game information analysis system;

FIG. 49 is a table organized as a list explaining machine categories in the game information analysis system;

FIG. 50 is a table organized as a list explaining player categories in the game information analysis system;

FIG. 52 is a diagram showing one example of game information;

FIG. 53 is a diagram showing one example of game information;

FIG. 57 is a diagram showing one example of game section information;

FIG. 59 is a diagram showing one example of a report;

FIG. 60 is a diagram showing one example of a report;

FIG. 61 is a diagram showing one example of a report;

DETAILED DESCRIPTION OF THE PREFERRED EMBODIMENT

One embodiment of the present invention will be described with reference to the accompanying drawings.

[Description of Outline of Game System]

Figure 1:
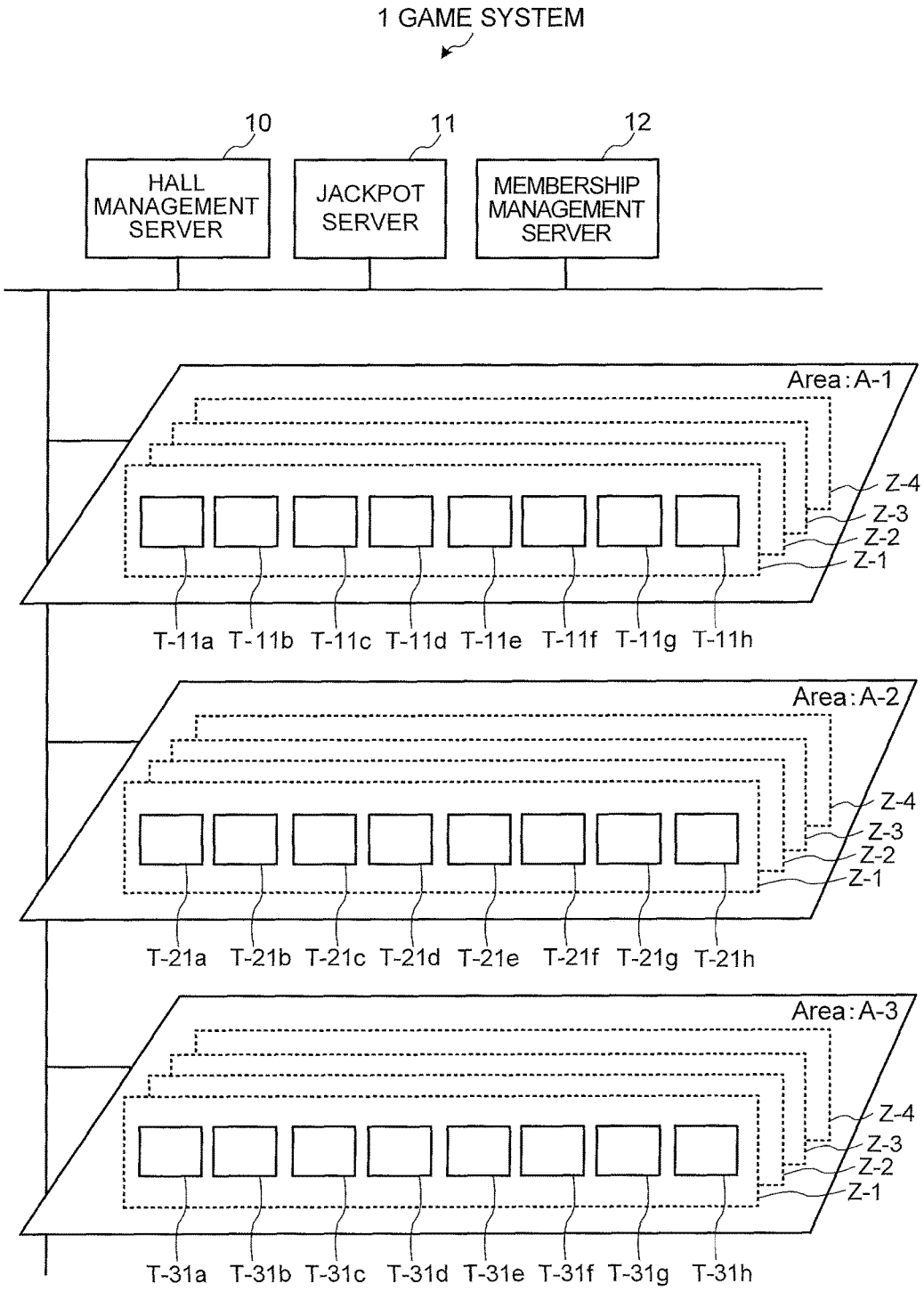
FIG. 1 is a diagram schematically illustrating a game system.

First, with reference to FIG. 1, an outline of a game system will be described. FIG. 1 is a schematic diagram schematically illustrating an overview of a game system 1 according to one embodiment of the present invention.

The game system 1 includes a hall management server 10, a jackpot server 11, a membership management server 12, and a plurality of gaming machines. Each of the gaming machines is, for example, a slot machine.

The hall management server 10 totalizes and manages a flow of money within a hall (game facility), prepares a balance sheet and the like, and manages the other servers. In addition, the hall management server 10 obtains, from the respective gaming machines, accounting information which includes timing at which each of the gaming machines starts a unit game; timing at which each of the gaming machines terminates the unit game; a drawing result in the unit game; and the like and accumulates the accounting information.

The jackpot server 11 manages accumulation and paying-out of jackpot amounts for a jackpot. For the jackpot, a part of coins which a player consumes on each of the gaming machines is accumulated as a jackpot amount, and in a case where a jackpot trigger has been established on any of the gaming machines, coins corresponding to the accumulated jackpot amounts are paid out to that gaming machine. In this case, each of the gaming machines calculates an accumulated amount (an accumulation amount) as the jackpot amount each time a game is played and transmits the calculated accumulated amount to the jackpot server 11 which is an external control device. The jackpot server 11 accumulates the accumulation amounts transmitted from the slot machines to the jackpot amount.

The membership management server 12 is a server which stores and manages personal information of members, membership card (IC card) information, the past game outcomes of the members, and the like. Issuance of membership cards (IC cards) is made by, for example, a membership card issuing terminal. The personal information of the members, inputted upon member registration, is stored on the membership management server 12 together with identification codes of the membership cards. In addition, the membership card issuing terminal is provided with a camera which allows also shooting of a face of a player, for whom an IC card is issued, upon issuing of a membership card. The shot image is stored on the membership management server 12 so as to be associated with an identification code.

As shown in FIG. 1, the gaming machines are installed in a plurality of areas (for example, as shown in FIGS. 1, A-1 to A-3). Here, the areas correspond to, for example, one floor of a hall or areas within the floor. In this example, although the areas from A-1 to A-3 are shown, this is merely one example.

Further, the gaming machines are installed in each zone (for example, as shown in FIG. 1, in Z-1 to Z-4) within each of the areas. Here, each of the zones corresponds to specific space within each of the areas. In this example, although the four zones (Z-1 to Z-4) are provided in each of the areas, respectively, this is also merely one example. In addition, in this example, although eight gaming machines are installed in each one of the zones, respectively, this is also merely one example, and various numbers of the gaming machines can be installed.

As shown in FIG. 1, in the zone Z-1 of the area A-1, eight gaming machines of T-11*a* to T-11*h* are installed; similarly, in the zone Z-2 of the area A-1, eight gaming machines of T-12*a* to T-12*h* are installed (thereinafter, not shown); in the zone Z-3 of the area A-1, eight gaming machines of T-13*a* to T-13*h* are installed; and in the zone Z-4 of the area A-1, eight gaming machines of T-14*a* to T-14*h* are installed.

Further, as shown in FIG. 1, in the zone Z-1 of the area A-2, eight gaming machines of T-21*a* to T-21*h* are installed; similarly, in the zone Z-2 of the area A-2, eight gaming machines of T-22*a* to T-22*h* are installed (thereinafter, not shown); in the zone Z-3 of the area A-2, eight gaming machines of T-23*a* to T-23*h* are installed; and in the zone Z-4 of the area A-2, eight gaming machines of T-24*a* to T-24*h* are installed. In addition, in the zone Z-1 of the area A-3, eight gaming machines of T-31*a* to T-31*h* are installed; similarly, in the zone Z-2 of the area A-3, eight gaming machines of T-32*a* to T-32*h* are installed (thereinafter, not shown); in the zone Z-3 of the area A-3, eight gaming machines of T-33*a* to T-33*h* are installed; and in the zone Z-4 of the area A-3, eight gaming machines of T-34*a* to T-34*h* are installed.

It is to be noted that as shown in FIG. 1, the respective gaming machines are connected to the hall management server 10, the jackpot server 11, and the membership management server 12 via a LAN connection or the like, for example, by Ethernet (a registered trademark).

In addition, each of the gaming machines is provided with a unique identifier, and the hall management server 10 or the like identifies transmission sources of data transmitted from the respective gaming machines by using the identifiers. In addition, also in a case where the hall management server 10 or the like transmits data to the gaming machines, based on the identifiers, transmission destinations are specified. Although as the identifiers, for example, network addresses such as IP addresses can be used, identifiers other than the network addresses may be provided, thereby allowing the individual gaming machines to be managed.

It is to be noted that the game system 1 may be constructed within one hall (game facility) where various games can be conducted or may be constructed over a plurality of game facilities. In addition, when the game system 1 is constructed in a single game facility, the game system 1 may be constructed in each floor or section of the game facility. A communication line for connecting the servers and the gaming machines may be a wired or wireless line, and the Internet (for example, used as a secret line using a VPN), a dedicated line, an exchange line, or the like can be adopted.

[Description of Outline of Gaming Machine]

Figure 2:
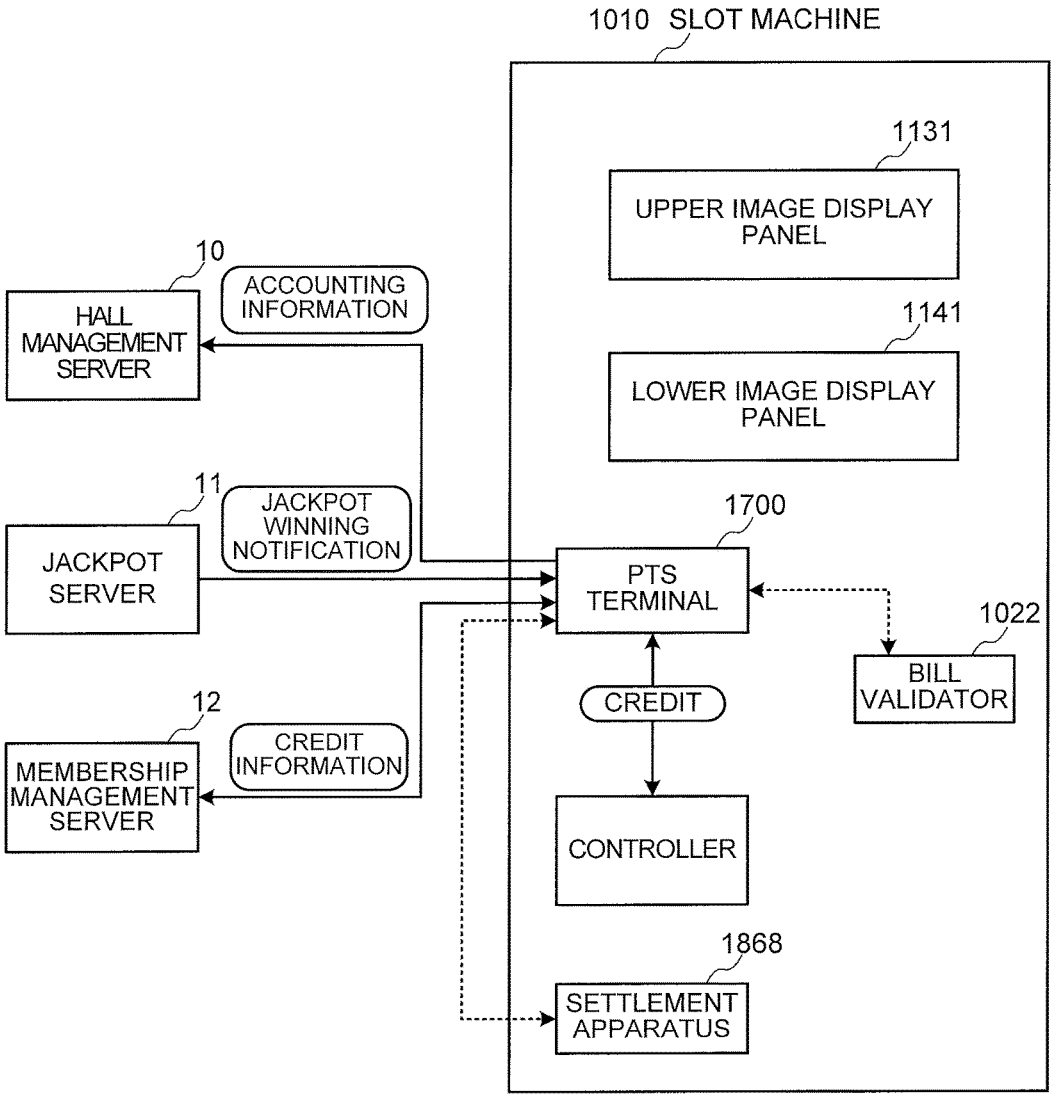
FIG. 2 is a diagram schematically illustrating a slot machine.

Next, with reference to FIG. 2, an outline of a gaming machine according to the embodiment of the present invention will be described. In FIG. 2, a configuration of a slot machine 1010 which is a gaming machine including a player tracking device is conceptually shown. It is to be noted that the player tracking device is a terminal for realizing a player tracking system, and in the present specification, hereinafter, this device is referred to as a PTS terminal. In addition, the PTS terminal in the present embodiment is configured to include a PTS front unit and a PTS main body. The PTS front unit is located on a front face of the gaming machine in an integrated manner and includes an operation part operated by a player. In addition, the PTS main body includes a control part connected to the PTS front unit by a cable or the like and is located so as to be remote from the PTS front unit. It is to be noted that although in the below description, a case where the slot machine is used as the gaming machine will be described, the present invention is not limited to the case of the slot machine and is applicable to gaming machines which conducts a variety of games.

As shown in FIG. 2, the slot machine 1010 has the PTS terminal 1700 mounted therein and further includes an upper image display panel 1131, a lower image display panel 1141, and a settlement apparatus 1868. The slot machine 1010 is connected via the PTS terminal 1700 to the hall management server 10, the jackpot server 11, and the like via a network.

In the present embodiment, one slot machine 1010 is provided with one PTS terminal 1700.

In the present embodiment, the PTS terminal 1700 is connected to a bill validator 1022 via a communication line (or the slot machine 1010).

In addition, based on a predetermined protocol, the PTS terminal 1700 conducts transmission and reception of data to and from a controller (the later-described controller 1100 of the slot machine 1010) and conducts data communication with the hall management server 10, the jackpot server 11, the membership management server 12, and the like connected via the network. For example, from the PTS terminal 1700 to the controller 1100, information pertinent to a credit required to start a game, a stop command to instruct to stop a unit game upon predetermined presentation, and the like are transmitted. From the controller 1100 to the PTS terminal 1700, information pertinent to a credit as a game outcome, start notification of the unit game, and termination notification thereof are transmitted.

In addition, from the PTS terminal 1700 to the hall management server 10, the start notification and the termination notification of the unit game, accounting information including a drawing result or the like, and the like are transmitted. It is to be noted that although in the present embodiment, the game information including the accounting information of the slot machine 1010 is transmitted via the PTS terminal 1700 to the hall management server 10 or the like, said game information can also be transmitted, with no PTS terminal 1700 involved, via a communication interface or via a device other than the PTS terminal 1700 from the controller 1100 to the hall management server 10 and the like. Further, between the PTS terminal 1700 and the membership management server 12, information pertinent to credits of members or the like is communicated.

Here, an outline of a game flow in a case of members is as described below. First, member registration is conducted by using the membership card issuing terminal, and at this time, a membership card (IC card) is issued. Thereafter, a player inserts the membership card into the PTS terminal 1700 of the slot machine 1010 and thereafter, inputs cash. When the bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller 1100.

Based on the credit transmitted from the PTS terminal 1700, the controller 1100 executes the game. A credit in accordance with a game outcome is transmitted from the controller 1100 to the PTS terminal 1700, calculation for paying-out based on the game outcome is performed on the PTS terminal 1700, and a money amount to be paid out to a player is determined. On the PTS terminal 1700, the determined money amount is written onto the membership card as it is, and the membership card is ejected. In addition, in accordance with the execution or the like of the game, predetermined points are provided for the membership card.

In addition, for each game, a to-be-paid-out money amount (credit) as a game outcome is transmitted together with an identification code of that member via the PTS terminal 1700 to the hall management server 10 (in real time or at predetermined timing). The information transmitted as described above is each grasped as a game outcome of a corresponding member on the hall management server 10 and is accumulated.

In a case where a player who is a member plays a game next, the PTS terminal 1700 reads the inserted membership card and then reads out the money amount stored in the membership card. The read-out money amount is converted to a credit and the converted credit is transmitted to the controller 1100. A credit in accordance with a game outcome is transmitted from the controller 1100 to the PTS terminal 1700 as mentioned above, calculation for paying-out based on the game outcome is performed on the PTS terminal 1700, and a money amount (credit) to be paid out to a player is determined. At this time, the money amount obtained as the game outcome is added to the money amount of the membership card, thereby updating this.

Further, at this time, the PTS terminal 1700 transmits an identification code (or a member ID) read out from the membership card and the updated money amount to the membership management server 12, and the membership management server 12 adds the money amount transmitted from the PTS terminal 1700 to a money amount of a member identified by the above-mentioned identification code and stores said money amount. By conducting this process, the money amount which the member holds is invariably managed.

Thereafter, if needed, a player who is a member can make settlement at a cashier counter or the like based on the money amount stored on the membership card. In addition, as on the above-described slot machine 1010, in a case where the settlement apparatus 1868 is included therein, on said slot machine 1010, the settlement can be made by using the membership card.

On the other hand, an outline of a game flow in a case where a player is a non-member is as described below. A player inputs cash to the PTS terminal 1700 of the slot machine 1010. When the bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller 1100.

Based on the credit transmitted from the PTS terminal 1700, the controller 1100 executes the game. A credit in accordance with a game outcome is transmitted from the controller 1100 to the PTS terminal 1700. On the PTS terminal 1700, calculation for paying-out based on the game outcome is performed and a money amount to be paid out to a player is determined. On the PTS terminal 1700, this determined money amount is written onto a new IC card stocked in the slot machine 1010, and the IC card is ejected. Here, the non-member gets the IC card for the first time. In addition, it is also possible for the non-member to obtain a non-membership card (an IC card or an IC ticket) for which a money amount is charged by inputting cash or the like. In this case, a game can be played by using this non-membership card.

Thereafter, if needed, a player who is the non-member can make settlement at a cashier counter or the like based on the money amount stored on the IC card. In addition, as with the above-described slot machine 1010, in a case where the settlement apparatus 1868 is included therein, on said slot machine 1010, the settlement can be made by using the IC card.

In addition, for each game, a to-be-paid-out money amount (credit) as a game outcome is transmitted via the PTS terminal 1700 to the hall management server 10 (in real time or at predetermined timing). The information transmitted as described above is grasped as a game outcome of the non-member on the hall management server 10 and is accumulated thereon.

[Description of Function Flow Diagram]

Figure 3:
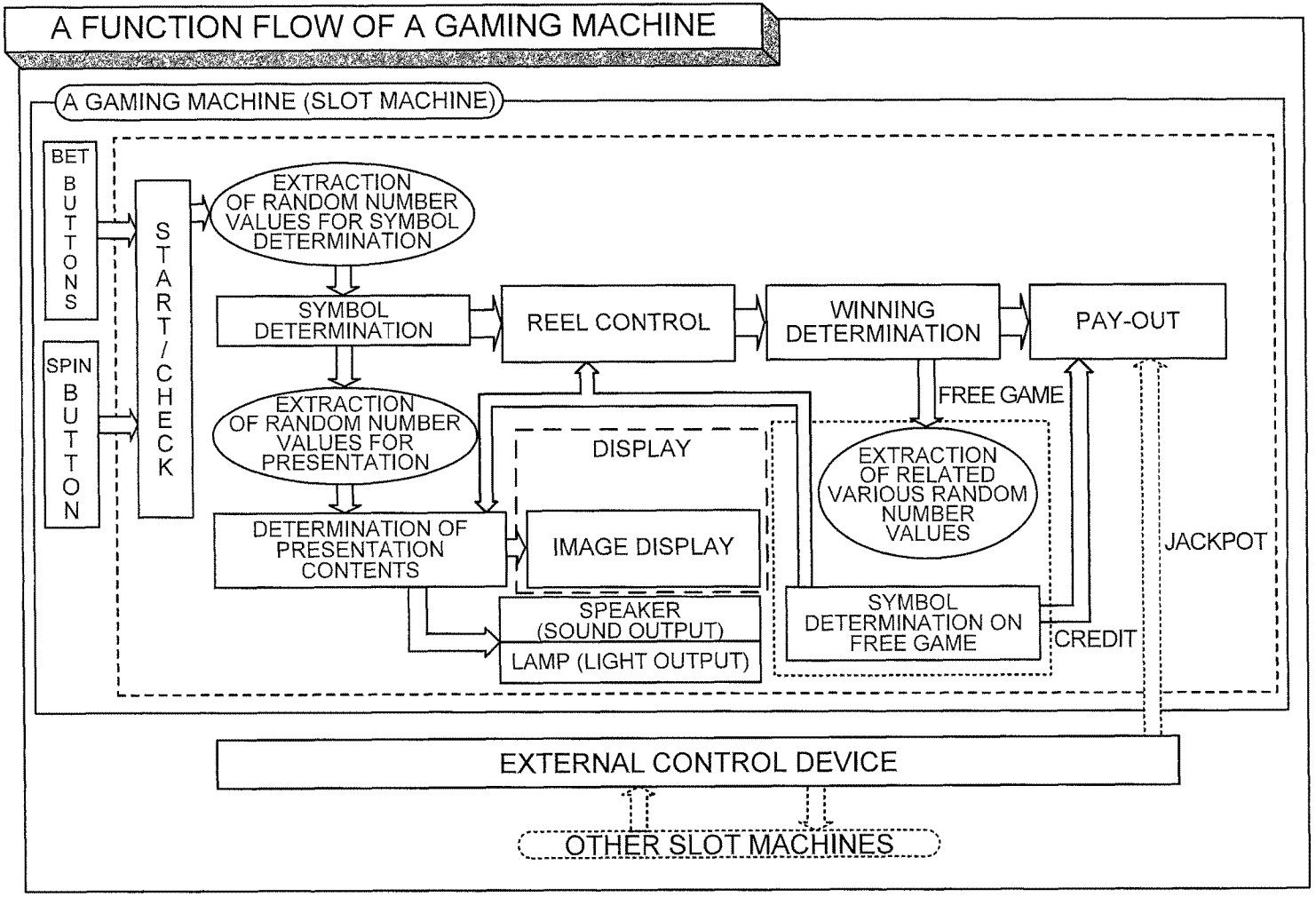
FIG. 3 is a diagram showing basic functions of a gaming machine.

With reference to FIG. 3, basic functions of a gaming machine (slot machine 1010) according to one embodiment of the present invention will be described. As shown in FIG. 3, the slot machine 1010 is connected to an external control device (for example, a jackpot server 11) so as to allow data communication, and the external control device is connected to a plurality of other slot machines 1010 installed in a hall so as to allow data communication.

<Start-Check>

First, the slot machine 1010 checks whether or not a BET button has been pressed by a player, and subsequently checks whether or not a spin button has been pressed by a player.

<Symbol Determination>

Next, when the spin button has been pressed by a player, the slot machine 1010 extracts random number values for symbol determination and determines symbols to be displayed to a player with respect to a plurality of reels at the time of stopping rotation of the reels.

<Reel Control>

Next, the slot machine 1010 starts the rotation of each of the reels and then stops the rotation such that the determined symbols are displayed to a player.

<Winning Determination>

Next, when the rotation of each of the reels has been stopped, the slot machine 1010 determines whether or not a combination of symbols displayed to a player is a combination related to winning.

<Paying-Out>

Next, when the symbols displayed to a player is the combination related to winning, the slot machine 1010 provides benefits according to the combination for a player. For example, when a combination of symbols related to paying-out of coins has been displayed, the slot machine 1010 adds a number of coins corresponding to the combination of symbols to a number of credits.

In addition, when a combination of symbols related to a jackpot trigger has been displayed, the slot machine 1010 starts a bonus game. It is to be noted that, in the present embodiment, a game (free game) in which a drawing related to the above-mentioned determination of to-be stopped symbols is conducted is conducted as a bonus game at a predetermined number of times without using coins.

In addition, when a combination of symbols related to a jackpot trigger has been displayed, the slot machine 1010 pays out coins of a jackpot amount to a player. The jackpot refers to a function which accumulates parts of coins used by players at the respective gaming machines as the amount of jackpot and which, when the jackpot trigger has been established in any of the slot machine 1010, pays out coins of the accumulated amount of the jackpot to that slot machine 1010. The slot machine 1010 calculates the amount (accumulation amount) to be accumulated to the amount of jackpot for each game (unit game) and transmits the calculated amount to the external control device. The external control device accumulates to the jackpot amount the accumulation amounts transmitted from the respective gaming machines.

Here, the unit game refers to a series of operations conducted from when the acceptance of betting is started through a player's pressing-down of the BET button to when winning is likely to be established.

<Determination of Presentation Contents>

The slot machine 1010 conducts presentation through displaying of images by a display, outputting of light by a lamp, and outputting of sound by a speaker. The slot machine 1010 extracts random number values for the presentation and determines presentation contents based on symbols or the like determined by a drawing.

[Structure of slot machine]

Next, with reference to FIG. 4, an overall structure of a slot machine 1010 will be described.

On the slot machine 1010, as game media, bills or electronic valuable information corresponding to these are used. In particular, in the present embodiment, credit-related data such as cash data stored in an IC card 1500 is used. It is to be noted that although the slot machine 1010 has a structure in which coins are not used as the game media, this is merely one example, and the slot machine 1010 may be configured as a slot machine on which a variety of game media including the coins can be used.

The slot machine 1010 is provided with a housing which includes a cabinet 1011 and a top box 1012 attached on an upper side of the cabinet 1011. Main parts of the cabinet 1011 and the top box 1012 are formed of metallic plate members. In addition, on a front face of the cabinet 1011, an upper door 1142 and a lower door 1144 are provided.

On a lower side of a front face of the upper door 1142, a lower image display panel 1141 is provided. The lower image display panel 1141 is constituted of a liquid crystal panel and configures a display.

In addition, on the front face of the upper door 1142 and above the above-mentioned lower image display panel 1141, a symbol display window 1135 is provided. Through the symbol display window 1135, a reel apparatus M1 which is provided inside of the cabinet 1011 and is constituted of five reels M1*a* to M1*e* is visually recognizable. On a peripheral surface of each of the reels, 12 symbols are depicted. The 12 symbols are arranged in succession along a direction in which each of the reels of the reel apparatus M1 is rotated and form a symbol array. Each of the reels M1*a* to M1*e* is rotated, the symbols depicted on each of the reels are thereby rotated in a longitudinal direction, and thereafter, the rotation is stopped, thereby allowing the symbols to be rearranged.

Here, "rearrangement" means a state in which after the arrangement of the symbols has been released, the symbols are arranged again. "Arrangement" means a state in which the symbols can be visually confirmed by an external player. The slot machine 1010 executes the so-called slot game in which based on the state of the arrangement of the symbols on the reels M1*a* to M1*e* which have been rotated and thereafter stopped, a payout in accordance with a predetermined combination is awarded.

It is to be noted that although in the present embodiment, the slot machine 1010 is a slot machine which includes a mechanical reel type reel apparatus M1, the slot machine 1010 may be a slot machine which includes a video reel type reel apparatus displaying pseudo reels, and the slot machine 1010 may be a slot machine in which the video reel type reel apparatus and the mechanical reel type reel apparatus are combined.

On a front face of the top box 1012, an upper image display panel 1131 is provided. The upper image display panel 1131 is constituted of a liquid crystal panel and configures a display. The upper image display panel 1131 displays images related to presentation and images showing introduction of contents of games and rules thereof.

On the above-mentioned lower image display panel 1141, arranged are a number-of-credits display part which indicates a state of credits (for example, a total number of credits which a player currently has) as necessary and a fraction cash display part which indicates fraction cash, and a variety of pieces of information pertinent to a game such as contents of betting are displayed. Here, "credits" are virtual game media on a game, to be used when a player makes betting. In addition, "fraction cash" is cash which is not converted to a credit because an inputted money amount is insufficient.

When the IC card 1500 has been inserted into the later-described PTS terminal 1700, a number of credits stored on the IC card is displayed on the number-of-credits display part, and fraction cash stored on the IC card is displayed on the fraction cash display part. It is to be noted that these numerical values are stored on the membership management server 12 so as to be associated with an identification code of the membership card.

Here, the IC card is, for example, a non-contact IC card and has incorporated thereon an IC (Integrated Circuit) for recording and computing a variety of pieces of data such as credits and enables short-range wireless communication using, for example, an RFID (Radio Frequency Identification) technology such as NFC (Near Field Communication). By using the IC card 1500, a player can have the credit-related data and further, freely carries this with him or her among different slot machines. A player inserts the IC card 1500 into the PTS terminal 1700 of the slot machine 1010 and thereby uses the credit-related data (money amount data) stored on the IC card 1500, thereby allowing a player to play a game such as a unit game on the slot machine 1010.

It is to be noted that it may be made possible for a player to deposit cash such as coins and bills as cash data on the IC card 1500 by using an apparatus installed in a hall.

On right and left sides of an uppermost portion of a front face of the lower door 1144, speakers 1112 are respectively provided. On the slot machine 1010, presentation of a unit game is executed through displaying of images by the upper image display panel 1131, outputting of sound by the speakers 1112, outputting of light by a lamp (not shown), and the like.

In addition, on the front face of the lower door 1144 and below said speaker 1112, a PTS front unit 1700*a* which is a front part of the PTS terminal 1700 is incorporated. On a right side of the PTS front unit 1700*a*, a printed matter discharge outlet 1136 and a bill insertion slot 1137 are located.

Further, on the front face of the lower door 1144, below the PTS front unit 1700*a*, a control panel 1030 is located. The control panel 1030 includes a base plate which is of a flat plate shape. On said base plate, a plurality of operation buttons (i.e. a spin button 1031, a MAX BET button 1032, a 5-BET button 1033, a 3-BET button 1034, a 2-BET button 1035, a 1-BET button 1036, a HELP button 1037, and a CASHOUT button 1038) are located.

In order to allow a player to easily perform a pressing operation of the spin button 1031 and easily identify the spin button 1031, the spin button 1031 is formed so as to be of a circular shape whose size is larger than those of the other buttons. The spin button 1031 is located in a right end portion of the base plate and has a function to start a game through a pressing operation.

The MAX BET button 1032 to 1-BET button 1036 are located on a left side of the spin button 1031 in an aligned manner at equal intervals. Each of these operation buttons is formed so as to be of a quadrangular shape. The MAX BET button 1032 located in a right end portion has a function to allow a game to be played with a maximum number of bets (BET number) such as a decuple through a pressing operation. The 5-BET button 1033 has a function to allow a game to be played with a quintupled number of BETs through a pressing operation. The 3-BET button 1034 has a function to allow a game to be played with a tripled number of BETs through a pressing operation. The 2-BET button 1035 has a function to allow a game to be played with a doubled number of BETs through a pressing operation. The 1-BET button 1036 has a function to allow a game to be played with one BET through a pressing operation.

The HELP button 1037 and the CASHOUT button 1038 are located in a longitudinal direction in a left end portion of the base plate. The HELP button 1037 has a function to display HELP information indicating a game method and the like on the lower image display panel 1141 or the like through a pressing operation. In addition, the CASHOUT button 1038 has a function to store a credit or the like on the IC card 1500 and to output the credit or the like in the form of a printed matter through a pressing operation.

Further, in the slot machine 1010, in side portions of the cabinet 1011, air ventilation slots 1133 and an air intake slot 1134 are located and in a side portion of the top box 1012, air ventilation slots 1132 are located. In addition, in an inside portion of the cabinet 1011, which corresponds to a position of the air ventilation slots 1133, a fan (not shown) is arranged, and similarly, in an inside portion of the top box 1012, which corresponds to a position of the air ventilation slots 1132, a fan (not shown) is arranged. These fans allow air inside of the slot machine 1010 to be discharged to an outside and take in external air from the air intake slot 1134, and through such air circulation, a temperature inside of the slot machine 1010 is adjusted.

In addition, in the side portion of the cabinet 1011 of the slot machine 1010, provided are a key cylinder 1138 into which a key used to open the upper door 1142 and the lower door 1144 is inserted and a door lock bar 1139 with which the upper door 1142 and the lower door 1144 are locked.

Next, with reference to FIG. 5, the slot machine 1010 in a state in which the upper door 1142 and the lower door 1144 are opened and an internal structure of the cabinet 1011 will be described.

Figure 5:
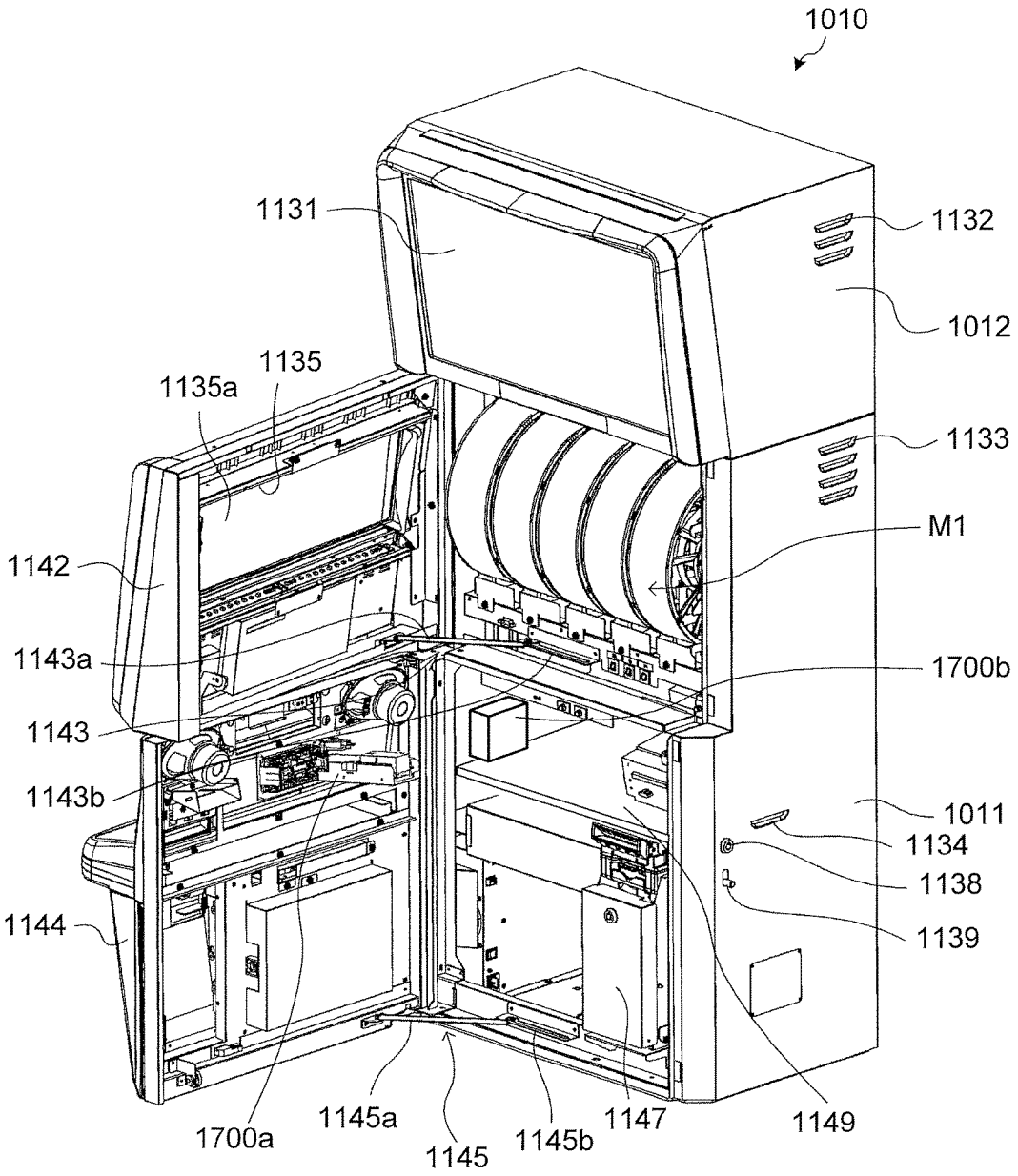
FIG. 5 is a perspective view illustrating a state in which an upper door and a lower door of the slot machine are opened.

FIG. 5 is a perspective view illustrating the slot machine 1010 in the state in which the upper door 1142 and the lower door 1144 are opened. As shown in FIG. 5, on the front face of the top box 1012 of the slot machine 1010, as described above, the upper image display panel 1131 is located, and in the side portion of the top box 1012, the air ventilation slots 1132 are located. The cabinet 1011 of the slot machine 1010 is formed so as to be of a box-like shape with the front face being opened, and in an upper portion of the front face, the upper door 1142 is located, and in a lower portion of the front face, the lower door 1144 is located.

In addition, in an upper portion of the side portion of the cabinet 1011, the air ventilation slots 1133 are located, and in a middle portion of the side portion of the cabinet 1011, the air intake slot 1134 is located. Further, in the vicinity of the air intake slot 1134, the above-mentioned key cylinder 1138 and door lock bar 1139 are located.

As shown in FIG. 5, in a left end portion of the cabinet 1011, the cabinet 1011 pivotally supports the upper door 1142 and the lower door 1144 in a rotatable manner. On an upper end portion and a lower end portion of the upper door 1142, the upper door 1142 and the cabinet 1011 are pivotally supported in a rotatable manner and are coupled by an upper door opening mechanism 1143. The upper door opening mechanism 1143 is located on a lower side of the upper door 1142 and has a rod member 1143*a* whose one end portion is pivotally supported in a rotatable manner onto a rear face wall of the upper door 1142 and a slide member 1143*b* which is laterally provided on a front face side of the cabinet 1011. The slide member 1143*b* engages the other end portion of the rod member 1143*a* in a horizontally movable manner, temporarily stops the upper door 1142 at a predetermined opening angle, and when a predetermined force or more is applied externally in a direction in which the upper door 1142 is closed, moves the upper door 1142 in a rotatable manner in a closing direction.

In addition, on an upper end portion and a lower end portion of the lower door 1144, the lower door 1144 and the cabinet 1011 are pivotally supported in a rotatable manner and are coupled by a lower door opening mechanism 1145. The lower door opening mechanism 1145 is located on a lower side of the lower door 1144 and has a rod member 1145*a* whose one end portion is pivotally supported in a rotatable manner onto a rear face wall of the lower door 1144 and a slide member 1145*b* which is laterally provided on a front face side of the cabinet 1011. The slide member 1145*b* engages the other end portion of the rod member 1145*a* in a horizontally movable manner, temporarily stops the lower door 1144 at a predetermined opening angle, and when a predetermined force or more is applied externally in a direction in which the lower door 1144 is closed, moves the lower door 1144 in a rotatable manner in a closing direction.

In the upper door 1142, as described above, the symbol display window 1135 is arranged, the symbol display window 1135 is covered with a reel cover 1135*a*. The reel cover 1135*a* includes: for example, a base panel such as a transparent liquid crystal panel and a transparent panel; and a touch panel provided on a front face of the base panel. The symbol display window 1135 covered with the reel cover 1135*a* allows 15 symbols in areas of 5 columns×3 rows among symbols depicted on peripheral surfaces of the respective reels of the reel apparatus M1 to be made viewable externally.

In addition, in FIG. 5, the PTS front unit 1700*a* located in the middle portion of the lower door 1144 is shown. With the lower door 1144 being closed, the PTS front unit 1700*a* comes to be housed inside of the cabinet 1011. A configuration of the PTS terminal 1700 including the PTS front unit 1700*a* will be described below in detail.

In a right lower portion of the cabinet 1011, a bill stocker 1147 is housed. The bill insertion slot 1137 shown in FIG. 4 communicates with an insertion slot (an insertion slot of the bill validator 1022) of the bill stocker 1147. The bill stocker 1147 has a function, for example, to pull in bills inputted into the bill insertion slot 1137; thereafter, to determine authenticity of the bills; if any of the bills are bogus, to discharge the bogus bills from the bill insertion slot 1137; and if the bills are authentic, to classify the bills according to kinds of the bills and to house the bills. In addition, in a middle portion of the cabinet 1011, a shelf plate member 1149 which partitions inner space of the cabinet 1011 is located. The shelf plate member 1149 is formed of a metallic thin plate.

As shown in FIG. 5, a PTS main body 1700*b* is located, for example, inside of the cabinet 1011 and above the shelf plate member 1149. The PTS main body 1700*b* has a magnet with which the PTS main body 1700*b* is attached in contact with an inner side face of the cabinet 1011. At this time, a portion of the inner side face of the cabinet 1011, which comes in contact with or close to said magnet, is formed of at least a metallic member. It is to be noted that although the PTS front unit 1700*a* and the PTS main body 1700*b* are connected by a predetermined network (for example, a predetermined cable), the illustration thereof is omitted here.

Figure 4:
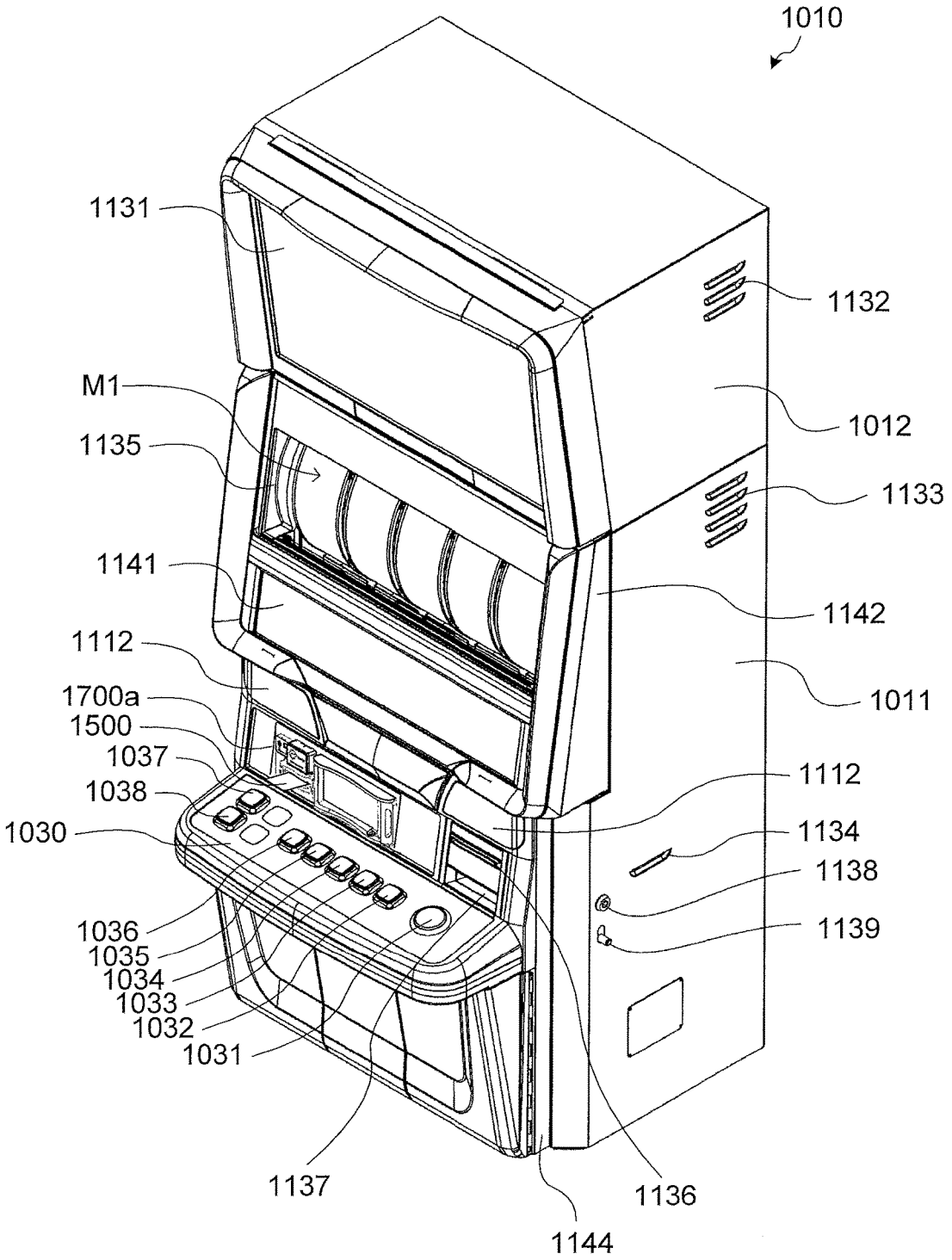
FIG. 4 is a perspective view illustrating an overall structure of the slot machine.

It is to be noted that although hereinabove, the slot machine 1010 is described as the apparatus having the configuration as shown in FIG. 4 and FIG. 5, a variety of other configurations may be adopted.

[Configuration of PTS Terminal]

Next, with reference to FIG. 6, a configuration of a PTS front unit 1700*a* will be described. A PTS terminal 1700 includes the PTS front unit 1700*a* incorporated into a lower door 1144 of a slot machine 1010 and a PTS main body 1700*b* housed inside of a cabinet 1011 of the slot machine 1010. The PTS front unit 1700*a* and the PTS main body 1700*b* are connected by a predetermined network (for example, a predetermined cable). It is to be noted that the PTS terminal 1700 uses a data interface which is commonalized for gaming machines to communicate data and can be thereby incorporated into each of a variety of types of gaming machines manufactured by a variety of manufacturers.

Figure 6:
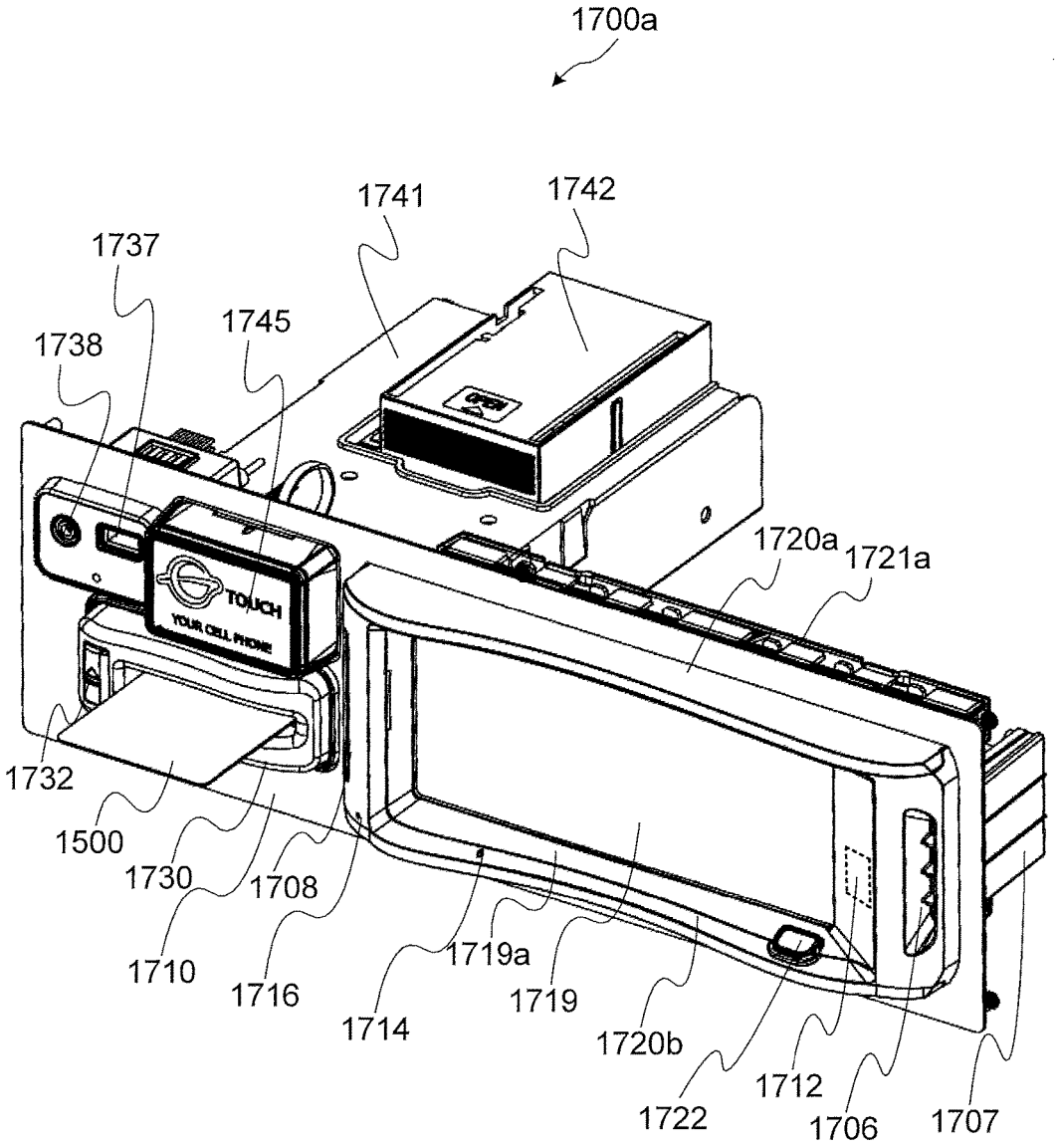
FIG. 6 is a perspective view illustrating a PTS front unit of a PTS terminal which is incorporated into the slot machine.

FIG. 6 is a diagram illustrating only the PTS front unit 1700*a* shown in FIG. 4 and FIG. 5 in an enlarged manner. As shown in FIG. 6, the PTS front unit 1700*a* has a panel 1710, respective parts located on a front face of the panel 1710 are viewable by a player, and members located on a rear face of the panel 1710 are housed inside of the cabinet 1011 of the slot machine 1010 and are not viewable by a player.

On a right side of the front face of the panel 1710, an LCD 1719 having a touch panel function is provided. The LCD 1719 displays, for example, information related to members and information for members, and a size of a screen thereof is 6.2 inches (approximately 15.7 cm). In addition, around the LCD 1719, an LCD cover 1719*a* is provided. It is to be noted that although in this example, the LCD 1719 is configured to have the touch panel function, instructions issued by a player may be inputted with other input devices such as a keyboard, a mouse, and buttons.

In addition, above the LCD 1719 and the LCD cover 1719*a*, a light emitting plate 1720*a* which is connected to LEDs and emits light is provided. The light emitting plate 1720*a* is formed of, for example, polycarbonate and is connected to a plurality of (for example, seven) full-color LEDs 1721*a* located on a rear side of the panel 1710 and emits light in accordance with light emitting of the full-color LEDs 1721*a*.

Below the LCD 1719 and the LCD cover 1719*a*, similarly, a light emitting plate 1720*b* which is connected to LEDs and emits light is provided. The light emitting plate 1720*b* is formed of, for example, polycarbonate and is connected to a plurality of (for example, seven) full-color LEDs 1721*b* (not shown) located on the rear side of the panel 1710 and emits light in accordance with light emitting of the full-color LEDs 1721*b*.

In addition, on a right side of the LCD 1719, an image pickup window 1712 is provided, and a human body detection camera 1713 (not shown) located inside of the LCD cover 1719*a* or on the rear side of the panel 1710 shoots an image of a player via this image pickup window 1712. The image pickup window 1712 may be also formed of, for example, a half mirror material which has undergone shield processing such as smoke processing.

In addition, at a position of the LCD cover 1719*a*, which is below the LCD 1719 and is on a right side, a home button 1722 is provided. The home button 1722 is a button to shift a screen displayed on the LCD 1719 to a predetermined upper level screen.

Further, at a position of the LCD cover 1719*a*, which is on the right side of the LCD 1719, a speaker duct 1706 is provided, and in a portion on the rear side of the panel 1710, which corresponds to a position of the speaker duct 1706, a bass reflex type speaker 1707 is provided. Similarly, on a left side of the LCD 1719, a speaker duct 1708 is provided, and in a portion on the rear side of the panel 1710, which corresponds to a position of the speaker duct 1708, a bass reflex type speaker 1709 (not shown) is provided. These speakers are speakers dedicated to the PTS terminal 1700 and are provided separately from the speakers 1112 for a slot machine game provided on the slot machine 1010. These speakers are capable of realizing presentation and a phone call by voice and of outputting notification sound for notifying a player that an IC card 1500 is left unremoved. It is to be noted that since the configuration thereof is made such that sound from the speakers passes through the above-described speaker ducts 1706 and 1708 and is heard in front thereof (on a player side) in a stereophonic manner, the speakers can be installed on the rear side of the panel 1710 and as a result, space-saving of the PTS front unit 1700*a* (panel face) can be realized.

In addition, at positions of the LCD cover 1719*a*, which are below the LCD 1719 and are on a left side, a microphone opening part 1714 and a microphone opening part 1716 are provided. In portions corresponding to the microphone opening part 1714 and the microphone opening part 1716 inside of the LCD cover 1719*a*, microphones 1715 and 1717 (not shown) are provided, respectively.

In a left lower portion of the front face of the panel 1710, a card insertion slot 1730 which allows the IC card 1500 to be inserted thereto and removed therefrom is provided. In a card insertion part of the card insertion slot 1730, full-color LEDs 1731 (not shown) are provided, which are lit up in a plurality of colors, thereby allowing the remaining number of IC cards 1500 stacked in the later-described card stacker 1742 to be notified. At the card insertion slot 1730, an eject button 1732 is provided, and in the vicinity of the eject button 1732, an LED 1733 (not shown) is provided, which is lit up in red, thereby allowing a position and a way of an ejection operation of the eject button 1732 to be found.

In addition, in positions on a rear side of the panel 1710, which correspond to the card insertion slot 1730, a card unit 1741 and the card stacker 1742 are provided, and the card insertion slot 1730 is configured as one part of the card unit 1741. In the card stacker 1742, approximately 30 IC cards 1500 can be retained, and when a player who has newly played a unit game makes settlement of credits, an IC card 1500 retained in the card stacker 1742 is taken out and ejected to the card insertion slot 1730.

For the IC card 1500 taken in from the card insertion slot 1730 and retained in the card unit 1741, upon the settlement of credits, credit information is updated by NFC or the like, and thereafter, the IC card 1500 is ejected from the card insertion slot 1730. While a player is playing a unit game, the IC card 1500 is completely housed inside of the card unit 1741.

In addition, in a case where upon the settlement of credits, even though the IC card 1500 has been left unremoved, absence of a player is detected by the human body detection camera or the like, the configuration may also be arranged such that the IC card 1500 can be retained in the card stacker 1742. Thus, for example, even in a case where a player has learned that the remaining number of credits is small and yet has left his or her seat with the IC card 1500 left unremoved or in a case where a player has simply forgotten to remove the IC card 1500 and has left his or her seat, it does not occur that the IC card 1500 is left retained in the card unit 1741 over a long period of time.

In positions on a upper left side of the front face of the panel 1710, a USB terminal 1737 and an audio terminal 1738 are provided. The USB terminal 1737 is configured to allow battery charge or the like by connecting a USB device thereto. In addition, the audio terminal 1738 is, for example, a four-pole terminal, and a headset is inserted thereto, thereby allowing a phone call with other person to be made with headphones and the microphones. In addition, the audio terminal 1738 may be configured to be a two-pole or three-pole terminal, thereby allowing sound to be listened with the headphones.

On the front face of the panel 1710 and on the left side of the LCD 1719, a touch unit 1745 is provided. The touch unit 1745 includes an RFID module which can function as a writer to write data through data communication to an IC device (for example, a non-contact IC card, a mobile phone and a smartphone, each of which has a communication function by NFC, and the like) including an IC chip and which can function as a reader to read data through the data communication from said IC device. In addition, in four corners of the front face of the touch unit 1745, LEDs 1746 (not shown) are located, respectively. In addition, besides the touch unit 1745 or instead of the touch unit 1745, an information recording medium reading device for reading information stored in an information recording medium such as a magnetic card may be provided. In this case, instead of the IC card 1500, the magnetic card may be a membership card.

As described above, the PTS front unit 1700*a* according to the present embodiment is formed such that the variety of devices having the microphone function, the camera function, the speaker function, the display function, and the like are integrated into one unit, thus realizing space-saving. In addition, although hereinabove, the PTS front unit 1700*a* is described as the apparatus having the configuration shown in FIG. 6, the PTS front unit 1700*a* may be each of apparatuses having a variety of other configurations.

[Configuration of Circuitry Included in Slot Machine]

Figure 7:
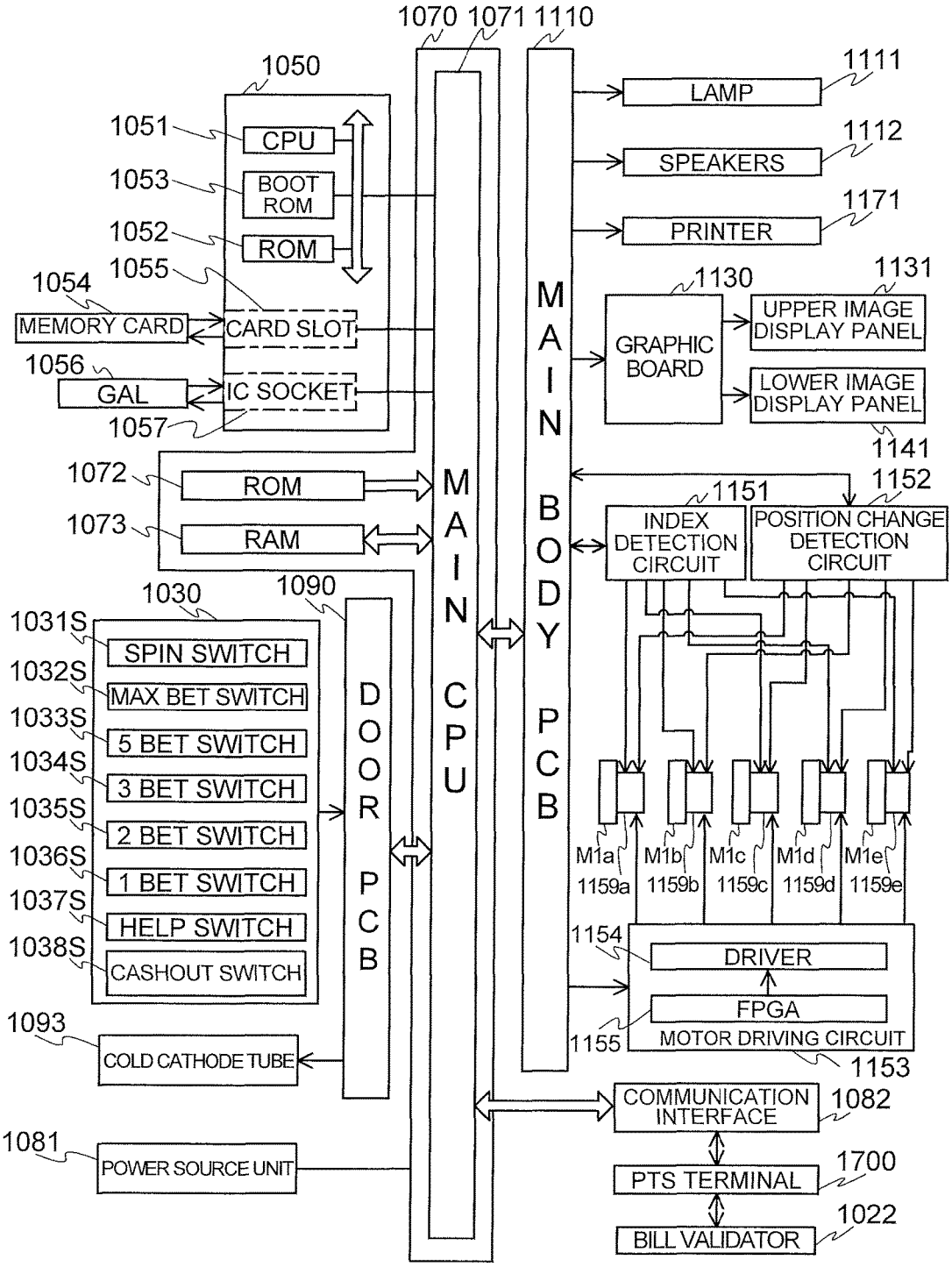
FIG. 7 is a diagram showing a circuit configuration of the slot machine.

Next, with reference to FIG. 7, a configuration of circuitry included in a slot machine 1010 will be described.

A gaming board 1050 is provided with: a CPU 1051, a ROM 1052, and a boot ROM 1053, which are mutually connected by an internal bus; a card slot 1055 corresponding to a memory card 1054; and an IC socket 1057 corresponding to a GAL (Generic Array Logic) 1056.

The memory card 1054 includes a non-volatile memory and stores a game program and a game system program. The game program includes a program related to game progression and a program for producing presentation by images and sounds. In addition, the above-mentioned game program includes a symbol determination program. The symbol determination program is a program for determining symbols to be rearranged.

In addition, the card slot 1055 is configured so that the memory card 1054 can be inserted thereinto and removed therefrom and is connected to a motherboard 1070 by an IDE bus. Accordingly, the memory card 1054 is pulled out from the card slot 1055, another game program is written into the memory card 1054, and that memory card 1054 is inserted into the card slot 1055, thereby allowing a kind and contents of a game played on the slot machine 1010 to be changed.

The GAL 1056 is a type of a PLD (Programmable Logic Device) having a fixed OR array structure. The GAL 1056 is provided with a plurality of input ports and output ports, and predetermined input into the input port causes output of the corresponding data from the output port.

In addition, the IC socket 1057 is configured so that the GAL 1056 can be inserted thereinto and removed therefrom and is connected to the motherboard 1070 by a PCI bus. The contents of the game to be played on the slot machine 1010 can be changed by replacing the memory card 1054 with another memory card 1054 having another program written therein or by rewriting the program written into the memory card 1054 as another program.

The CPU 1051, the ROM 1052 and the boot ROM 1053 mutually connected by the internal bus are connected to the motherboard 1070 by a PCI bus. The PCI bus enables a signal transmission between the motherboard 1070 and the gaming board 1050 and power supply from the motherboard 1070 to the gaming board 1050.

The ROM 1052 stores an authentication program. The boot ROM 1053 stores a pre-authentication program, a program (boot code) to be used by the CPU 1051 for activating the pre-authentication program, and the like.

The authentication program is a program (tamper check program) for authenticating the game program and the game system program. The pre-authentication program is a program for authenticating the above-mentioned authentication program. The authentication program and the pre-authentication program are written along a procedure (authentication procedure) for proving that the program to be the subject has not been tampered.

The mother board 1070 is configured by using a commercially available general-purpose mother board (printed circuit board having basic components of a personal computer mounted thereon) and includes a main CPU 1071, a ROM (Read Only Memory) 1072, a RAM (Random Access Memory) 1073, and a communication interface 1082. Here, the main CPU 1071 corresponds to a controller 1100 of the slot machine 1010.

The ROM 1072 includes a memory device such as a flash memory and stores a program such as a BIOS (Basic Input/Output System) to be executed by the main CPU 1071 and permanent data. When the BIOS is executed by the main CPU 1071, processing for initializing predetermined peripheral devices is conducted; and further, through the gaming board 1050, processing of loading the game program and the game system program stored in the memory card 1054 is started. It is to be noted that in the present invention, the ROM 1072 may be a ROM in which contents are rewritable or a ROM in which contents are un-rewritable.

The RAM 1073 stores data and programs such as the symbol determination program which are used in operation of the main CPU 1071. For example, when the processing of loading the above-mentioned game program, game system program, or authentication program is conducted, the RAM 1073 can store the program. The RAM 1073 is provided with working areas used for operations in execution of these programs. Examples of the areas include: areas that stores counters for managing the number of games, the number of BETs, the number of payout, the number of credits, and the like; an area that stores symbols (code numbers) determined by a drawing; and the like.

The communication interface 1082 is to control transmission and reception of data between a PTS terminal 1700 and the main CPU 1071. In addition, the motherboard 1070 is connected with the later-described door PCB (Printed Circuit Board) 1090 and a main body PCB 1110 by respective USBs. The motherboard 1070 is also connected with a power supply unit 1081.

When the power is supplied from the power supply unit 1081 to the motherboard 1070, the main CPU 1071 of the motherboard 1070 is activated, and then the power is supplied to the gaming board 1050 through the PCI bus so as to activate the CPU 1051.

The door PCB 1090 and the main PCB 1110 are connected with input devices such as switches and sensors and peripheral devices, the operations of which are controlled by the main CPU 1071.

The door PCB 1090 is connected with a control panel 1030 and a cold cathode tube 1093.

The control panel 1030 is provided with a spin switch 1031S, a MAX-BET switch 1032S, a 5-BET switch 1033S, a 3-BET switch 1034S, a 2-BET switch 1035S, a 1-BET switch 1036S, a HELP switch 1037S, and a CASHOUT switch 1038S which correspond to the above-mentioned respective buttons. Each of the switches outputs a signal to the main CPU 1071 upon detection of pressing of the button corresponding thereto by a player.

The cold cathode tube 1093 functions as a backlight installed on the rear face sides of the upper image display panel 1131 and the lower image display panel 1141 and lights up based on a control signal outputted from the main CPU 1071.

The main body PCB 1110 is connected with a lamp 1111, speakers 1112, a printer 1171, and a graphic board 1130. It is to be noted that although in this example, a bill validator 1022 is connected to the PTS terminal 1700, a configuration in which the bill validator 1022 is connected to the slot machine 1010 may be adopted.

The lamp 1111 lights up based on a control signal outputted from the main CPU 1071. The speakers 1112 outputs sounds such as BGM, based on a control signal outputted from the main CPU 1071. Based on a control signal outputted from the main CPU 1071, the printer 1171 prints on a ticket, for example, a barcode representing encoded data of a number of credits, date and time, an identification number of a slot machine 1010, and the like stored in the RAM 1073 and then outputs the ticket as a ticket with a barcode.

It is to be noted that the upper image display panel 1131 and the lower image display panel 1141 may be configured as touch panels. Each of the touch panel detects a position where a finger or the like of a player touches and outputs a signal corresponding to the detected position to the main CPU 1071.

The bill validator 1022 identifies whether or not bills are authentic and accepts authentic bills into the cabinet 1011. An amount of the bills inputted into the cabinet 1011 is converted to a number of coins and a credit which is equivalent to the converted number of coins is added as a credit which a player has.

The graphic board 1130 controls display of images conducted by the respective upper image display panel 1131 and lower image display panel 1141 based on control signals outputted from the main CPU 1071. The graphic board 1130 is provided with a VDP (Video Display Processor) generating image data, a video RAM storing the image data generated by the VDP, and the like. It is to be noted that the image data used in generation of image data by the VDP is included in the game program which has been read from the memory card 1054 and stored into the RAM 1073.

A motor driving circuit 1153 includes an FPGA (Field Programmable Gate Array) 1155 and a driver 1154. Connected to the motor driving circuit 1153 are stepping motors 1159*a* to 1159*e* for rotating the respective reels M1*a* to M1*e*. The FPGA 1155 is a programmable electronic circuit such as LSI and functions as a control circuit for the stepping motors

1159*a* to 1159*e*. The driver 1154 functions as an amplifying circuit for pulses inputted to the stepping motors 1159*a* to 1159*e*.

An index detection circuit 1151 is to detect a position of each of the reels M1*a* to M1*e* which are rotating and further, is capable of detecting losing of steps of each of the reels M1*a* to M1*e*. A position change detection circuit 1152 detects a change of a position where each of the reels M1*a* to M1*e* has stopped. For example, in a case where although in reality, a combination of symbols displayed after stopping of the reels M1*a* to M1*e* is not associated with any of combinations of symbols related to winning, the position where each of the reels M1*a* to M1*e* has stopped is changed by an external action such as a fraudulent act so as to establish any of combinations of symbols related to winning, the position change detection circuit 1152 detects the change of the position where each of the reels M1*a* to M1*e* has stopped. The position change detection circuit 1152 is configured to detect, for example, fins (not shown) attached at predetermined intervals to internal portions of each of the reels M1*a* to M1*e* and to be capable of thereby detecting the change of the position where each of the reels M1*a* to M1*e* has stopped.

It is to be noted that an excitation system of the stepping motors 1159*a* to 1159*e* is not particularly limited and a 1-2 phase excitation system or a 2 phase excitation system may be adopted. In addition, instead of the stepping motors, DC motors may be adopted. In a case where the DC motors are adopted, connected to the main body PCB 110 are a deviation counter, a D/A converter, and a servo amplifier in this order, and the DC motors are connected to the servo amplifier. In addition, rotation positions of the DC motors are detected by a rotary encoder, current rotation positions of the DC motors are supplied as data from the rotary encoder to the deviation counter.

It is to be noted although the configuration of the circuitry of the slot machine 1010 is described as the configuration shown in FIG. 7 hereinabove, a variety of other configurations may be adopted.

[Circuitry Configuration of PTS Terminal]

Figure 8:
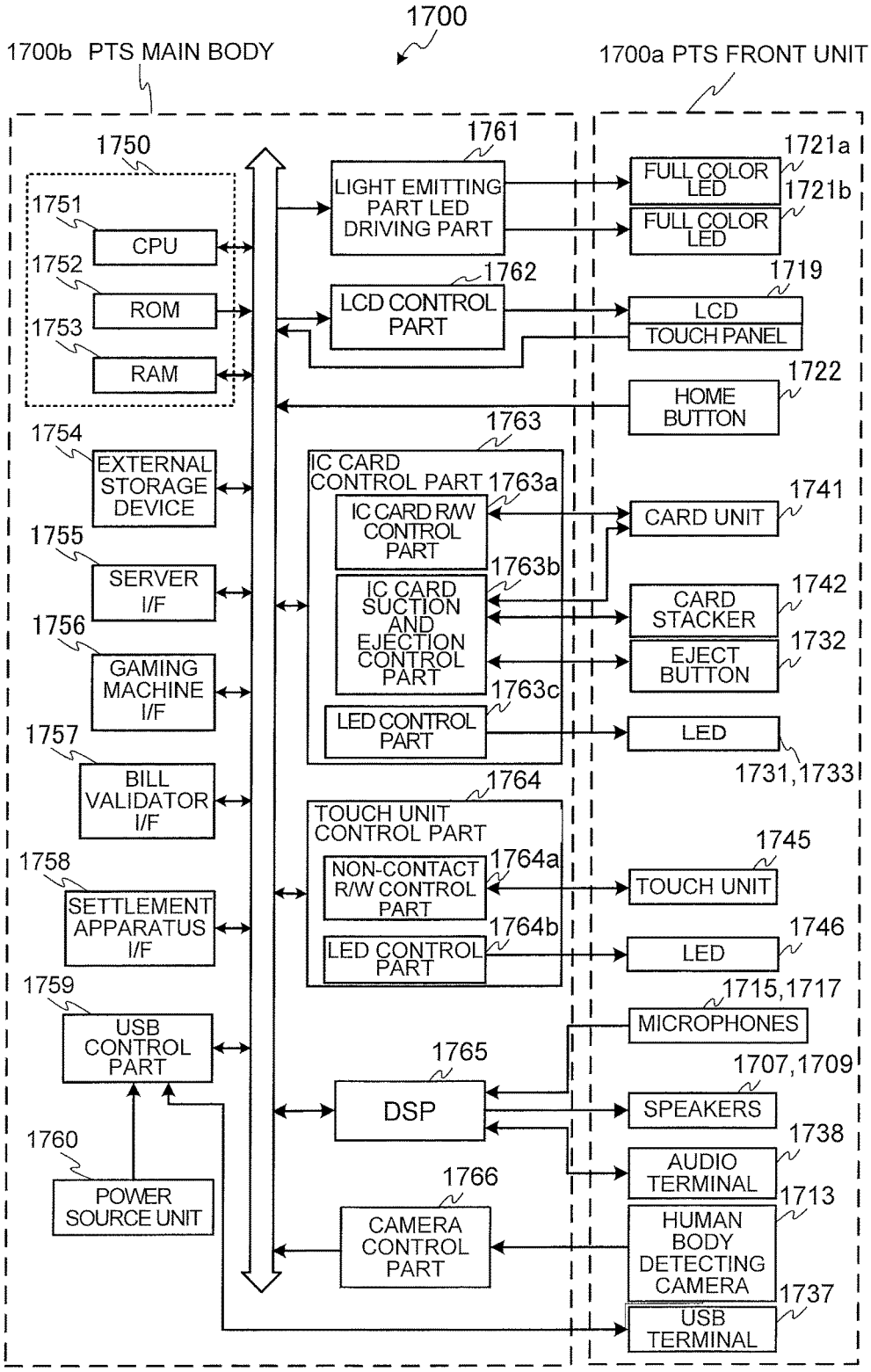
FIG. 8 is a diagram showing a circuitry configuration of the PTS terminal.

Next, with reference to FIG. 8, a configuration of circuitry or the like which a PTS terminal 1700 includes will be described. As described above, the PTS terminal 1700 includes a PTS front unit 1700*a* and a PTS main body 1700*b*. In FIG. 8, however, the circuitry or the like which the PTS terminal 1700 includes is shown by dividing the circuitry or the like into circuitry or the like included in the PTS front unit 1700*a* and circuitry or the like included in the PTS main body 1700*b*.

A PTS controller 1750 for controlling the PTS terminal 1700 has a CPU 1751, a ROM 1752, and a RAM 1753.

The CPU 1751 controls execution of each component of the PTS terminal 1700, executes a variety of programs stored in the ROM 1752, and performs computation. For example, the CPU 1751 executes a credit updating program and updates credit-related data stored in an IC card 1500.

The ROM 1752 is constituted of a memory device such as a flash memory and has stored therein permanent data executed by the CPU 1751. For example, in the ROM 1752, a credit updating program for rewriting credit-related data stored in the IC card 1500 or the like can be stored.

The RAM 1753 temporarily stores data required upon executing a variety of programs stored in the ROM 1752.

An external storage device 1754 is a storage device, for example, such as a hard disk device and stores a program executed by the CPU 1751 and data which a program executed by the CPU 1751 uses.

A server I/F (interface) 1755 realizes data communication between servers such as a hall management server 10, a jackpot server 11, and the like and the PTS terminal 1700. A gaming machine I/F (interface) 1756 realizes data communication between a slot machine 1010 and the PTS terminal 1700, and for said data communication, a specified protocol can be used.

Besides, the PTS terminal 1700 is connected to a bill validator 1022 via a bill validator I/F (interface) 1757 and connected to a settlement apparatus 1868 via a settlement apparatus I/F (interface) 1758 and is capable of performing transmission and reception of data as needed.

A USB control part 1759 determines whether on a USB terminal 1737, power is supplied from a power supply unit 1760 and when a predetermined condition is satisfied, enables the recharging on the USB terminal 1737. When the predetermined condition is satisfied, a player connects an electronic device to the USB terminal 1737, thereby allowing said electronic device to be recharged.

A light emitting part LED driving part 1761 performs control such that in order to cause an upper light emitting plate 1720*a* of an LCD 1719 to emit light, full-color LEDs 1721*a* are lit up at predetermined timing and performs control such that in order to cause a lower light emitting plate 1720*b* of the LCD 1719 to emit light, full-color LEDs 1721*b* are lit up at predetermined timing.

An LCD control part 1762 performs control to cause the LCD 1719 to display information pertinent to members, information for the members, and the like and to display data read out from an IC card 1500 and data inputted by a player. In addition, the LCD 1719 has a touch panel function and when a touch panel is operated by a player, a predetermined signal is transmitted to the CPU 1751.

A home button 1722 is provided in the vicinity of the LCD 1719 and is a button for shifting a screen displayed on the LCD 1719 to a predetermined upper level screen. When the home button 1722 is pressed by a player, that operation by a player is transmitted to the CPU 1751, and the CPU 1751 transmits an instruction to the LCD control part 1762 to update the display on the LCD 1719 in accordance with said operation.

An IC card control part 1763 performs control for insertion and ejection of an IC card 1500, writing of credit data thereto, and the like. The IC card control part 1763 includes an IC card R/W (reader/writer) control part 1763*a*, an IC card suction and ejection control part 1763*b*, and an LED control part 1763*c*.

The IC card R/W control part 1763*a* controls a card unit 1741 and updates credit-related data stored in an IC card 1500. In addition, when an IC card 1500 is newly issued, credit-related data corresponding a settled money amount is stored. The card unit 1741 has an antenna part for reading data by an NFC or the like from the IC card 1500 or writing the data thereto.

Although the card unit 1741 has functions of an IC card reader for reading information stored in an IC card 1500 and an IC card writer for writing information to an IC card 1500, the card unit 1741 may have a function of either one of the IC card reader and the IC card writer as needed.

The IC card suction and ejection control part 1763*b* performs control for suction and ejection of an IC card 1500. When an IC card 1500 is inserted by a player into the card insertion slot 1730, the IC card suction and ejection control part 1763*b* performs control to retain the IC card while a player is executing a game. In addition, after the credit-related data has been written in the IC card 1500 upon the settlement, the IC card suction and ejection control part 1763*b* performs control to eject that IC card 1500. Further, when an eject button 1732 is pressed, the IC card suction and ejection control part 1763*b* ejects the IC card 1500.

In addition, when an IC card 1500 is newly issued, the IC card suction and ejection control part 1763*b* newly takes out an IC card 1500 from a card stacker 1742 and in order to cause the IC card 1500 to store credit-related data, supplies the IC card 1500 to the card unit 1741.

The LED control part 1763*c* performs control to light up LEDs (full-color LEDs 1731) provided in the vicinity of the card insertion slot 1730 of the card unit 1741 and to light up an LED (red LED 1733) provided in the vicinity of the eject button 1732.

A touch unit control part 1764 controls data transmission and reception associated with a touch operation on an IC card 1500, a mobile phone, a smartphone, or the like. The touch unit control part 1764 includes a non-contact R/W (reader/writer) control part 1764*a* and an LED control part 1764*b*.

The non-contact R/W control part 1764*a* determines whether or not the IC card 1500 or the mobile phone comes near within a predetermined distance (for example, a touch operation has been conducted) with a touch unit 1745, and when the IC card 1500 or the mobile phone has come near within the predetermined distance, the non-contact R/W control part 1764*a* obtains a reading-out result from the touch unit 1745. The touch unit 1745 has an antenna part for performing data transmission and reception to and from the IC card 1500 or the mobile phone by an NFC or the like.

Although the touch unit 1745 has functions of the IC card reader for reading information stored in the IC card 1500 or the mobile phone and the IC card writer for writing information to the IC card 1500 or the mobile phone, the touch unit 1745 may have a function of either one thereof as needed.

The LED control part 1764*b* controls LEDs 1746 located in four corners of a front face of the touch unit 1745 to light up the LEDs 1746 at predetermined timing.

A DSP 1765 receives sound data obtained from microphones 1715 and 1717 and conducts predetermined processing for the sound data and thereafter, transmits the processed data to the CPU 1751. In addition, the DSP 1765 transmits the received sound data to speakers 1707 and 1709. Further, the DSP 1765 outputs the sound, received to an audio terminal connected with a headset, to headphones and processes the sound received from the microphones and transmits the processed sound to the CPU 1751. It is to be noted that here, the configuration of the outline is described and the description of an A/D converter, a D/A converter, an amplifier, and the like are omitted.

A camera control part 1766 obtains an image of a player or the like shot by a human body detection camera 1713, subjects the image to predetermined image processing as needed, and transmit the processed data to the CPU 1751. Said data is transmitted, for example, via a server I/F 1755 to the hall management server 10, the membership management server 12, and the like.

It is to be noted that although hereinabove, the circuitry configuration of the PTS terminal 1700 is descried as the configuration shown in FIG. 8, a variety of other configurations may be adopted.

[Configuration of Symbol Combination Table]

Next, with reference to FIG. 9, a symbol combination table will be described.

The symbol combination table specifies combinations of drawn symbols related to winning and the numbers of payout. On a slot machine 1010, the rotation of symbol arrays of five reels M1*a* to M1*e* (a first reel to a fifth reel) of a reel apparatus M1 is stopped, and winning is established when the combination of symbols displayed along a winning line matches one of the combinations of symbols specified by the symbol combination table. According to the winning combination, a benefit such as payout of a credit or the like is provided for a player. It is to be noted that winning is not established (i.e. the game is lost) when the combination of symbols displayed along the winning line does not match any of the combinations of symbols specified by the symbol combination table.

Basically, winning is established when all symbols displayed along the winning line by all of the five reels M1*a* to M1*e* are of one kind out of kinds of symbols "RED", "APPLE", "BLUE 7", "BELL", "CHERRY", "STRAWBERRY", "PLUM", and "ORANGE". However, with respect to the respective kinds of symbols "CHERRY" and "ORANGE", winning is also established when one or three symbols of either kind are displayed along the winning line by the reel or the reels.

For example, when all the symbols displayed along the winning line by all of the five reels M1*a* to M1*e* of the reel apparatus M1 are the symbols "BLUE 7", the winning combination is a "BLUE" combination, and "10" is determined as the number of payout. Based on the determined number of payout, the provision of a credit is conducted. The provision of the credit is conducted, for example, such that the added credit is stored in the IC card 1500 and thereafter, the IC card 1500 is ejected from the card insertion slot 1730.

[Contents of program executed on slot machine]

Next, with reference to FIG. 10 to FIG. 16, one example of a program executed on a slot machine 1010 will be described.

<Main Control Process>

Figure 10:
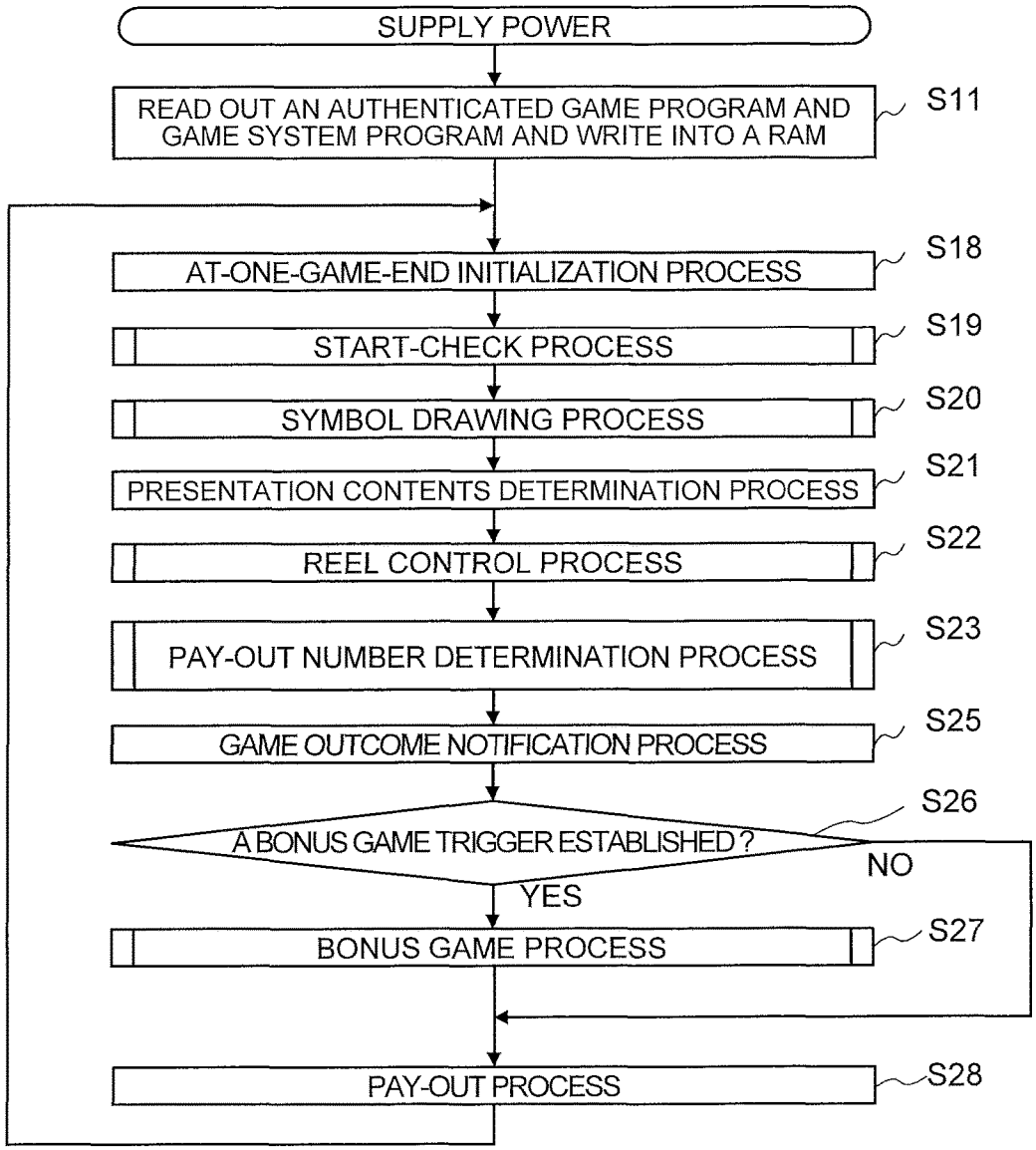
FIG. 10 is a flowchart showing a procedure of a main control process executed on the slot machine.

First, with reference to FIG. 10, a main control process will be described. FIG. 10 is a flowchart of the main control process executed on a slot machine 1010 according to the embodiment of the present invention.

First, when the power is supplied to the slot machine 1010, a main CPU 1071 reads the authenticated game program and game system program from a memory card 1054 via a gaming board 50 and writes the programs into a RAM 1073 (step S11).

Next, the main CPU 1071 conducts an at-one-game-end initialization process (step S18). For example, data that becomes unnecessary after each game in working areas of the RAM 1073, such as the number of BETs and the symbols determined by a drawing, is cleared.

Next, the main CPU 1071 conducts a start-check process which is described later (step S19). In this process, input from a BET switch and a spin switch is checked.

Next, the main CPU 1071 conducts a symbol drawing process which is described later (step S20). In this process, to-be stopped symbols are determined based on random number values for symbol determination.

Next, the main CPU 1071 conducts a presentation contents determination process (step S21). The main CPU 1071 extracts random number values for presentation and determines any of the presentation contents from a predetermined plurality of presentation contents by a drawing. The presentation contents can be determined in accordance with a winning combination and a state of a game on the slot machine 1010. For example, the configuration can be arranged such that in accordance with winning combinations and the states of the game on the slot machine 1010, drawing probabilities related to respective presentation contents are made different from one another.

Next, the main CPU 1071 conducts a reel control process which is described later (step S22). In this process, rotation of five reels M1*a* to M1*e* (a first reel to a fifth reel) of a reel apparatus M1 is started, and the to-be stopped symbols determined in the symbol drawing process at step S20 are stopped in predetermined positions (for example, in a symbol display window 1135). In other words, three symbols including the to-be stopped symbols with respect to each of the reels are displayed in the symbol display window 1135.

Next, the main CPU 1071 conducts a to-be-paid-out number determination process which is described later (step S23). In this process, based on a combination of symbols displayed on a winning line L, a to-be-paid-out number is determined and stored in a to-be-paid-out number storage region provided in the RAM 1073.

Next, the main CPU 1071 conducts a game outcome notification process (step S25). In this process, data which includes termination time at which a unit game is terminated (for example, time at which the to-be-paid-out number determination process is conducted); game contents (for example, a to-be-paid-out number); and an identification code for identifying the slot machine 1010 is transmitted to a PTS terminal 1700. In addition, when a player can be identified with an IC card 1500 or the like being inserted, an identification code of a member associated with the IC card 1500 is also transmitted to the PTS terminal 1700. The PTS terminal 1700 transmits this data to a hall management server 10, and on the hall management server 10, this data is accumulated as information (game information) pertinent to a game progress for each player playing games and for each machine.

Next, the main CPU 1071 determines whether or not a bonus game trigger has been established (step S26). When the main CPU 1071 determines that the bonus game trigger has been established, the main CPU 1071 conducts a bonus game process which is described later (step S27).

After the process at step S27 or when determining at step S26 that the bonus game trigger has not been established, the main CPU 1071 conducts a paying-out process (step S28). The main CPU 1071 adds a value stored in the to-be-paid-out number storage region to a number-of-credits storage region provided in the RAM 1073. Here, for example, when a player presses a CASHOUT button, a CASHOUT switch 1038S which has detected the pressing thereof outputs a signal to the main CPU 1071 and the value in the number-of-credits storage region is added to the number of credits stored in the IC card 1500 held by a card unit 1741. It is to be noted that a ticket with a barcode may be issued by a printer 1171. After finishing the paying-out process, the main CPU 1071 returns to the process at S18 and the unit game is repeated.

<Start-Check Process>

Figure 11:
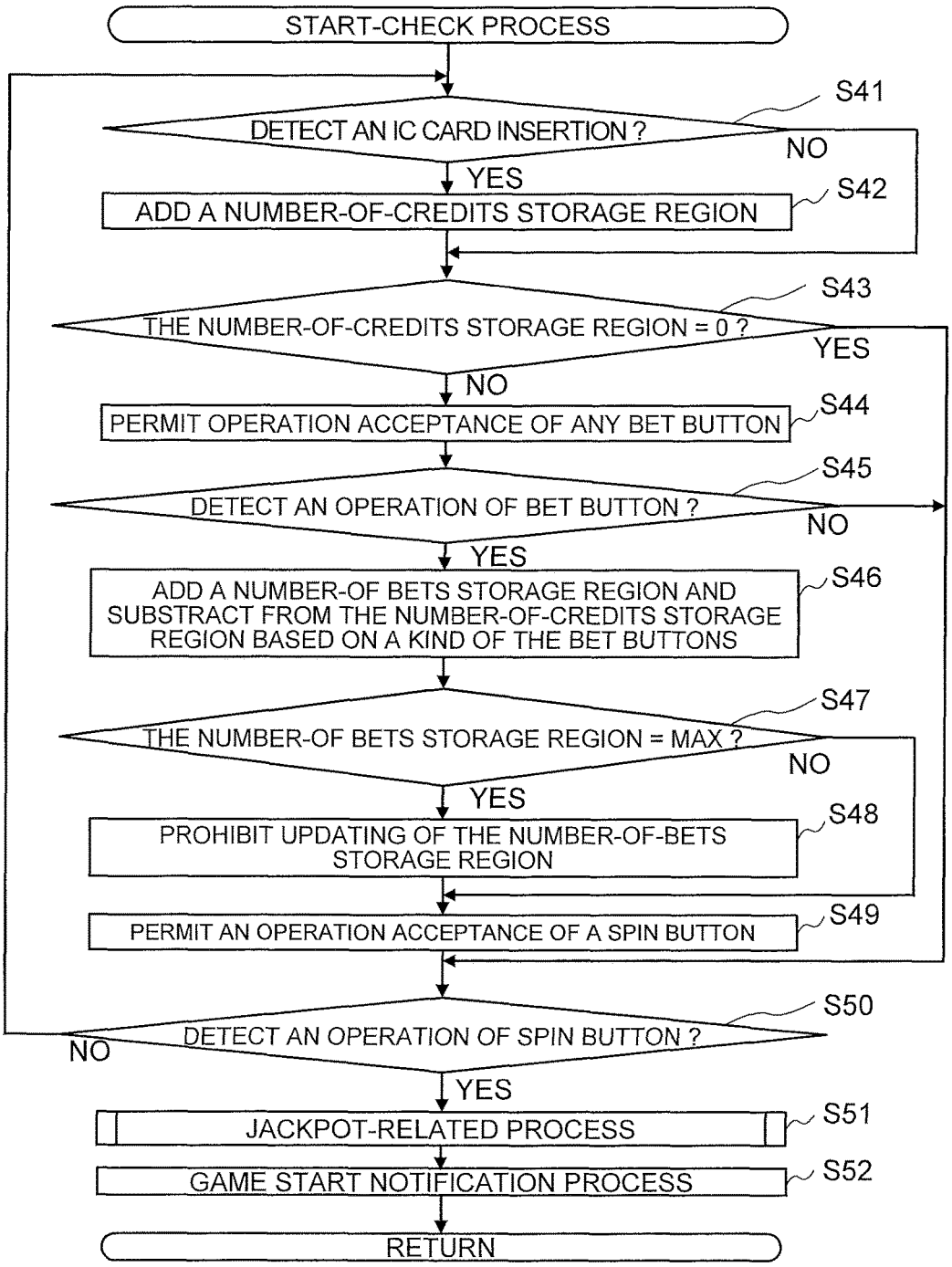
FIG. 11 is a flowchart showing a procedure of a start-check process executed on the slot machine.

Next, with reference to FIG. 11, a start-check process will be described. FIG. 11 is a flowchart of the start-check process executed on a slot machine 1010 according to the present embodiment of the present invention.

The main CPU 1071 determines whether or not an IC card 1500 inserted from a card insertion slot 1730 has been held by a card unit 1741 and whether or not bills are inputted into a bill validator 1022 (step S41). When the main CPU 1071 determines that the insertion of the IC card 1500 or the inputting of the bills has been detected, authenticity of said IC card 1500 or said bills are confirmed and thereafter, addition thereof to a number-of-credits storage region is performed (step S42).

After the process at step S42 or when determining at step S41 that the insertion of the IC card 1500 or the like has not been detected, the main CPU 1071 determines whether or not a value stored in the number-of-credits storage region is zero (step S43). When the main CPU 71 determines that the value stored in the number-of-credits storage region is not zero, the main CPU 71 permits operation acceptance of a BET button (for example, any of a MAX BET button 1032, a 5-BET button 1033, a 3-BET button 1034, a 2-BET button 1035, and a 1-BET button 1036) (step S44).

Next, the main CPU 1071 determines whether or not operation of any of the BET buttons has been detected (step S45). When the pressing of any BET button by a player has been detected by a BET switch (for example, any of a MAX-BET switch 1032S, a 5-BET switch 1033S, a 3-BET switch 1034S, a 2-BET switch 1035S, a 1-BET switch 1036S), the main CPU 1071 performs addition to a number-of-BETs storage region provided in the RAM 1073 and subtraction from the number-of-credits storage region based on the kind of the BET button (step S46).

Next, the main CPU 1071 determines whether or not a value stored in the number-of-BETs storage region is at its maximum (step S47). When the main CPU 1071 determines that the value stored in the number-of-BETs storage region is at its maximum, the main CPU 1071 prohibits updating of the value stored in the number-of-BETs storage region (step S48). After step S48 or when determining at step S47 that the value stored in the number-of-BETs storage region is not at its maximum, the main CPU 71 permits operation acceptance of a spin button (step S49).

After step S49 or when determining at step S45 that the operation of any of the BET buttons has not been detected, or when determining at step S43 that the value stored in the number-of-credits storage region is zero, the main CPU 1071 determines whether or not operation of the spin button has been detected (step S50). When the main CPU 1071 determines that the operation of the spin button has not been detected, the main CPU 1071 shifts the processing to step S41.

When the main CPU 1071 determines that the operation of the spin button has been detected, the main CPU 1071 conducts a jackpot-related process which is described later. In this process, one part of the bet credit is paid out via a PTS terminal 1700 to a jackpot server 11, for example, as a jackpot amount to be accumulated for a jackpot (step S51).

Next, the main CPU 1071 conducts a game start notification process (step S52). In this process, data which includes game start time at which a unit game is started; game contents (for example, a BET number); and an identification code for identifying a slot machine 1010 is transmitted to the PTS terminal 1700. In addition, when a player can be identified with an IC card 1500 or the like being inserted, an identification code of a member associated with the IC card 1500 is also transmitted to the PTS terminal 1700. The PTS terminal 1700 transmits this data to a hall management server 10, and on the hall management server 10, this data is accumulated as information (game information) pertinent to a game progress for each player playing games and for each machine. After the process at step S52 has been conducted, the start-check process is completed.

<Symbol Drawing Process>

Figure 12:
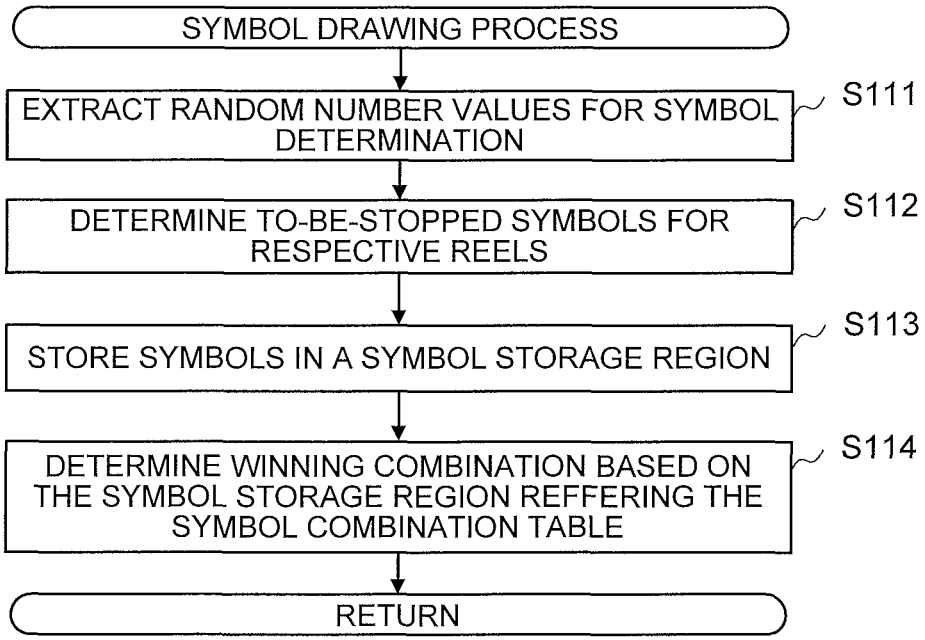
FIG. 12 is a flowchart showing a procedure of a symbol drawing process executed on the slot machine.

Next, with reference to FIG. 12, a symbol drawing process will be described. FIG. 12 is a flowchart of the symbol drawing process executed on a slot machine 1010 according to the embodiment of the present invention.

First, the main CPU 1071 extracts random number values for symbol determination (step S111). Next, the main CPU 1071 determines to-be stopped symbols for five reels M1*a* to M1*e* (a first reel to a fifth reel) of a reel apparatus M1 (step S112). The main CPU 1071 conducts a drawing for each of the reels and determines any of 12 symbols as to-be stopped symbols.

Next, the main CPU 1071 stores the determined to-be stopped symbols for the respective reels in a symbol storage region provided in a RAM 1073 (step S113). Next, the main CPU 1071 references a symbol combination table (FIG. 9) and determines a winning combination based on the symbol storage region (step S114). The main CPU 71 determines whether or not the combination of symbols to be displayed along a winning line by the respective reels matches any of the combinations of symbols specified by the symbol combination table and determines the winning combination. After the process has been conducted, the symbol drawing process is completed.

<Reel Control Process>

Figure 13:
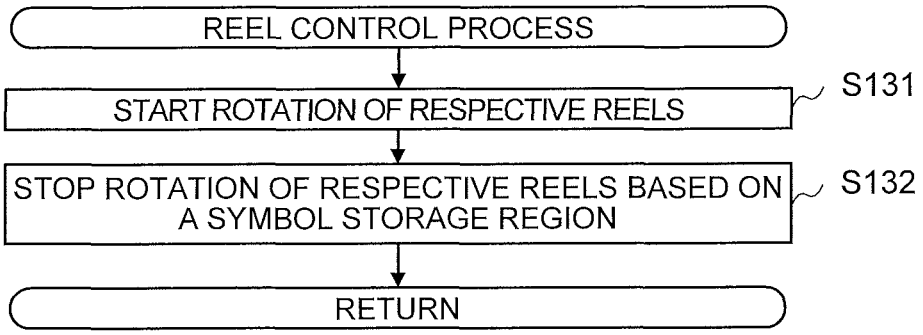
FIG. 13 is a flowchart showing a procedure of a reel control process executed on the slot machine.

Next, with reference to FIG. 13, a reel control process will be described. FIG. 13 is a flowchart of the reel control process executed on a slot machine 1010 according to the embodiment of the present invention.

First, the main CPU 1071 controls stepping motors 1159*a* to 1159*e* and starts rotation of five reels M1*a* to M1*e* of a reel apparatus M1 (step S131). Next, the main CPU 1071 controls the stepping motors 1159*a* to 1159*e* and stops the rotation of the five reels M1*a* to M1*e* based on the above-mentioned symbol storage region (step S132). After the process has been conducted, the reel control process is completed.

It is to be noted that in accordance with timing of starting and stopping of the rotation of the reels M1*a* to M1*e* in the reel control process or other timing, the presentation determined in the presentation contents determination process (FIG. 10) is executed. For example, a moving image and a still image are displayed on an upper image display panel 1131 of the slot machine 1010, sound is outputted from speakers 1112, and a lamp 1111 is lit up, thereby allowing said presentation to be executed.

<To-Be-Paid-Out Number Determination Process>

Figure 14:
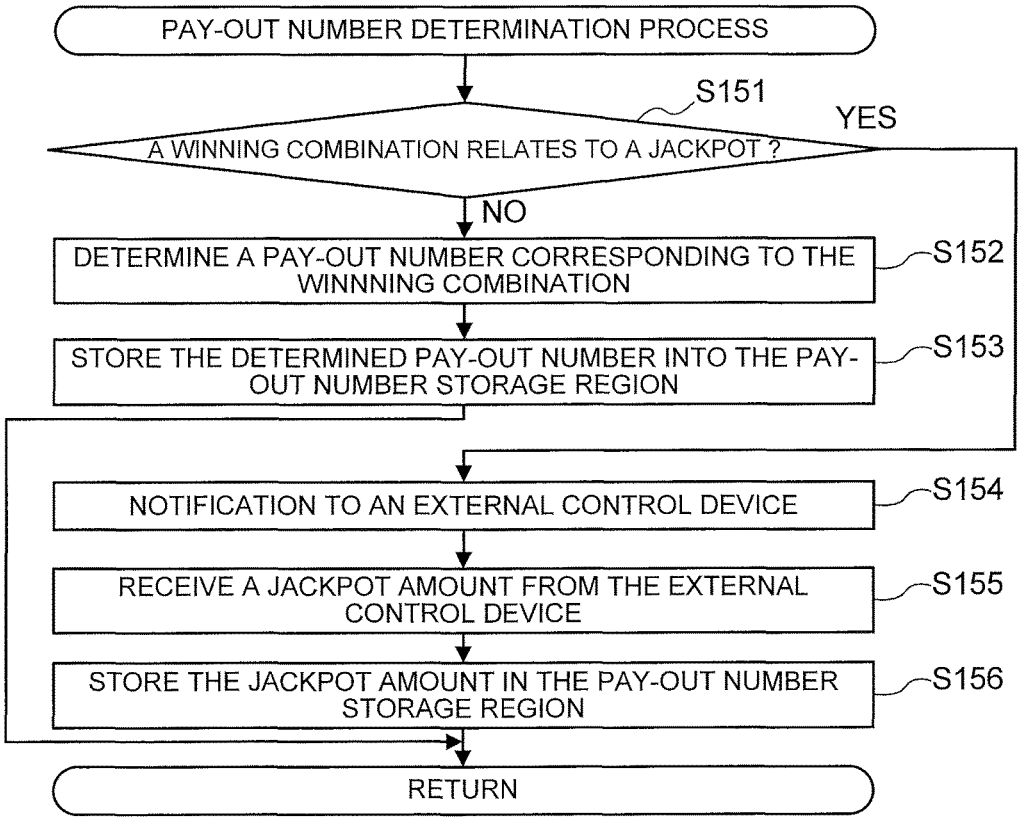
FIG. 14 is a flowchart showing a procedure of a to-be-paid-out number determination process executed on the slot machine.

Next, with reference to FIG. 14, a to-be-paid-out number determination process will be described. FIG. 14 is a flowchart of the to-be-paid-out number determination process executed on a slot machine 1010 according to the embodiment of the present invention.

First, the main CPU 1071 determines whether or not a winning combination is a combination related to a jackpot (step S151). When the main CPU 1071 determines that the winning combination is not the combination of the jackpot, the main CPU 1071 determines a to-be-paid-out number corresponding to the winning combination (step S152). For example, when the winning combination is a combination of symbols "BELL", the main CPU 1071 determines "8" as the to-be-paid-out number (refer to FIG. 9). It is to be noted that the main CPU 1071 determines "0" as the to-be-paid-out number in a case where a game is lost. Next, the main CPU 1071 stores the determined to-be-paid-out number into a to-be-paid-out number storage region (step S153). After the process has been conducted, the to-be-paid-out number determination process is completed.

When the main CPU 1071 determines that the winning combination is the combination of the jackpot, the main CPU 1071 notifies an external control device (that is, a jackpot server 11) of the winning of the jackpot (step S154). It is to be noted that upon reception of the notification, the jackpot server 11 transmits to the slot machine 1010 the amount of a jackpot having been updated up to that time. At this time, a part (e.g. 80%) of the amount of jackpot may be an amount to be paid out and the rest (e.g. 20%) may be carried over for the upcoming establishment of a jackpot trigger.

Next, the main CPU 1071 receives the jackpot amount from the jackpot server 11 (step S155). Next, the main CPU 1071 stores the received jackpot amount into the to-be-paid-out number storage region (step S156). After this process has been conducted, the to-be-paid-out number determination process is completed.

<Jackpot-related process>

Figure 15:
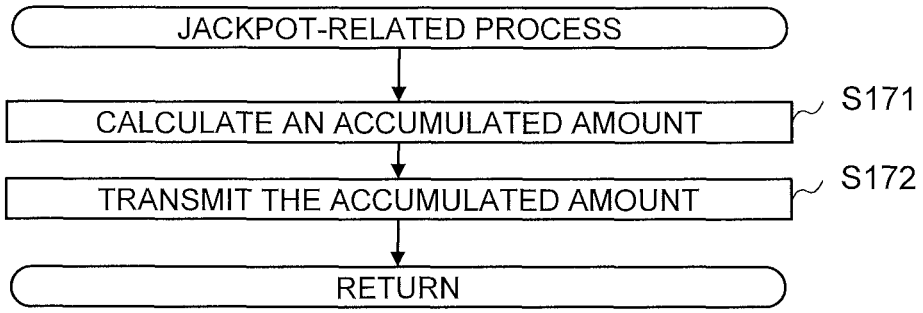
FIG. 15 is a flowchart showing a procedure of a jackpot-related process executed on the slot machine.

Next, with reference to FIG. 15, a jackpot-related process will be described. FIG. 15 is a flowchart of the jackpot-related process executed on a slot machine 1010 according to the embodiment of the present invention First, the main CPU 1071 calculates an accumulation amount (step S171). The main CPU 1071 obtains a product of a value stored in a number-of-BETs storage region and a predetermined accumulation ratio, thereby calculating the accumulation amount to the amount of a jackpot.

Next, the main CPU 1071 transmits the calculated accumulation amount to a jackpot server 11 (step S172). Upon reception of the accumulation amount, the jackpot server 11 updates the amount of the jackpot. After the process has been conducted, the jackpot-related process is completed.

<Bonus Game Process>

Figure 16:
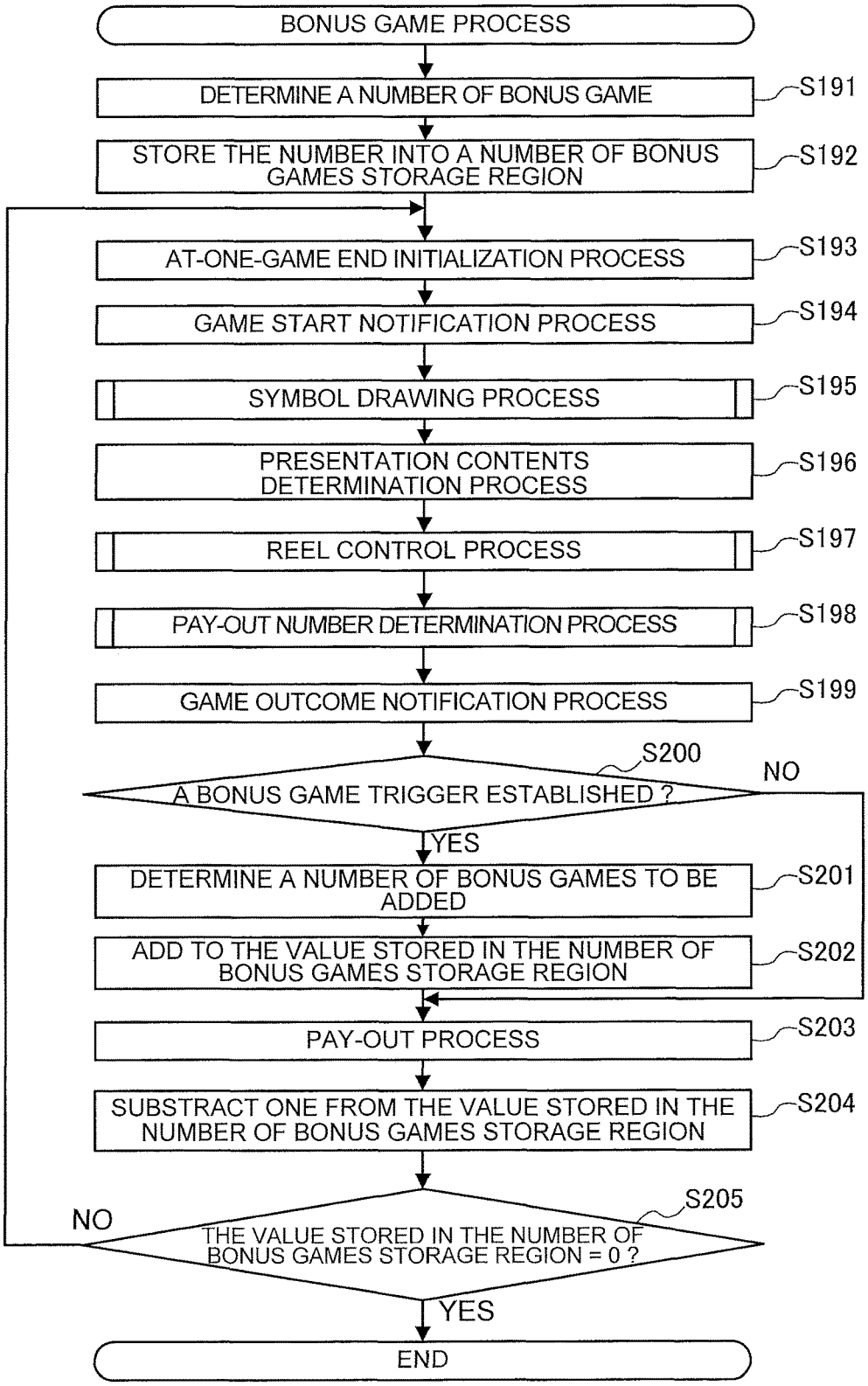
FIG. 16 is a flowchart showing a procedure of a bonus game process executed on the slot machine.

Next, with reference to FIG. 16, a bonus game process will be described. FIG. 16 is a flowchart of the bonus game process executed on a slot machine 1010 according to the embodiment of the present invention.

First, the main CPU 1071 determines a number of bonus games (step S191). The main CPU 1071 extracts random number values for number-of-bonus-games determination and determines any one of the various numbers of bonus games such as "10", "20" and "30" by a drawing.

Next, the main CPU 1071 stores the determined number of bonus games into a number-of-bonus-games storage region provided in a RAM 1073 (step S192).

Next, the main CPU 1071 conducts an at-one-game-end initialization process in the same way as the process at step S18 described with reference to FIG. 10 (step S193).

Next, the main CPU 1071 conducts a game start notification process (step S194). This process is the same as the game start notification process at step S52 shown in FIG. 11, and in this process, data which includes game start time at which a unit game (in a bonus game) is started; game contents (for example, a BET number); and an identification code for identifying a slot machine 1010 is transmitted to a PTS terminal 1700. In addition, when a player can be identified with an IC card 1500 or the like being inserted, an identification code of a member associated with the IC card 1500 is also transmitted to the PTS terminal 1700. The PTS terminal 1700 transmits this data to a hall management server 10, and on the hall management server 10, this data is accumulated as information (game information) pertinent to a game progress for each player playing games and for each machine.

Next, the main CPU 1071 conducts a symbol drawing process described with reference to FIG. 12 (step S195). Next, the main CPU 1071 conducts a presentation contents determination process, as with the process described with reference to FIG. 10 (step S196). Next, the main CPU 1071 conducts a reel control process described with reference to FIG. 13 (step S197). Next, the main CPU 1071 conducts a to-be-paid-out number determination process described with reference to FIG. 14 (step S198).

Next, the main CPU 1071 conducts a game outcome notification process (step S199). This process is the same as the game outcome notification process at step S25 shown in FIG. 10, and in this process, data which includes termination time at which a unit game (in a bonus game) is terminated (for example, time at which the to-be-paid-out number determination process is conducted); game contents (for example, a to-be-paid-out number); and an identification code for identifying the slot machine 1010 is transmitted to the PTS terminal 1700. In addition, when a player can be identified with an IC card 1500 or the like being inserted, an identification code of a member associated with the IC card 1500 is also transmitted to the PTS terminal 1700. The PTS terminal 1700 transmits this data to a hall management server 10, and on the hall management server 10, this data is accumulated as information (game information) pertinent to a game progress for each player playing games and for each machine.

Next, the main CPU 1071 determines whether or not a bonus game trigger has been established (step S200). When the main CPU 1071 determines that the bonus game trigger has been established, the main CPU 1071 determines a number of bonus games to be added (step S201). In the same way as the above-mentioned process at step S191, the main CPU 1071 determines the number of bonus games. Next, the main CPU 1071 adds the determined number of bonus games to a value stored in a number-of-bonus-games storage region (step S202).

After the process of step S202 or when determining at step S200 that the bonus game trigger has not been established, the main CPU 1071 conducts a paying-out process (step S203). In this paying-out process, the main CPU 1071 adds the value stored into the to-be-paid-out number storage region in the above-mentioned to-be-paid-out number determination process at step S198 to a value stored in a to-be-paid-out number storage region for bonuses. The to-be-paid-out number storage region for bonuses is a region for storing a total of the to-be-paid-out numbers determined during the bonus games.

When the bonus game process has been completed, the main CPU 1071 adds the value stored in the to-be-paid-out number storage region for bonuses to the value stored in the number-of-credits storage region provided in the RAM 1073, in the paying-out process at step S28 described with reference to FIG. 10. In other words, the total of the to-be-paid-out numbers determined during the bonus games is collectively paid out.

Next, the main CPU 1071 subtracts one from the value stored in the number-of-bonus-games storage region (step S204). Next, the main CPU 1071 determines whether or not a value stored in the number-of-bonus-games storage region is zero (step S205). When the main CPU 1071 determines that the value stored in the number-of-bonus-games storage region is not zero, the main CPU 1071 shifts the processing to step S193. On the other hand, when the main CPU 1071 determines that the value stored in the number-of-bonus-games storage region is zero, the main CPU 1071 completes the bonus game process. When the bonus game process has been completed, the processing is shifted to the processing at step S28 described with reference to FIG. 10.

On the slot machine 1010 according to the present embodiment, each game executed as the bonus game is each free game in which without consuming coins, a drawing related to determination of to-be stopped symbols is conducted, the free game being repeated at a number of times which is determined by a drawing as a number of bonus games. In addition, a BET number at this time is a BET number in a case where a 1-BET button 1036 is pressed by a player.

[Outline of Game Information Analysis System]

Next, with reference to FIG. 17 to FIG. 32, an outline of a game information analysis system will be described. The present game information analysis system is to obtain and analyze game information pertinent to gaming machines such as slot machines or the like installed in a hall store (or a store).

FIG. 17 is a diagram showing variations of representative operation forms of the game information analysis system. As shown in FIG. 17, as the representative operation forms of the game information analysis system, there are an online operation form for a small-scale hall store; an online operation form for a large-scale hall store; and an offline operation form, and further, as options, several appendant operation forms are prepared.

In the online operation form for the small-scale hall store, the game information analysis system includes (the later-described) analysis server for conducting an analysis process, and this analysis server obtains, from a hall management server, game information or the like required for an analysis in real time or at other timing. In addition, the hall management server receives, from a plurality of gaming machines (in the present embodiment, slot machines), information related to game states or the like and accumulates the information. Here, a number of gaming machines connected to the hall store management server is, for example, 1,000 or less, and the number thereof is a number of the gaming machines in the small-scale hall store.

In the online operation form for the large-scale hall store, as in the online operation form for the small-scale hall store, the game information analysis system includes (the later-described) analysis server for conducting an analysis process, and this analysis server obtains, from a hall management server, game information or the like required for an analysis in real time or at other timing. In addition, the hall management server receives, from a plurality of gaming machines (in the present embodiment, slot machines), information related to game states or the like and accumulates the information. Here, a number of gaming machines connected to the hall store management server is, for example, larger than 1,000, and the number thereof is a number of the gaming machines in the large-scale hall store. Because the analysis server in said operation form receives data from such a large number of gaming machines (via the hall management server) and conducts the analysis process, there may be a case where a large load is exerted on a computer resource. Therefore, a plurality of analysis servers is provided to share the analysis process, and the game information analysis system also can be thereby configured so as not to exert an excessive load on each of the analysis servers.

In the offline operation forms, as in the online operation form for the small-scale hall store, the game information analysis system is configured to include an analysis server which conducts an analysis process. However, analysis result data or the like transmitted from the analysis server to a client terminal is neither received in real time nor received via a network. The analysis result data or the like is provided for the client terminal via, for example, a portable recording medium such as a CD-ROM and a portable memory.

The game information analysis system can be configured to conduct the analysis process, as an option, by using game information or the like on a plurality of sites (for example, sites of a plurality of independent hall stores, sites of a plurality of hall stores belonging to the same group, etc.). In addition, displaying or the like of an analysis result can be instructed by a simple operation including a simple authentication-compliant operation (by the later-described client terminal connected to the analysis server). Further, as the above-mentioned client terminal, a mobile terminal such as a smartphone, a mobile phone, and a PDA can be used. The game information or the like is obtained from a hall management server or hall management servers or the like of the existing system, thereby allowing linkage between the systems to be realized.

Figure 18:
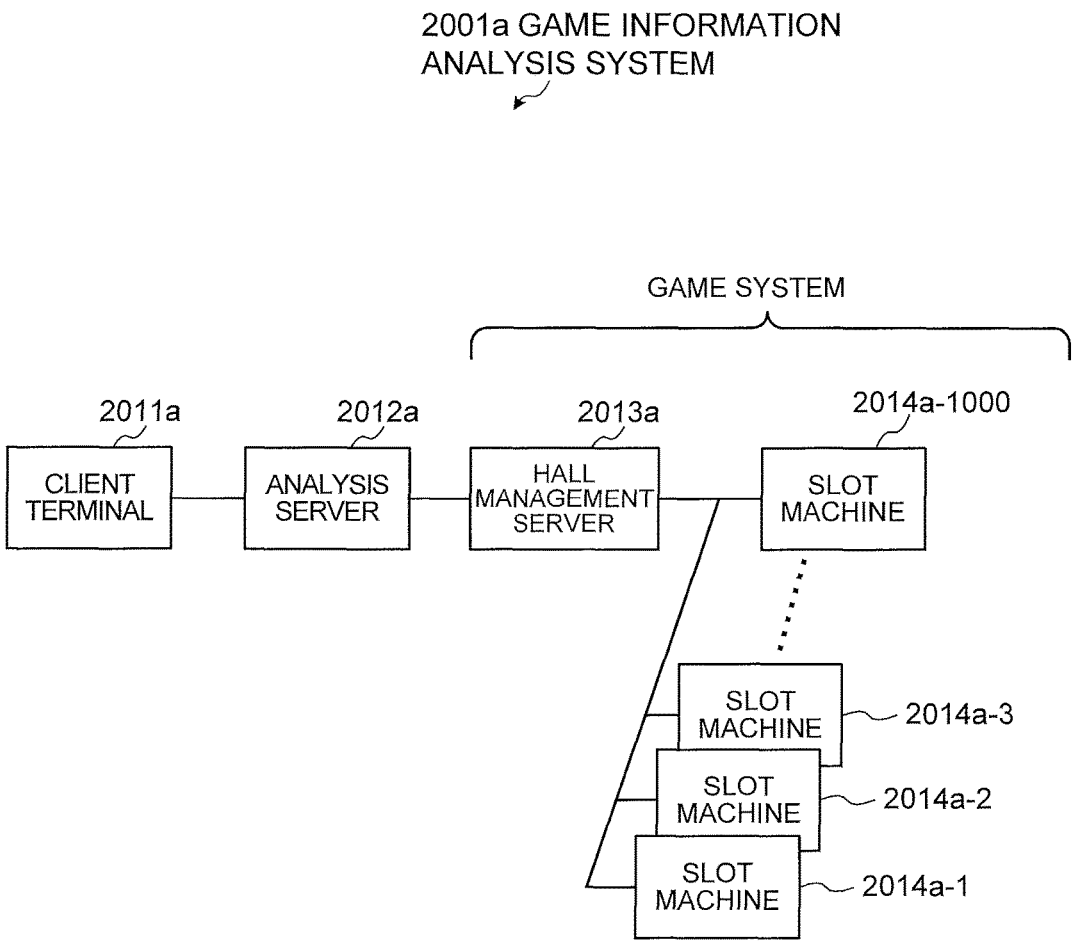
FIG. 18 is a diagram showing a game information analysis system realized in an online operation form for a small-scale hall store.

FIG. 18 is a diagram showing a configuration example of a game information analysis system 2001*a* realized in the online operation form for the small-scale hall store.

As shown in FIG. 18, the game information analysis system 2001*a* includes a client terminal 2011*a* and an analysis server 2012*a* and is connected to a game system such as a game system 1 show in FIG. 1, which is introduced in each hall store. Here, the game system includes, for example, a hall management server 2013*a* and a plurality of slot machines 2014*a*-1, 2014*a*-2, and 2014*a*-3 to 2014*a*-1000 connected to this hall management server 2013*a*.

The game information analysis system 2001*a* is a system implemented in the online operation form for the above-described small-scale hall store and includes the slot machines whose number is 1000 or less (for example, 1000) as described above. Each of the slot machines is connected via a network to the hall management server 2013*a*, and game information indicating game states such as a money amount or a number of coins inputted to each of the slot machines (as it is called, "IN" information, hereinafter, referred to as a BET number, a BET amount, a BET money amount, an input money amount, an investment money amount, or the like) and a money amount or a number of coins paid out from each of the slot machines (as it is called, "OUT" information, hereinafter, referred to as a to-be-paid-out number, a payout amount, a to-be-paid-out money amount, or the like) is transmitted from each of the slot machines to the hall management server 2013*a* in real time and further, is transmitted from the hall management server 2013*a* to the analysis server 2012*a*.

In addition, machine information related to each of the slot machines stored in the hall management server 2013*a* is transmitted to the analysis server 2012*a*. The machine information includes fixed information registered for managing the gaming machines and variable information which varies in accordance with a game played by a player, and the variable information is transmitted in real time from each of the slot machines via the hall management server 2013*a* to the analysis server 2012*a*.

The analysis result data obtained as a result of the analysis process on the analysis server 2012*a* is provided for the client terminal 2011*a*, and in response to a user's operation, the client terminal 2011*a* controls a display or the like of the client terminal 2011*a* to display a variety of analysis reports or the like based on the received analysis result data.

It is to be noted that the analysis server 2012*a* can be connected to the existing game system. In this case, it is required for the analysis server 2012*a* to grasp a protocol and a format of the data transmitted from the hall management server 2013*a* of the game system and to receive the data so as to correspond thereto.

In addition, in the present specification, in a case where the game information analysis system is collectively referred to, instead of being referred to as each game information analysis system in each of the individual operation forms, the game information analysis system is referred to as a game information analysis system 2001; in a case where the client terminal is collectively referred to, instead of being referred to as each client terminal in each of the individual operation forms, the client terminal is referred to as a client terminal 2011; in a case where the analysis server is collectively referred to, instead of being referred to as each analysis server in each of the individual operation forms, the analysis server is referred to as an analysis server 2012; in a case where the hall management server is collectively referred to, instead of being referred to as each hall management server in each of the individual operation forms, the hall management server is referred to as a hall management server 2013; and in a case where the slot machine is collectively referred to, instead of being referred to as each slot machine in each of the individual operation forms, the slot machine is referred to as a slot machine 2014. The slot machine 2014 corresponds to the slot machine 1010 shown in FIG. 2 and FIG. 4.

Figure 19:
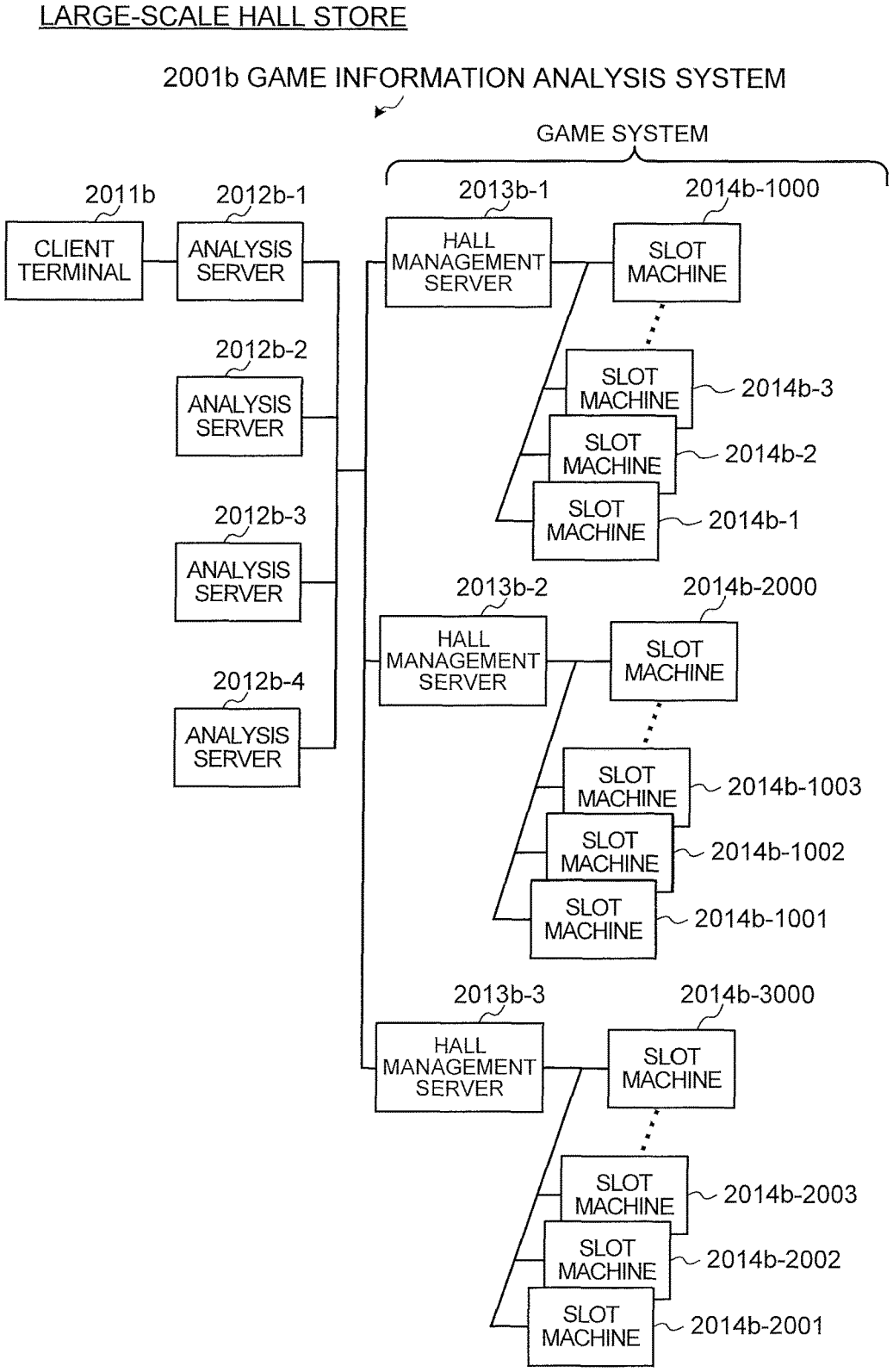
FIG. 19 is a diagram showing a game information analysis system realized in an online operation form for a large-scale hall store.

FIG. 19 is a diagram showing a configuration example of a game information analysis system 2001*b* realized in the online operation form for the large-scale hall store.

As shown in FIG. 19, the game information analysis system 2001*b* includes a client terminal 2011*b* and an analysis server 2012*b*-1 to an analysis server 2012*b*-4 and is connected to a game system introduced in each hall store such as the game system 1 shown in FIG. 1. Here, the game system includes, for example, a hall management server 2013*b*-1 to a hall management server 2013*b*-3 and a plurality of slot machines 2014*b*-1, 2014*b*-2, and 2014*b*-3 to 2014*b*-1000; 2014*b*-1001, 2014*b*-1002, and 2014*b*-1003 to 2014*b*-2000; and 2014*b*-2001, 2014*b*-2002, and 2014*b*-2003 to 2014*b*-3000 which are connected the hall management server 2013*b*-1 to hall management server 2013*b*-3, respectively.

The game information analysis system 2001*b* is a system implemented in the online operation form for the above-described large-scale hall store and includes the slot machines whose number is larger than 1000 (for example, 3000) as described above. Each of the slot machines is connected via a network to one corresponding hall management server among the hall management server 2013*b*-1 to hall management server 2013*b*-3, and game information indicating game states such as a BET number inputted to each of the slot machines and a to-be-paid-out number paid out is transmitted to the corresponding hall management server 2013*b* in real time from each of the slot machines, and further, the game information is transmitted from each of the hall management server 2013*b*-1 to hall management server 2013*b*-3 to any of the analysis server 2012*b*-1 to analysis server 2012*b*-4.

In this example, the analysis server 2012*b* is constituted of four analysis server 2012*b*-1 to analysis server 2012*b*-4, the analysis process is shared to be executed. The analysis server 2012*b* may be configured such that each of the analysis servers 2012*b* takes charge of a different analysis process or executes the same analysis process with respect to each different range of slot machines. The hall management server 2013*b*-1 to hall management server 2013*b*-3 transmit necessary data to the respective analysis servers 2012*b* in accordance with processing contents on the analysis server 2012*b*-1 to analysis server 2012*b*-4.

In addition, machine information related to each of the slot machines stored on the hall management server 2013*b*-1 to hall management server b-3 is transmitted as needed to all or any of the analysis server 2012*b*-1 to analysis server 2012*b*-4. The machine information includes fixed information registered for managing the gaming machines and variable information which varies in accordance with a game played by a player, and the variable information is transmitted in real time from each of the slot machines via the hall management server 2013*b* to the analysis server 2012*b*.

Figure 20:
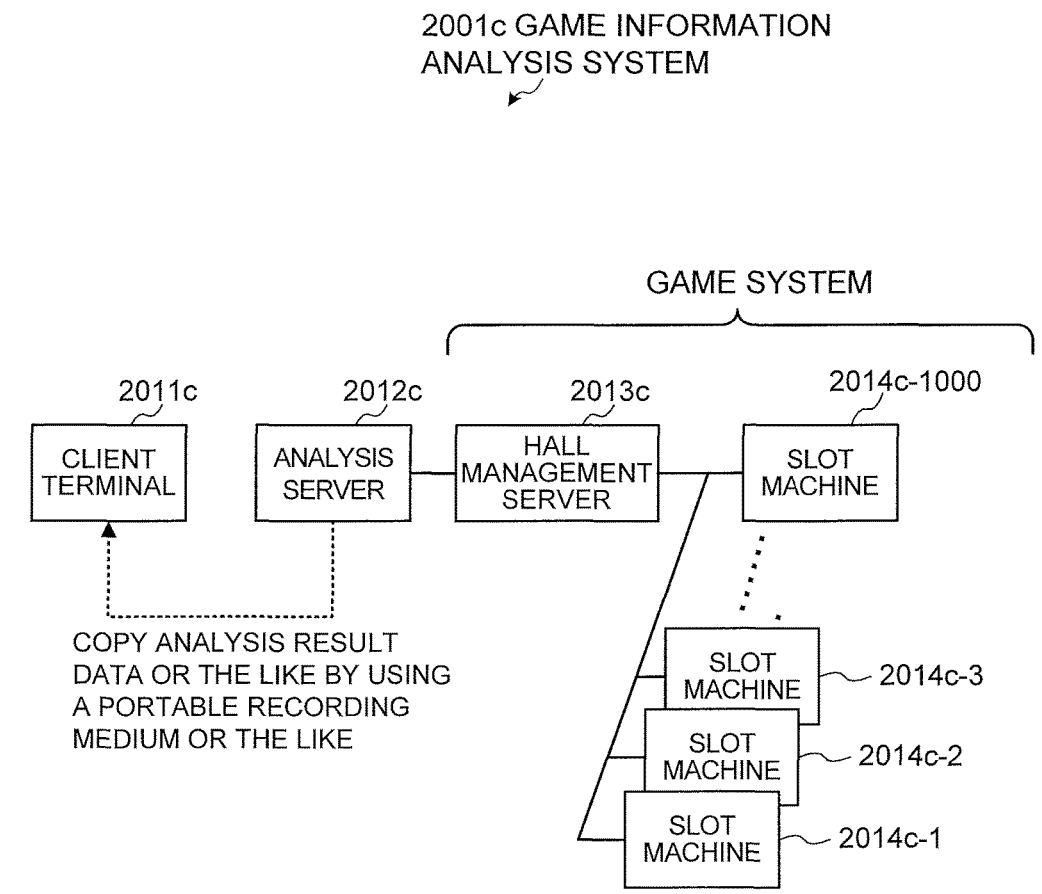
FIG. 20 is a diagram showing a game information analysis system realized in an offline operation form.

FIG. 20 is a diagram showing a configuration example of a game information analysis system 2001*c* realized in the offline operation form.

As shown in FIG. 20, the game information analysis system 2001*c* includes a client terminal 2011*c* and an analysis server 2012*c* and is connected to a game system introduced in each hall store such as the game system 1 shown in FIG. 1. Here, the game system includes, for example, a hall management server 2013*c* and a plurality of slot machines 2014*c*-1, 2014*c*-2, and 2014*c*-3 to a machine 2014*c*-1000 connected to this hall management server 2013*c*. In this case, the client terminal 2011*c* is not connected via a network to the analysis server 2012*c* and therefore, can be referred to as a "stand-alone terminal".

The game information analysis system 2001*c* is a system implemented in the offline operation form for the above-described small-scale hall store and includes slot machines whose number is within 1000 (for example, 1000) as described above. Connection between each of the slot machine 2014*c*-1 to slot machine 2014*c*-1000 and the hall management server 2013*c* and data to be transmitted are the same as in the game information analysis system 2001*a* shown in FIG. 18, and connection between the analysis server 2012*c* and the hall management server 2013*c* and data to be transmitted are also the same as in the game information analysis system 2001*a* shown in FIG. 18.

Analysis result data obtained as a result of an analysis process on the analysis server 2012*c* is stored in, for example, a portable recording medium such as a CD-ROM and a portable memory and is provided for the client terminal 2011*c*. Based on the received analysis result data, the client terminal 2011*c* controls a display or the like of the client terminal 2011*c* to display a variety of analysis reports or the like.

Figure 21:
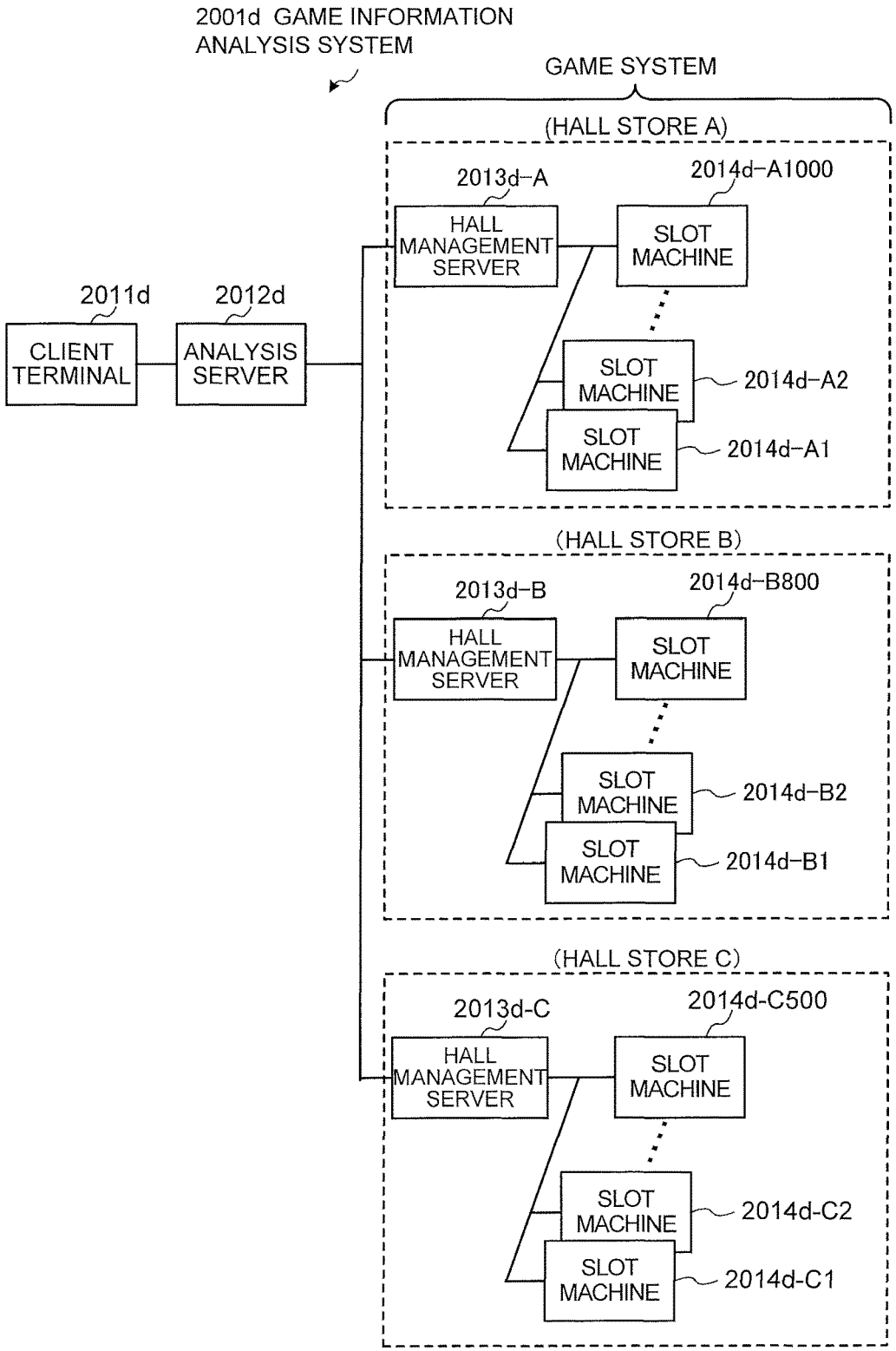
FIG. 21 is a diagram showing a game information analysis system in which an analysis process is conducted with respect to a plurality of hall stores.

FIG. 21 is a diagram showing a configuration example of a game information analysis system 2001*d* in which an analysis process is conducted with respect to a plurality of hall stores. The game information analysis system 2001*d* is provided as an option, for example, for each of the three configuration examples of the above-described game information analysis system (the game information analysis system 2001*a*, the game information analysis system 2001*b*, and the game information analysis system 2001*c*).

As shown in FIG. 21, the game information analysis system 2001*d* includes a client terminal 2011*d* and an analysis server 2012*d* and is connected to a plurality of game systems introduced in the hall stores, each of which is the game system 1 shown in FIG. 1. Here, the game systems are game systems installed in three hall stores (a hall store A to a hall store C). The game system installed in the hall store A includes, for example, a hall management server 2013*d*-A and a plurality of slot machines 2014*d*-A1 and 2014*d*-A2 to 2014*d*-A1000 connected to this hall management server 2013*d*-A. The game system installed in the hall store B includes, for example, a hall management server 2013*d*-B and a plurality of slot machines 2014*d*-B1 and 2014*d*-B2 to 2014*d*-B800 connected to this hall management server 2013*d*-B. In addition, the game system installed in the hall store C includes, for example, a hall management server 2013*d*-C and a plurality of slot machines 2014*d*-C1 and 2014*d*-C2 to 2014*d*-0500 connected to this hall management server 2013*d*-C.

Each of the hall store A to hall store C corresponds to the above-described small-scale hall store (in other words, the number of slot machines is within 1000). Connection between each of the slot machine 2014*d*-A1 to slot machine 2014*d*-A1000 and the hall management server 2013*d*-A in the hall store A and data to be transmitted are the same as in the game information analysis system 2001*a* shown in FIG. 18, and also in each of the hall store B and the hall store C, connection between the corresponding apparatuses and data to be transmitted are the same as in the game information analysis system 2001*a* shown in FIG. 18.

From the hall management server 2013*d*-A to the analysis server 2012*d*, game information or the like related to the slot machine 2014*d*-A1 to the slot machine 2014*d*-A1000 is transmitted in real time or at other timing. From the hall management server 2013*d*-B to the analysis server 2012*d*, game information or the like related to the slot machine 2014*d*-B1 to the slot machine 2014*d*-B800 is transmitted in real time or at other timing. From the hall management server 2013*d*-C to the analysis server 2012*d*, game information or the like related to the slot machine 2014*d*-C1 to the slot machine 2014*d*-0500 is transmitted in real time or at other timing.

Figure 22:
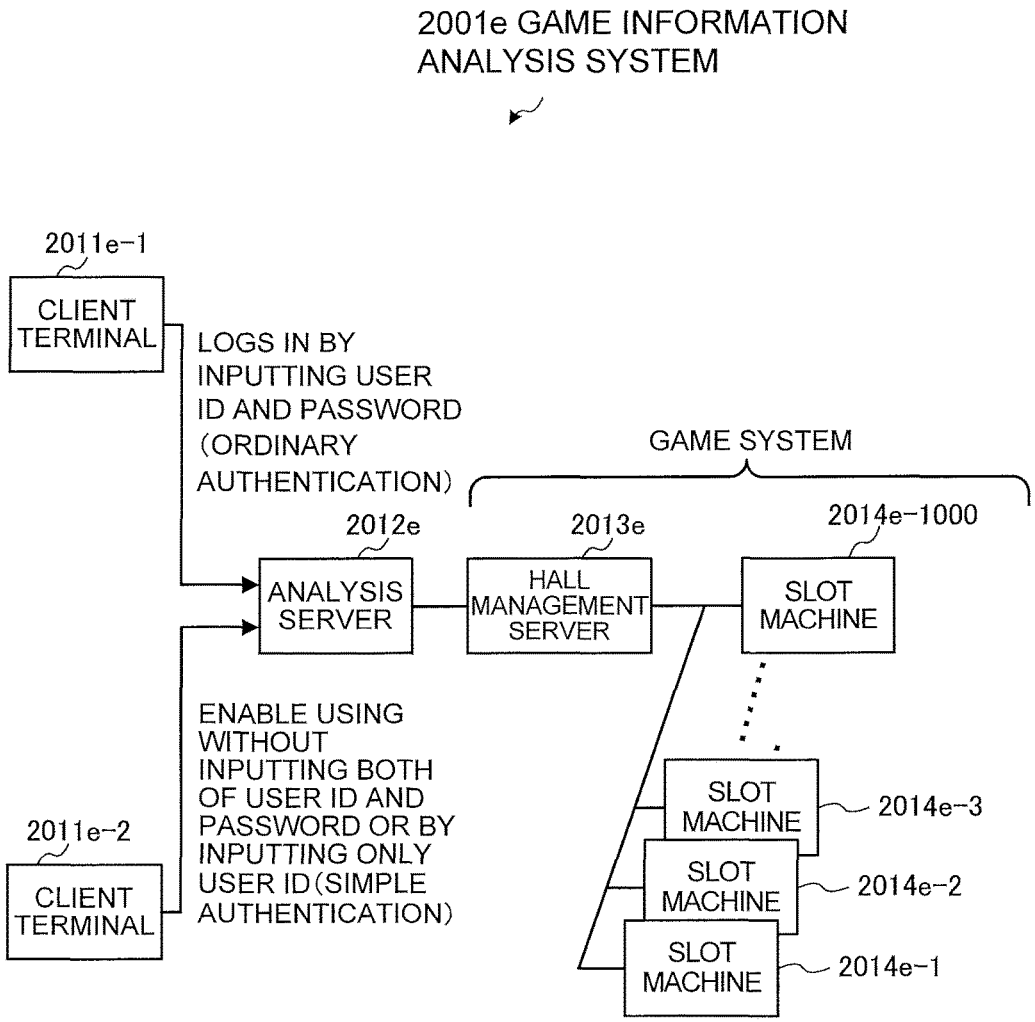
FIG. 22 is a diagram showing a game information analysis system in which client terminals are connected to an analysis server through a plurality of connection methods.

FIG. 22 is a diagram showing a configuration example of a game information analysis system 2001*e* in which client terminals are connected to an analysis server through a plurality of connection methods. The game information analysis system 2001*e* is provided as an option, for example, for the three configuration examples of the above-described game information analysis system (the game information analysis system 2001*a*, the game information analysis system 2001*b*, and the game information analysis system 2001*c*).

As shown in FIG. 22, the game information analysis system 2001*e* includes a client terminal 2011*e* and an analysis server 2012*e* and is connected to a game system introduced in each hall store such as the game system 1 shown in FIG. 1. Here, the game system includes a hall management server 2013*e* and a plurality of slot machines 2014*e*-1, 2014*e*-2, and 2014*e*-3 to 2014*e*-1000 connected to this hall management server 2013*e*.

In addition, the client terminal 2011*e* in the game information analysis system 2001*e* can be configured so as to include two kinds of client terminals (for example, a client terminal 2011*e*-1 and a client terminal 2011*e*-2). Here, when a user operates and causes the client terminal 2011*e*-1 to display an analysis result, by inputting an user ID and a password, the client terminal 2011*e*-1 can connect to the analysis server 2012*e* and can log on to the game information analysis system 2001*e* (ordinary authentication).

On the other hand, by inputting neither a user ID nor a password or only by inputting a user ID and other character string, the client terminal 2011*e*-2 can connect to the analysis server 2012*e* and log on to the game information analysis system 2001*e* (simple authentication).

As described above, the log-in methods (authentication methods) of the client terminal 2011*e*-1 and the client terminal 2011*e*-2 to the game information analysis system 2001*e* are different from each other, and in accordance with the above-mentioned difference, ranges in which data can be referenced with the game information analysis system 2001*e*, data which can be handled, functions which can be utilized, and the like may be made different from each other.

Figure 23:
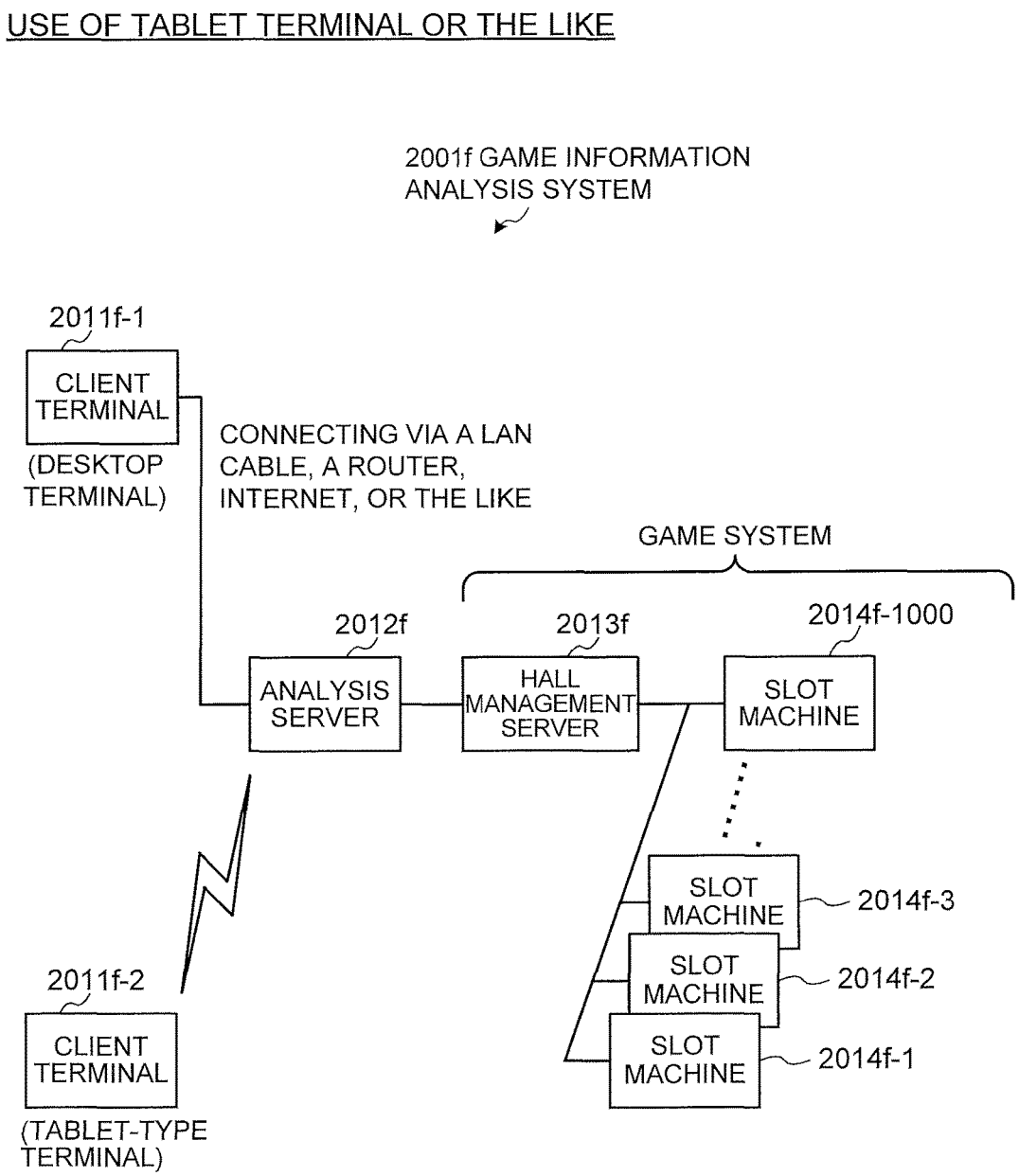
FIG. 23 is a diagram showing a game information analysis system in which a plurality of kinds of client terminals can be utilized.

FIG. 23 is a diagram showing a configuration example of a game information analysis system 2001*f* in which a plurality of kinds of client terminals can be utilized. The game information analysis system 2001*f* is provided as an option, for example, for the three configuration examples of the above-described game information analysis system (the game information analysis system 2001*a*, the game information analysis system 2001*b*, and the game information analysis system 2001*c*).

As shown in FIG. 23, the game information analysis system 2001*f* includes a client terminal 2011*f* and an analysis server 2012*f* and is connected to a game system introduced in each hall store such as the game system 1 shown in FIG. 1. Here, the game system includes a hall management server 2013*f* and a plurality of slot machines 2014*f*-1, 201*f*-2, and 2014*f*-3 to 2014*f*-1000 connected to this hall management server 2013*f*.

In addition, the client terminal 2011*f* of the game information analysis system 2001*f* can be configured so as to include two kinds of client terminals (for example, a client terminal 2011*f*-1 and a client terminal 2011*f*-2). Here, the client terminal 2011*f*-1 is a desktop type personal computer and the client terminal 2011*f*-2 is a tablet type portable computer. Here, the client terminal 2011*f*-1 is connected to the analysis server 2012*f* via a LAN cable, a router, the Internet, and the like, whereas the client terminal 2011*f*-2 is connected to the analysis server 2012*f* via a wireless LAN, a wireless router, the Internet, and the like or via a public wireless communication network, a wireless base station, the Internet, and the like.

As described above, configurations of hardware of the client terminal 2011*f*-1 and the client terminal 2011*f*-2 are different from each other and in some cases, methods of connecting the client terminal 2011*f*-1 and the client terminal 2011*f*-2 to the analysis server 2012*f* are different from each other, and in accordance with the above-mentioned difference, ranges in which data can be referenced with the game information analysis system 2001*f*, data which can be handled, functions which can be utilized, and the like may be made different from each other.

In addition, here, although the desktop type personal computer and the tablet type portable computer are exemplified, other various computers such as a smartphone and a mobile phone which can be connected to the analysis server 2012*f* can be used as the client terminal.

Hereinabove, although with reference to FIG. 18 to FIG. 23, each of the configurations of the game information analysis system is described, each of these configurations is merely one example, and by adopting other various configurations, the game information analysis system can be realized. For example, although in each of the above-described examples, the game information or the like related to each of the slot machines is transmitted via the hall management computer to the analysis server, the game information or the like related thereto may be transmitted via other computer to the analysis server, and the game information or the like related to each of the slot machines can be grasped on the analysis server in other various communication forms.

Figure 24:
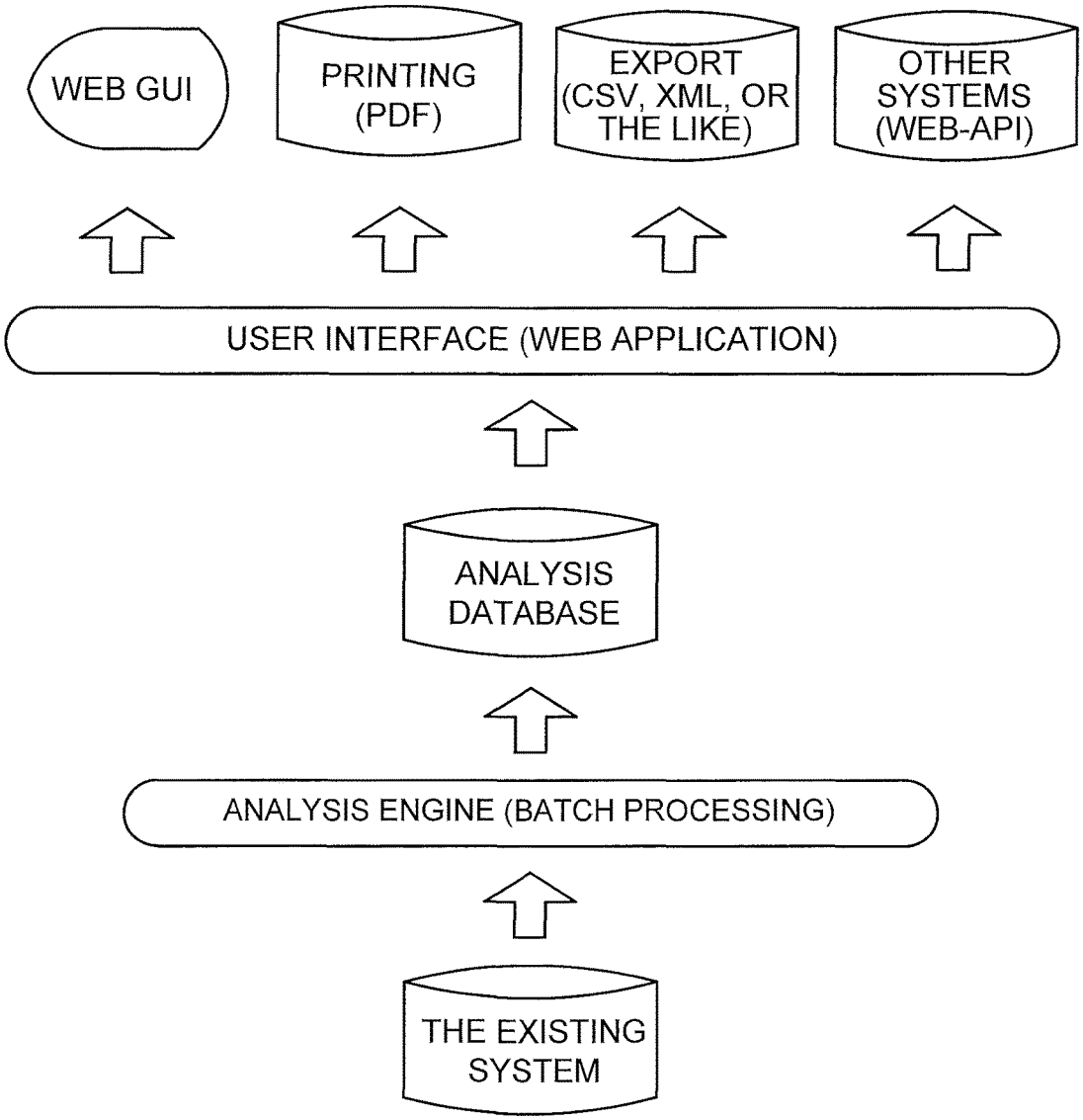
FIG. 24 is a diagram showing a configuration example of software of the game information analysis system.

Next, with reference to FIG. 24, a configuration example of software of a game information analysis system 2001 will be described. In an example shown in FIG. 24, from a hall management server 2013 or the like included in the existing game system (the existing system) to an analysis engine of an analysis server 2012, game information or the like accumulated from the past to the present is transmitted, an analysis process for the past information or the like is conducted there, and an analysis result is stored and accumulated in an analysis database. The analysis process using the analysis engine is, here, a batch process, and for example, in the night, the game information or the like is collected from the hall management server via a network including the Internet and the analysis process is conducted.

Through the above-described analysis process for the past accumulated data, for example, even in a case where the game information analysis system 2001 is introduced from halfway to said existing game system, for a while, without obtaining the game information from each of the slot machines and conducting the analysis (for obtaining statistical data), player attributes and machine attributes at the present time can be immediately grasped (by the past accumulated data), and from the moment at which the use of the game information analysis system 2001 is started, outputting or the like of an effective analysis report is enabled.

Of course, the analysis process by the analysis engine may be conducted in real time and an analysis result may be stored in the analysis database. It is to be noted that in this case, it is required for the game information or the like needed for the analysis process to be transmitted in real time from the hall management server.

The analysis result stored in the analysis database is provided for a user by a user interface such as a Web application. For example, the analysis result stored in the analysis database is obtained and interpreted by a Web browser (Web GUI) executed on the client terminal connected to the analysis server, and an analysis result report or the like is displayed to a user (on a display of the client terminal).

In addition, the analysis result stored in the analysis database is obtained and interpreted by an application executed on the client terminal connected to the analysis server, and the analysis result report or the like is outputted to a printer or the like connected to the client terminal for printing. In addition, the analysis result report or the like is outputted as data in a predetermined file format such as PDF, and a user displays that data on other computer, thereby allowing the analysis result report or the like to be confirmed.

Further, the analysis result stored in the analysis database is obtained and interpreted by an application executed on the client terminal connected to the analysis server, and the analysis result report or the like is outputted as data in a predetermined file format such as CSV and XML, and a user displays that data on other computer, thereby allowing the analysis result report or the like to be confirmed.

In addition, further, by accessing the analysis server from other system via a WEB-API, needed data is obtained from the analysis database, the analysis result report or the like may be edited and outputted. The WEB-API can be previously prepared in the game information analysis system so as to allow a predetermined user to utilize the analysis result or the like.

Next, with reference to FIG. 25 and FIG. 26, outlines of main functions and features of the game information analysis system 2001 will be described. A first function is a function to make a diagnosis with respect to a balance between customer psychology and administration. In the present game information analysis system 2001, a psychological analysis of a customer in accordance with transition of games can be made. In the psychological analysis of a customer, for example, a course (history) of games played by a customer (player) is represented by a candlestick chart, and psychological states are thereby classified and are scored.

In addition, in the present game information analysis system 2001, a diagnosis with respect to a balance between this psychology of a customer and sales can be made. If a hall store attaches weight to sales and holds down a payout amount, an adverse influence is exerted on the psychology of a customer. In the present game information analysis system 2001, the effective diagnosis with respect to the balance between such customer psychology and the administration can be made.

If a hall store pursues only a profit, customers are dissatisfied, and hall store administration cannot be stable. In the present game information analysis system 2001, from a scatter diagram in which scored customer psychology and sales are shown, diagnosis on whether the administration of a hall store is in a well-balanced state can be made.

A second function of the game information analysis system 2001 shown in FIG. 25 is a function to analyze attributes of machines and customers. In the present game information analysis system 2001, the attributes of the machines (hereinafter, the gaming machines such as the slot machines are referred to as machines as appropriate) and the attributes of customers (in other words, game players or players) can be analyzed, and thus, attribute matching diagnosis for the machines and the customers can be further made.

A third function of the game information analysis system 2001 shown in FIG. 25 is a function to detect potential risks and trend changes. In the present game information analysis system 2001, through an analysis for machine operations and a profitability, a fraudulent act analysis, a failure analysis, and the like, the potential risks can be detected. In addition, in the game information analysis system 2001, through a popularity analysis and the like based on machine classification and customer classification, the trend changes can be detected. It is to be noted that a part of the fraudulent act is also referred to as "cheat" and is an act of receiving payout from a machine by conducting an act of causing the machine to perform operation which a machine maker and the like do not intend.

In FIG. 26, an example in which with respect to the fraudulent act analysis, suspected machines and suspected players are analyzed is shown. In an upper row in FIG. 26, determination results of a player A are shown. With respect to the player A, four fraudulent act determination methods (in other words, determination based on a large BET per game; determination based on a machine failure; determination based on taking-in-and-out of bills; and determination based on a winning ratio upon changing a BET) are implemented, all of the determination results are "OK".

In a lower row in FIG. 26, determination results of a player B are shown. With respect to the player B, the four fraudulent act determination methods (in other words, the determination based on a large BET per game; the determination based on a machine failure; the determination based on taking-in-and-out of bills; and the determination based on a winning ratio upon changing a BET) are implemented, determination results other than a determination result of the determination based on the winning ratio are "OK". The player B from which the above-mentioned determination results are obtained is extracted as a player (caution-needed player) who is committing the fraudulent act or has the possibility of committing the fraudulent act.

A fourth function of the game information analysis system 2001 shown in FIG. 25 is a function to conduct future prediction and simulation of a profitability. In the present game information analysis system 2001, through setting of sales targets and prediction, the simulation can be conducted, and in addition, simulation related to promotion effect can also be conducted.

Next, with reference to FIG. 27 to FIG. 29, hardware configurations of the client terminal 2011 and the analysis server 2012 and a hardware configuration of the hall management server 2013 will be described.

Figure 27:
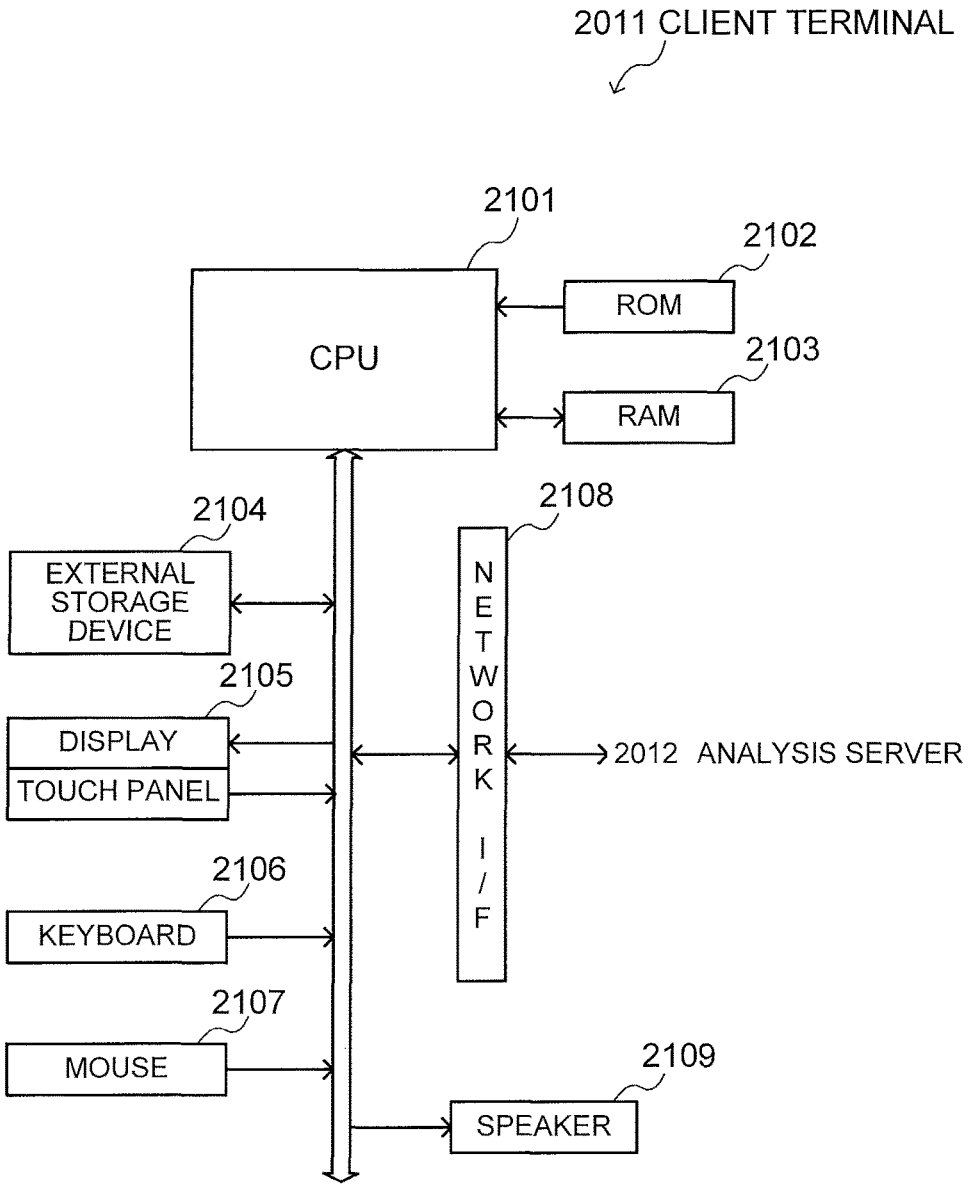
FIG. 27 is a block diagram showing one example of a hardware configuration of a client terminal in the game information analysis system.

FIG. 27 is a block diagram showing one example of the hardware configuration of the client terminal 2011. The client terminal 2011 includes a CPU 2101, a ROM 2102, a RAM 2103, an external storage device 2104, a display 2105, a keyboard 2106, a mouse 2107, a network I/F (interface) 2108, and a speaker 2109.

The CPU 2101 reads out and executes control programs stored in the ROM 2102 and the RAM 2103. For example, the CPU 2101 executes a WEB browser by a user's instruction and based on analysis result data or the like received from the analysis server 2012, displays a variety of analysis reports or the like on the display 2105. The ROM (Read Only Memory) 2102 is a non-volatile memory, and programs or the like executed upon starting up the client terminal 2011 are stored therein. The RAM (Random Access Memory) 2103 is a volatile memory, and programs such as the above-described WEB browser executed by the CPU 2101 and data or the like used during the execution of these programs are temporarily stored therein.

The external storage device 2104 is, for example, a storage device such as a hard disk device, and program data of the WEB browser and analysis result data or the like received from the analysis server 2012 are stored therein.

The display 2105 is configured as a touch panel display including a touch panel on which a touch operation by a user can be performed. This display 2105 is realized, for example, by a liquid crystal display, and the analysis reports or the like are displayed by the WEB browser thereon. Here, when the user's operation is inputted onto the touch panel, said operation content is transmitted to the CPU 2101, and processing in accordance with that operation is conducted.

The keyboard 2106 and the mouse 2107 are input devices with which a user issues instructions and conducts data inputting or the like.

The network I/F 2108 is connected via a network such as the Internet to the analysis server 2012 and controls data transmission and reception between the client terminal 2011 and the analysis server 2012. For example, via this network I/F 2108, a user's instruction content is transmitted from the client terminal 2011 to the analysis server 2012. In addition, for example, analysis result data (a WEB page or the like) is transmitted from the analysis server 2012 to the client terminal 2011. The speaker 2109 outputs a variety of pieces of sound data.

It is to be noted that although FIG. 27 shows the example in which the client terminal 2011 is a desktop type computer, as described above, as the client terminal 2011, computers in various other forms such as a tablet type computer and a smartphone can be used.

In a case where the client terminal 2011 is configured as the stand-alone terminal like the client terminal 2011*c* shown in FIG. 20, the analysis result data or the like is copied from the analysis server 2012 into a portable recording medium such as a CD-ROM and a portable memory; the data stored in the portable recording medium is read via an external recording medium interface (not shown) of the client terminal 2011 and stored in the external storage device 2104; thereafter, the analysis result data or the like is interpreted by the WEB browser; and finally, the variety of analysis reports or the like are displayed on the display 2105.

In addition, in a case where the client terminal 2011 is configured as a terminal (for example, a tablet type terminal) which receives the analysis result data or the like through wireless communication, like the client terminal 2011*f*-2 shown in FIG. 23, the client terminal 2011 is configured to have a wireless communication control part and an antenna (not shown), and through these components, a user's instruction content is transmitted from the client terminal 2011 to the analysis server 2012 via a network including a wireless network and on the other hand, the analysis result data or the like is transmitted from the analysis server 2012 to the client terminal 2011.

Figure 28:
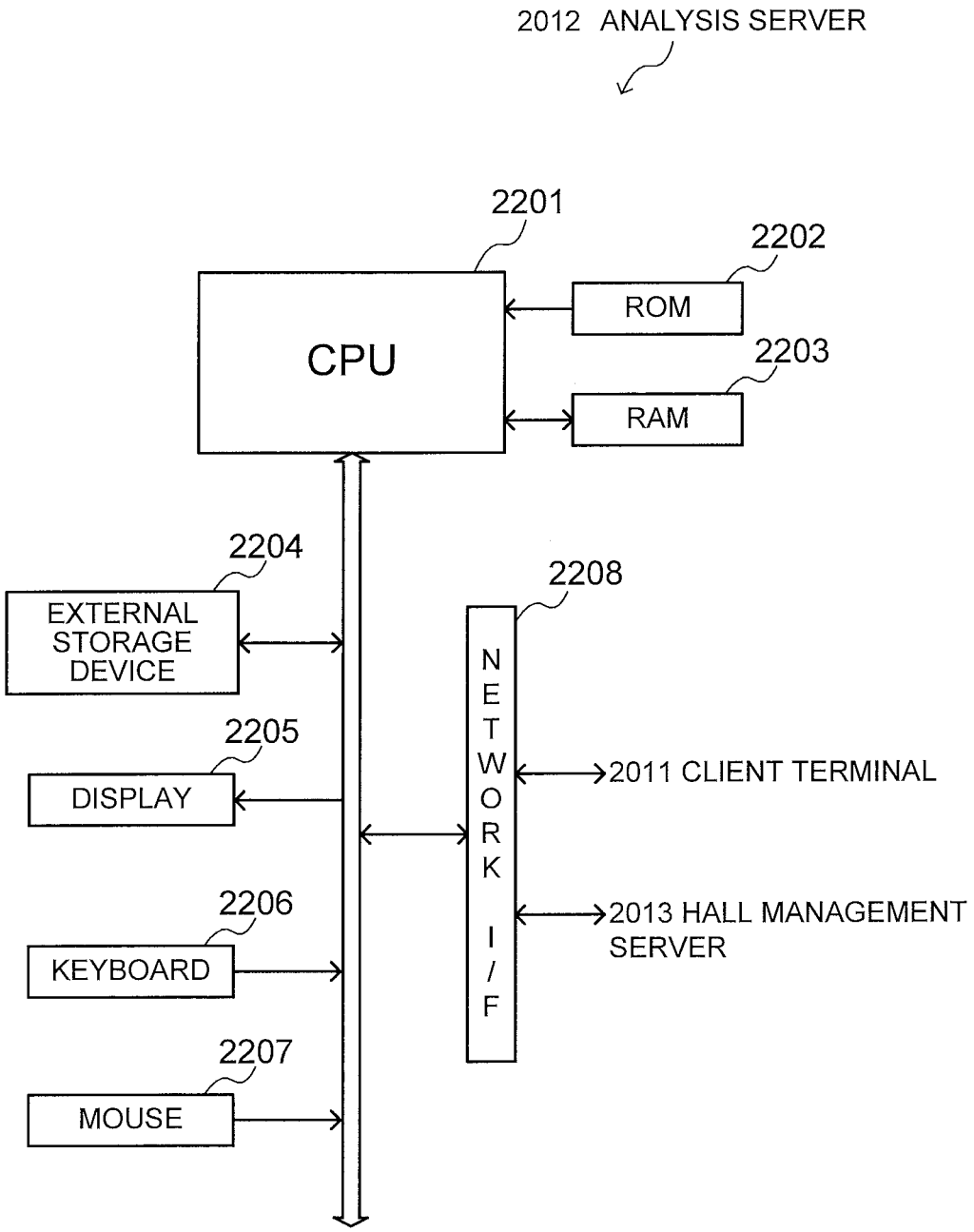
FIG. 28 is a block diagram showing one example of a hardware configuration of an analysis server in the game information analysis system.

FIG. 28 is a block diagram showing one example of the hardware configuration of the analysis server 2012. The analysis server 2012 includes a CPU 2201, a ROM 2202, a RAM 2203, an external storage device 2204, a display 2205, a keyboard 2206, a mouse 2207, and a network I/F (interface) 2208.

The CPU 2201 reads out and executes control programs stored in the ROM 2202 and the RAM 2203. For example, the CPU 2201 executes a corresponding analysis process in accordance with a user's instruction from the client terminal 2011 and generates analysis result data. The ROM 2202 is a non-volatile memory and programs or the like executed upon starting up the analysis server 2012 are stored therein. The RAM 2203 is a volatile memory and programs for conducting the above-described analysis process to be executed by the CPU 2201 and data or the like used during the execution of these programs are temporarily stored therein.

The external storage device 2204 is, for example, a storage device such as a hard disk device, and program data for conducting the analysis process, the analysis result data transmitted to the client terminal 2011, game information received from the hall management server 2013, and the like are stored therein.

The display 2205 is configured as a touch panel display including a touch panel on which a touch operation by an administrator or the like of the game information analysis system can be performed. This display 2205 is realized, for example, by a liquid crystal display. In a case where the analysis server 2012 receives input and instructions from a terminal remotely connected, the analysis server 2012 does not have to include the display 2205.

The keyboard 2206 and the mouse 2207 are input devices with which an administrator or the like of the game information analysis system issues instructions and conducts data inputting or the like. Also with respect to the keyboard 2206 and the mouse 2207, as in the above description, in a case where the analysis server 2012 receives input and instructions from a terminal remotely connected, the analysis server 2012 does not have to include these.

The network I/F 2208 is connected via a network such as the Internet to the client terminal 2011 and the hall management server 2013 and controls data transmission and reception between the client terminal 2011 and the analysis server 2012 as well as between the hall management server 2013 and the analysis server 2012. For example, via this network I/F 2208, a user's instruction content is transmitted from the client terminal 2011 to the analysis server 2012. In addition, for example, analysis result data (a WEB page or the like) is transmitted from the analysis server 2012 to the client terminal 2011. In addition, for example, via this network I/F 2208, game information or the like is transmitted from the hall management server 2013 to the analysis server 2012.

It is to be noted that the analysis server 2012 shown in FIG. 28 is merely one example, and other various configurations can be adopted.

Figure 29:
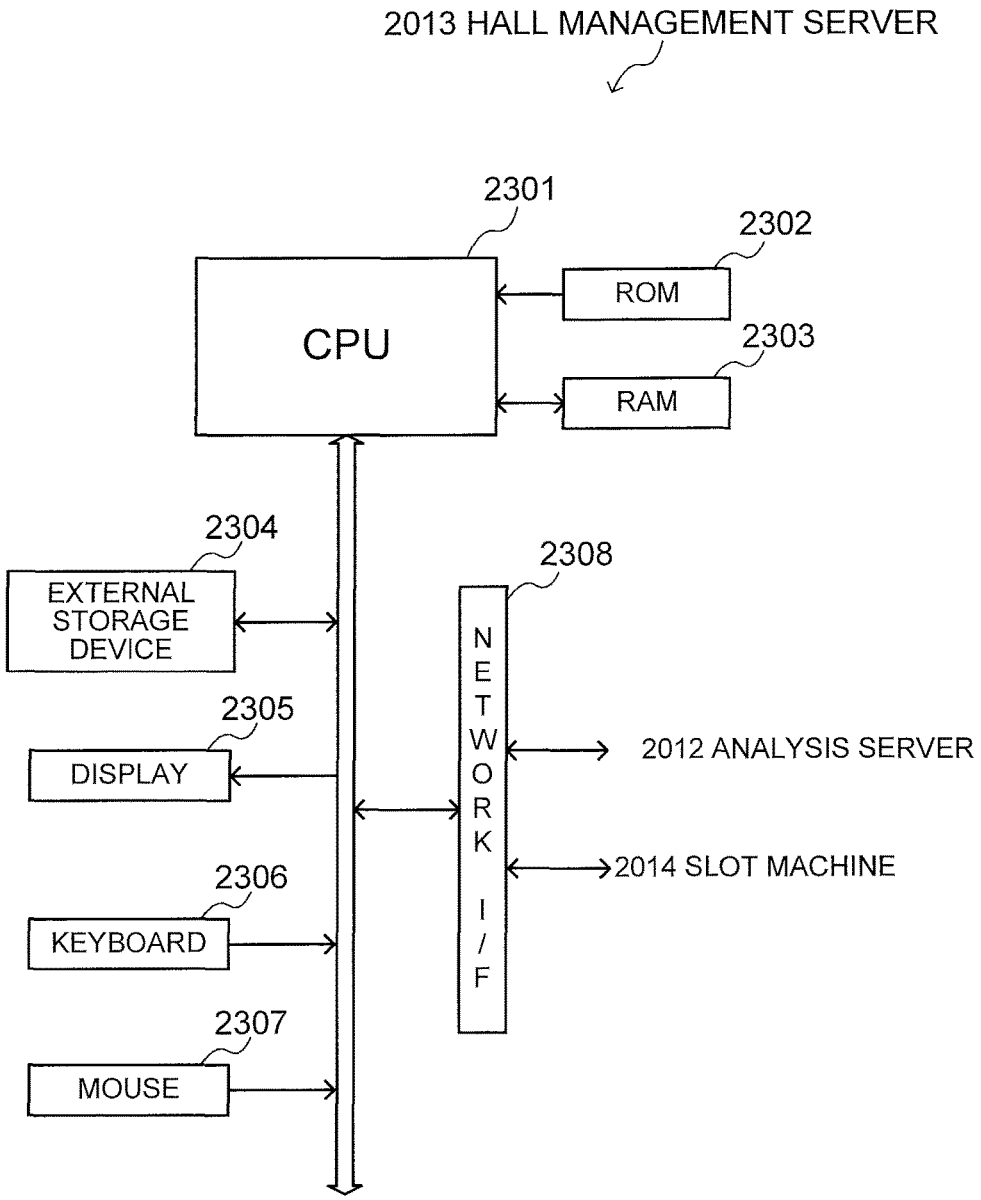
FIG. 29 is a block diagram showing one example of a hardware configuration of a hall management server in the game information analysis system.

FIG. 29 is a block diagram showing one example of the hardware configuration of the hall management server 2013. There is a case where the hall management server 2013 is a hall management server included in the existing game system or also a case where as the hall management server 2013, a hall management server is newly introduced to be combined in the game information analysis system 2001. The hall management server 2013 includes a CPU 2301, a ROM 2302, a RAM 2303, an external storage device 2304, a display 2305, a keyboard 2306, a mouse 2307, and a network I/F (interface) 2308.

The CPU 2301 reads out and executes control programs stored in the ROM 2302 and the RAM 2303. For example, when pieces of game information are transmitted from a slot machine 2014, the CPU 2301 appropriately edits and totalizes those pieces of information as needed and accumulates those in the external storage device 2304. The ROM 2302 is a non-volatile memory and programs or the like executed upon starting up the hall management server 2013 are stored therein. The RAM 2303 is a volatile memory and programs for controlling the accumulation of the above-described game information executed by the CPU 2301 and data or the like used during the execution of these programs are temporarily stored therein.

The external storage device 2304 is, for example, a storage device such as a hard disk device and program data for controlling the accumulation of the pieces of game information and the game information or the like are stored therein.

The display 2305 is configured as a touch panel display including a touch panel on which a touch operation by an administrator of a hall store can be performed. This display 2305 is realized, for example, by a liquid crystal display. In a case where the hall management server 2013 receives input and instructions from a terminal remotely connected, the hall management server 2013 does not have to include the display 2305.

The keyboard 2306 and the mouse 2307 are input devices with which an administrator of a hall store issues instructions and conducts data inputting or the like. Also with respect to the keyboard 2306 and the mouse 2307, as in the above description, in a case where the hall management server 2013 receives input and instructions from a terminal remotely connected, the hall management server 2013 does not have to include these.

The network I/F 2308 is connected via a network such as the Internet to the analysis server 2012 and is connected to slot machines 2014 via a network or the like in a hall store and controls data transmission and reception between the hall management server 2013 and the analysis server 2012 as well as between the slot machines 2014 and the hall management server 2013. For example, via this network I/F 2308, game information or the like is transmitted from the hall management server 2013 to the analysis server 2012 and the game information or the like is transmitted from the slot machines 2014 to the hall management server 2013.

It is to be noted that the hall management server 2013 shown in FIG. 29 is merely one example, and other various configurations can be adopted.

Next, with reference to FIG. 30 to FIG. 32, respective functions of the client terminal 2011 and the analysis server 2012 used in the game information analysis system 2001 and respective functions of the hall management server 2013 used therein will be described.

Figure 30:
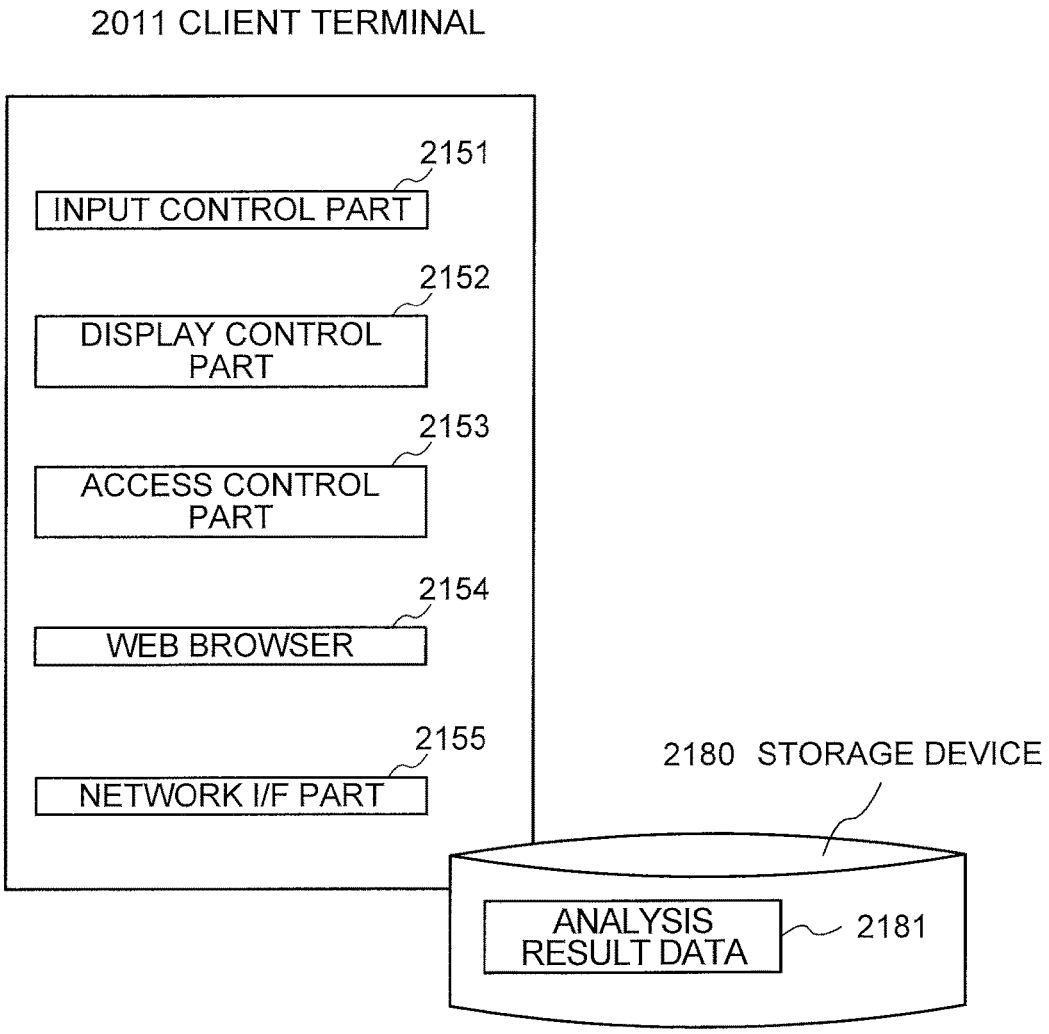
FIG. 30 is a functional block diagram of the client terminal in the game information analysis system.

FIG. 30 is a functional block diagram of the client terminal 2011. The client terminal 2011 includes an input control part 2151, a display control part 2152, an access control part 2153, a WEB browser 2154, and a network I/F (interface) part 2155. In addition, the client terminal 2011 stores (as needed) analysis result data 2181 received from the analysis server 2012 in a storage device 2180 (corresponding to the external storage device 2104 shown in FIG. 27).

The input control part 2151 detects operations of the display 2105, the keyboard 2106, the mouse 2107, and the like which are shown in FIG. 27 and transmits operation contents to the CPU 2101. Thus, for example, a user or the like can display a desired analysis report on the WEB browser.

The display control part 2152 controls the display 2105 to display a screen or the like. For example, in response to an instruction of the WEB browser 2154, the display control part 2152 controls the display 2105 to display a WEB page in which the analysis report or the like generated by the WEB browser 2154 is displayed.

The access control part 2153 transmits a user ID and a password inputted by a user to the analysis server 2012 and when accessing is permitted by the analysis server 2012 (authentication OK), the reception or the like of the analysis result data from the analysis server 2012 is made possible. In addition, when the simple authentication as shown in FIG. 22 is conducted, the access control part 2153 enables data transmission and reception to and from the analysis server 2012 without conducting an authentication process with the analysis server 2012 or by transmitting only a user ID to the analysis server 2012.

The WEB browser 2154 requests the analysis server 2012 to display a designated analysis report in response to a user's operation; receives analysis result data in HTML format and related image data transmitted, as a response for said request, from the analysis server 2012; interprets the received analysis result data or the like; and generates an analysis report (a WEB page or the like) to be displayed on the display 2105. It is to be noted that although in this example, by using the WEB browser 2154, the analysis report is displayed on the display 2105, the configuration can be arranged such that by using other application, the same process is conducted.

The network I/F part 2155 controls the network I/F 2108 shown in FIG. 27 and controls data transmission and reception between the client terminal 2011 and the analysis server 2012.

Figure 31:
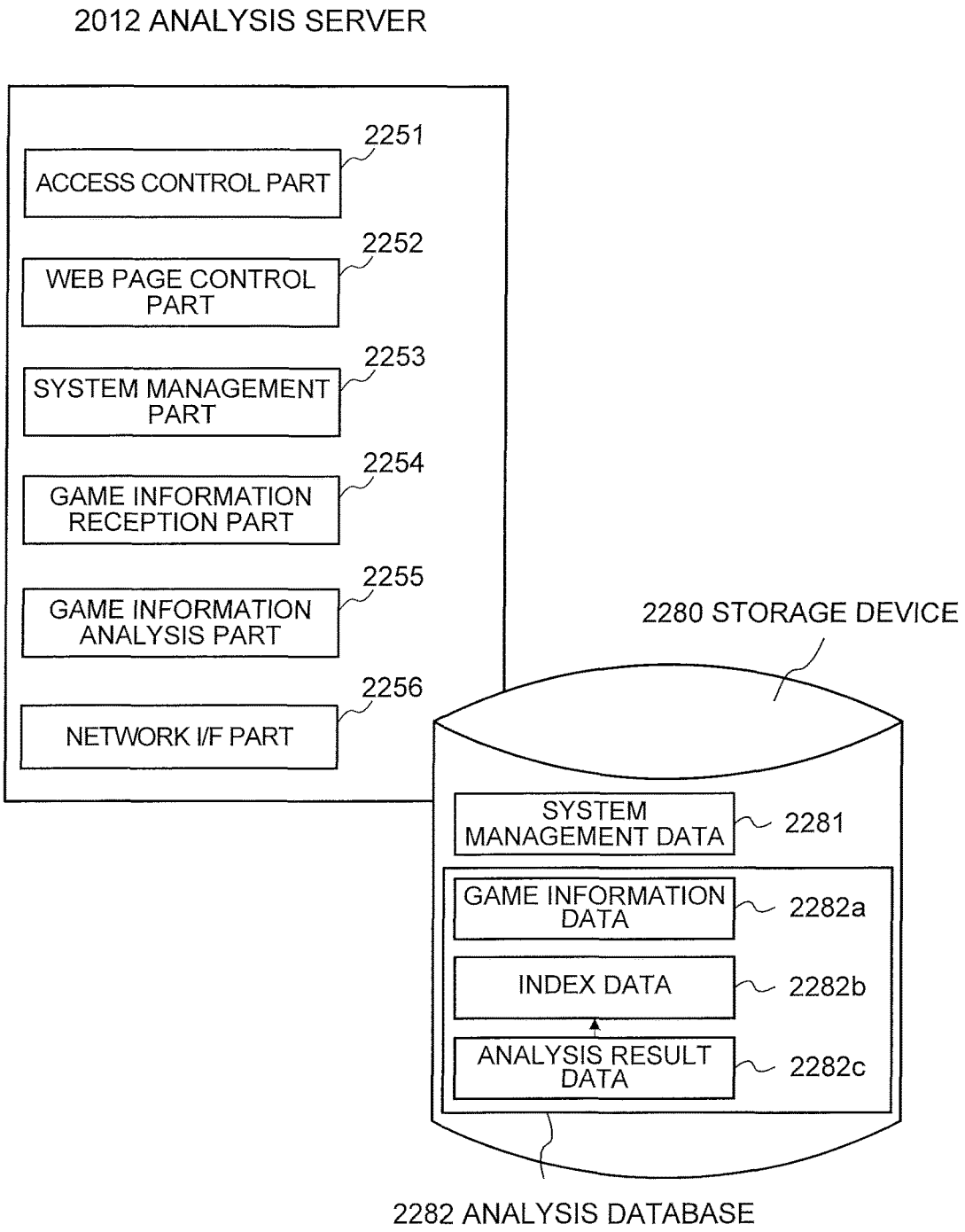
FIG. 31 is a functional block diagram of the analysis server in the game information analysis system.

FIG. 31 is a functional block diagram of the analysis server 2012. The analysis server 2012 includes an access control part 2251, a WEB page control part 2252, a system management part 2253, a game information reception part 2254, a game information analysis part 2255, and a network I/F (interface) part 2256. In addition, the analysis server 2012 stores system management data 2281 and analysis database 2282 in a storage device 2280 (corresponding to the external storage device 2204 shown in FIG. 28). Here, in the analysis database 2282, game information data 2282*a*, index data 2282*b*, and analysis result data 2282*c* are included.

When there is login from the client terminal 2011, the access control part 2251 conducts authentication checking for a user ID and a password based on user registration information of the system management data 2281 and if the authentication is OK, the access control part 2251 permits accessing of the client terminal 2011.

When there is a request of a WEB page from a WEB browser executed on the client terminal 2011, the WEB page control part 2252 generates the requested WEB page and transmits the generated WEB page to the client terminal 2011. For example, when there is a request to display the analysis report from the client terminal 2011, the WEB page control part 2252 generates as a WEB page the analysis result data 2282*c* in the analysis database 2282 and a result of the analysis process by the game information analysis part 2255 and transmits those as analysis result data to the client terminal 2011. The WEB page control part 2252 is a function part which functions as a WEB server.

When a user operates the client terminal 2011 and performs an operation for system management (operation related to system management performed by selecting the system management on the later-described menu screen of the game information analysis system), the system management part 2253 stores that operation and the input result in the system management data 2281 in the storage device 2280.

For example, when as the operation for the system management, data management operation for conducting maintenance for predetermined data and algorithm is performed by a user, the system management part 2253 stores a processing result obtained by that operation in data information of the system management data 2281. In addition, when a group management operation for defining authorization of a user group utilizing the present system is performed by a user, the system management part 2253 stores a processing result obtained by that operation in group information of the system management data 2281. In addition, when a user management operation for registering a user utilizing the present system is performed by a user, the system management part 2253 stores a processing result obtained by that operation in user registration information of the system management data 2281. In the user registration information, user IDs, passwords, and the like are included. In addition, the system management part 2253 stores an access history of a user utilizing the present system in access information of the system management data 2281.

The game information reception part 2254 receives game information from the hall management server 2013. The game information includes game information transmitted from a plurality of slot machines 2014 and game information accumulated, edited, or processed on the hall management server 2013. In addition, the game information reception part 2254 can receive the game information of the slot machines 2014 in a hall store in real time or at near-real-time timing. The received game information is stored as the game information data 2282*a* in the analysis database 2282 in the storage device 2280.

In addition, when the game information analysis system 2001 is introduced in the existing game system, the accumulated past game information can be collectively received.

In addition, in the game information analysis system 2001, the index data 2282*b* used for the analysis of the game information is held in the analysis database 2282. Each piece of the index data 2282*b*, for which updating and generation are required each time the game information is received, is calculated in the later-described game information analysis part 2255 to be stored as index data 2282*b*.

Based on the game information data 2282*a*, the index data 2282*b*, and the like in the analysis database 2282, the game information analysis part 2255 conducts an analysis process at a predetermined timing and stores an analysis result as the analysis result data 2282*c* in the analysis database 2282. It is to be noted that as the timing at which the game information analysis part 2255 conducts the analysis process, various timings such as a timing at which a user issues a request to display the analysis report via the client terminal 2011 and a timing at which the game information reception part 2254 receives the game information can be set.

In addition, when the game information reception part 2254 collectively receives the accumulated past game information, the configuration can be arranged such that through batch processing in the night, the analysis process is conducted from the predetermined game information or the index data is generated.

The network I/F (interface) part 2256 controls the network I/F 2208 shown in FIG. 28, controls data transmission and reception between the analysis server 2012 and the client terminal 2011, and controls reception of the game information transmitted from the hall management server 2013.

It is to be noted that the respective functions of the analysis server 2012 shown in FIG. 31 are executed through the control by the CPU 2201 of the analysis server 2012 shown in FIG. 28.

Figure 32:
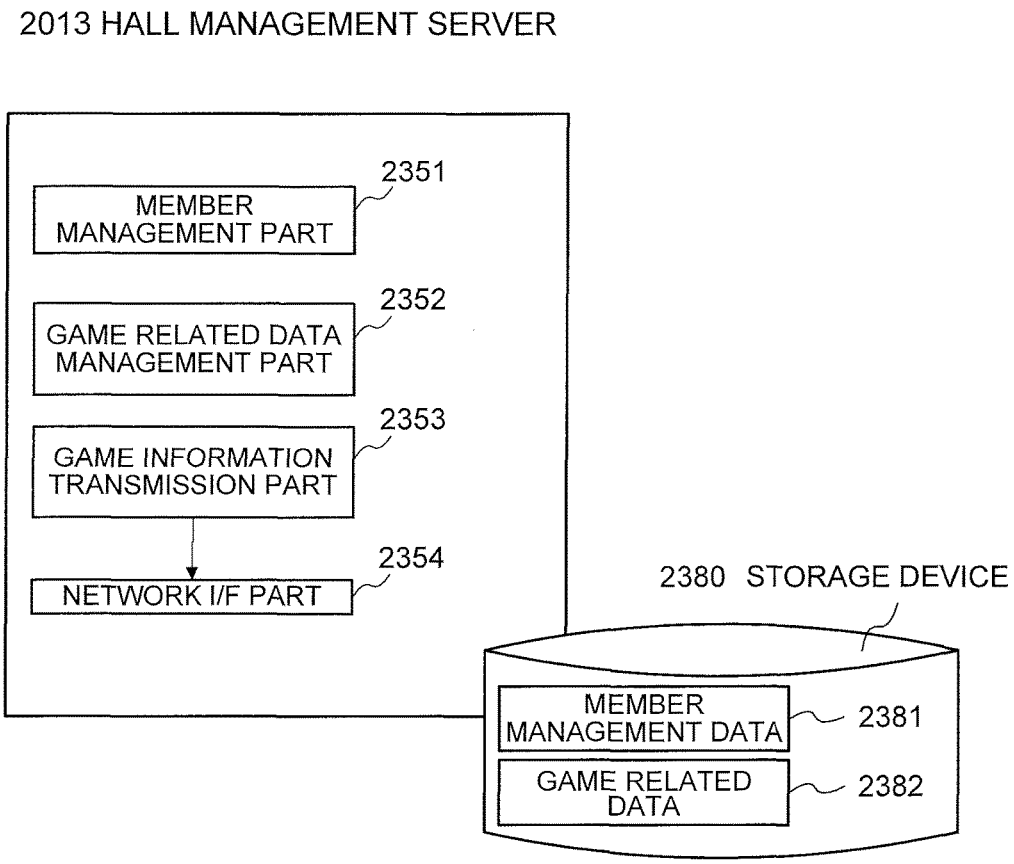
FIG. 32 is a functional block diagram of the hall management server in the game information analysis system.

FIG. 32 is a functional block diagram of the hall management server 2013. The hall management server 2013 includes a member management part 2351, a game related data management part 2352, a game information transmission part 2353, and a network I/F (interface) part 2354. In addition, the hall management server 2013 stores member management data 2381 and game related data 2382 in a storage device 2380 (corresponding to the external storage device 2304 shown in FIG. 29).

Here, the member management data 2381 includes information pertinent to members who have been registered as members in a hall store. In addition, the game related data 2382 includes game information transmitted from the hall management server 2013 to the analysis server 2012 and stores a game history on each of the slot machines 2014 (the game history of each member is managed so as to be associated with an identifier such as a member ID) and in addition thereto, stores a variety of pieces of information or the like which include information pertinent to machine information and failure of each of the slot machines 2014.

The member management part 2351 controls an operation of the member registration in a hall store and stores information pertinent to registered members in the member management data 2381 in the storage device 2380.

The game related data management part 2352 collects game related data from each of the slot machines 2014 and stores the data in the game related data 2382. As the game related data, starting time of each game on each of the slot machines 2014, termination time of each game thereon, a BET amount, a payout amount, a machine ID, a player ID (in a case of a member) and in addition thereto, a variety of pieces of game related data are included.

The game information transmission part 2353 transmits the data collected by the game related data management part 2352 from each of the slot machines 2014 to the analysis server 2012 having a previously set address as needed. The pieces of information related to each game such as the starting time of a game, the termination time thereof, and the BET amount are transmitted basically in real time, and the timing of the transmission is determined variously in accordance with a kind of the data.

The respective functions of the hall management server 2013 shown in FIG. 32 are executed through the control by the CPU 2301 of the hall management server 2013 shown in FIG. 29. In addition, there is a case where the game information analysis system 2001 is designed and developed independently of the game system including the hall management server 2013 (for example, a case where the game information is transmitted from a hall management server 2013 of the existing game system manufactured by other company to the game information analysis system 2001). In such a case, it is required to devise consistency between a transmission protocol and a transmission format of the hall management server 2013 in the game system and a reception protocol and a reception format of the analysis server 2012 in the game information analysis system 2001.

[Outline of Menu Configuration of Game Information Analysis System]

Next, with reference to FIG. 33 to FIG. 41, a menu screen having a hierarchical structure, which is displayed on a display of a client terminal 2011 by a game information analysis system 2001, will be described.

Figure 33:
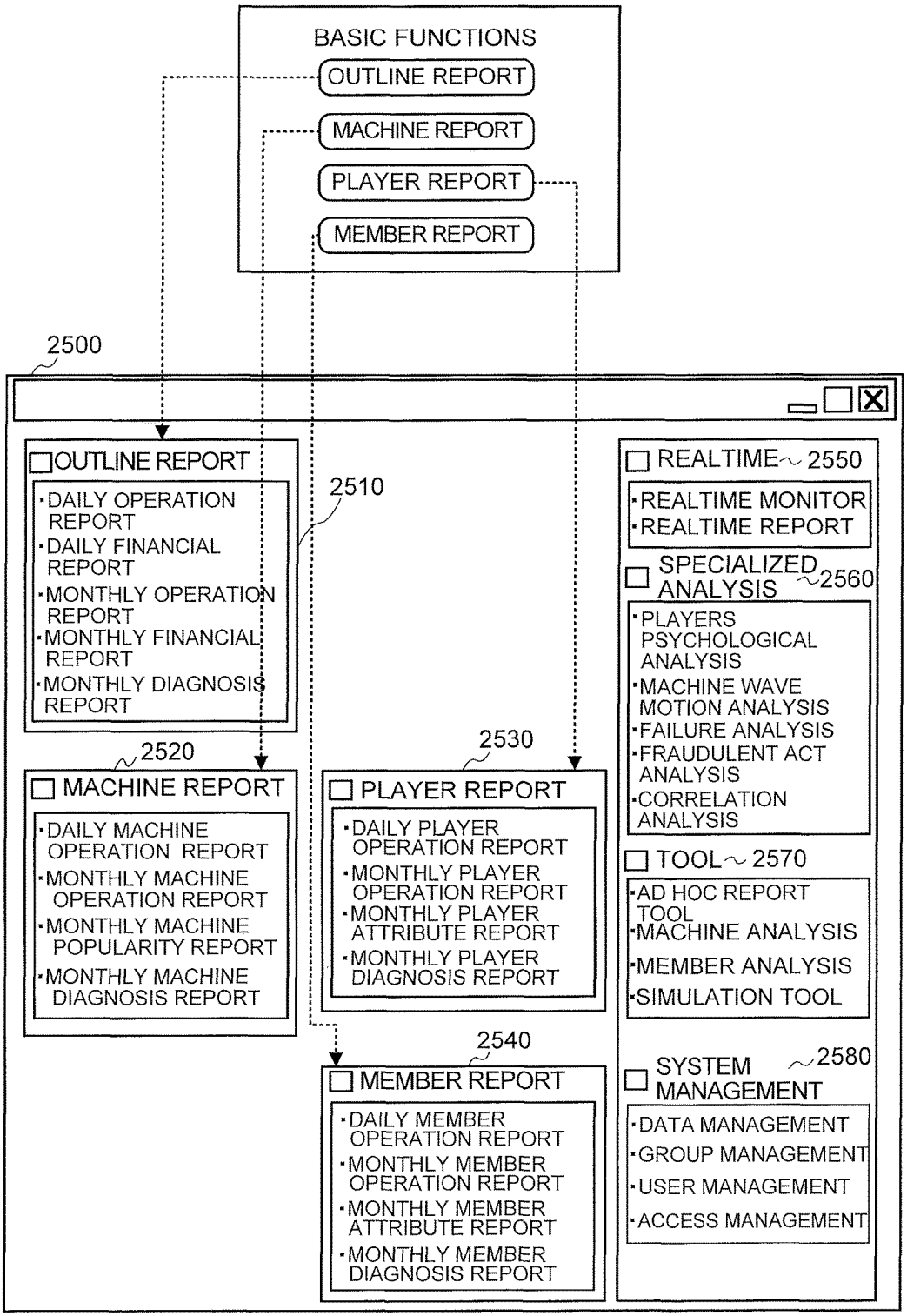
FIG. 33 is a diagram showing a menu screen displayed in the game information analysis system.

FIG. 33 is a diagram showing a menu screen 2500 displayed on the display of the client terminal 2011. In FIG. 33, the menu screen 2500 is shown so as to be associated with basic functions of the game information analysis system 2001. The menu screen 2500 is a screen initially displayed on the display of the client terminal 2011, for example, when a user has logged in to the game information analysis system 2001 by the client terminal 2011.

As shown in FIG. 33, the menu screen 2500 roughly includes respective display parts which are an outline report display part 2510; a machine report display part 2520; a player report display part 2530; a member report display part 2540; a real time display part 2550; a specialized analysis display part 2560; a tool display part 2570; and a system management display part 2580.

As shown in an upper portion in FIG. 33, the basic functions of the game information analysis system 2001 include an outline report, a machine report, a player report, and a member report. Among these functions, the basic function "outline report" is associated with the outline report display part 2510, and in other words, by respective reports provided by the outline report display part 2510, said basic function is realized. Similarly, the basic function "machine report" is associated with the machine report display part 2520; the basic function "player report" is associated with the player report display part 2530; and the basic function "member report" is associated with the member report display part 2540.

Figure 34:
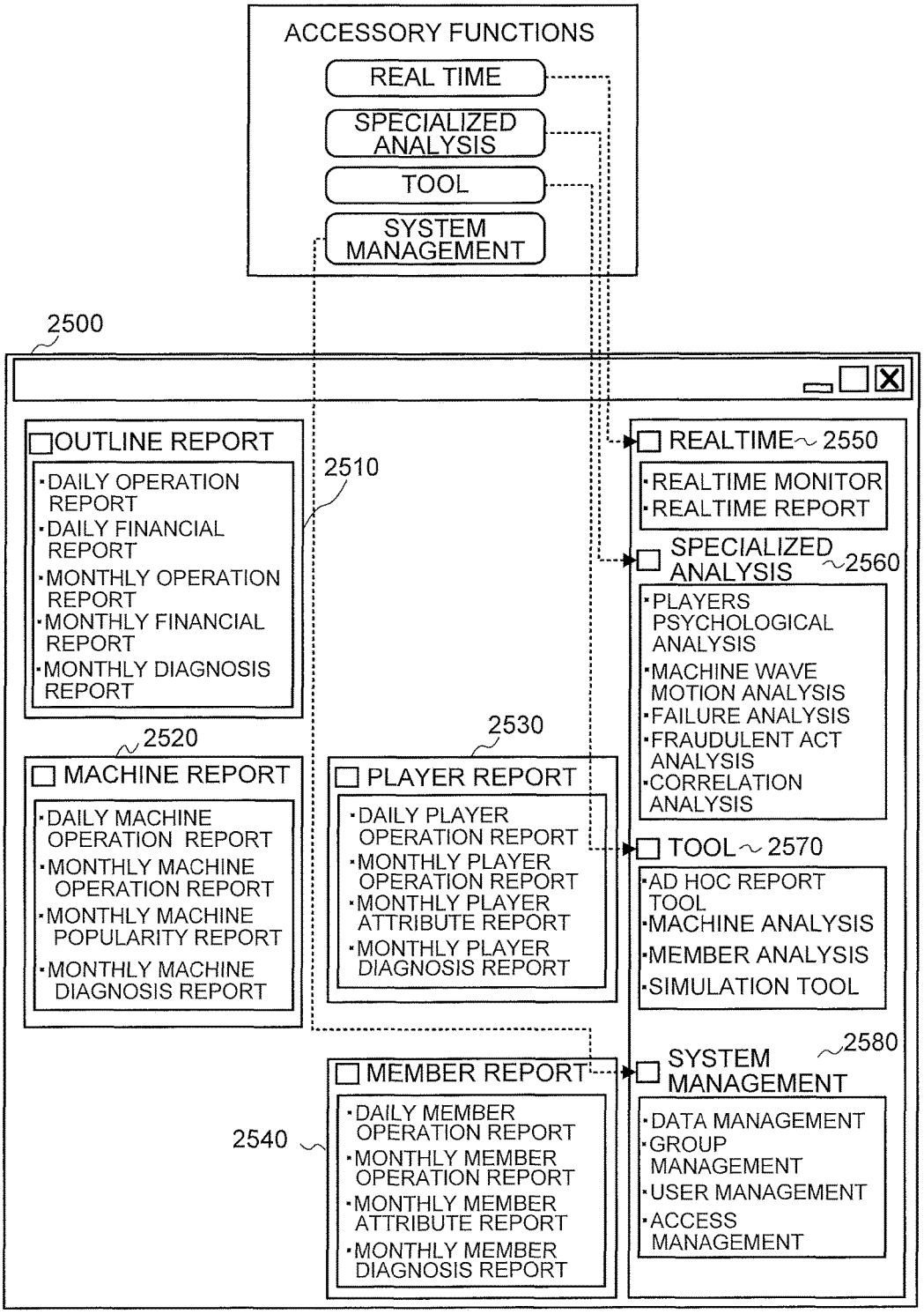
FIG. 34 is a diagram showing a menu screen displayed in the game information analysis system.

Although in FIG. 34, the same menu screen 2500 as shown in FIG. 33 is shown, here, the menu screen 2500 is shown so as to be associated with accessory functions of the game information analysis system 2001.

As shown in an upper portion in FIG. 34, the accessory functions of the game information analysis system 2001 include: real time; a specialized analysis; a tool; and system management. Among these functions, the accessory function "real time" is associated with the real time display part 2550, and in other words, by a monitor display and a report provided by the real time display part 2550, said basic function is realized. Similarly, the accessory function "specialized analysis" is associated with the specialized analysis display part 2560; the accessory function "tool" is associated with the tool display part 2570; and the accessory function "system management" is associated with the system management display part 2580.

Figure 35:
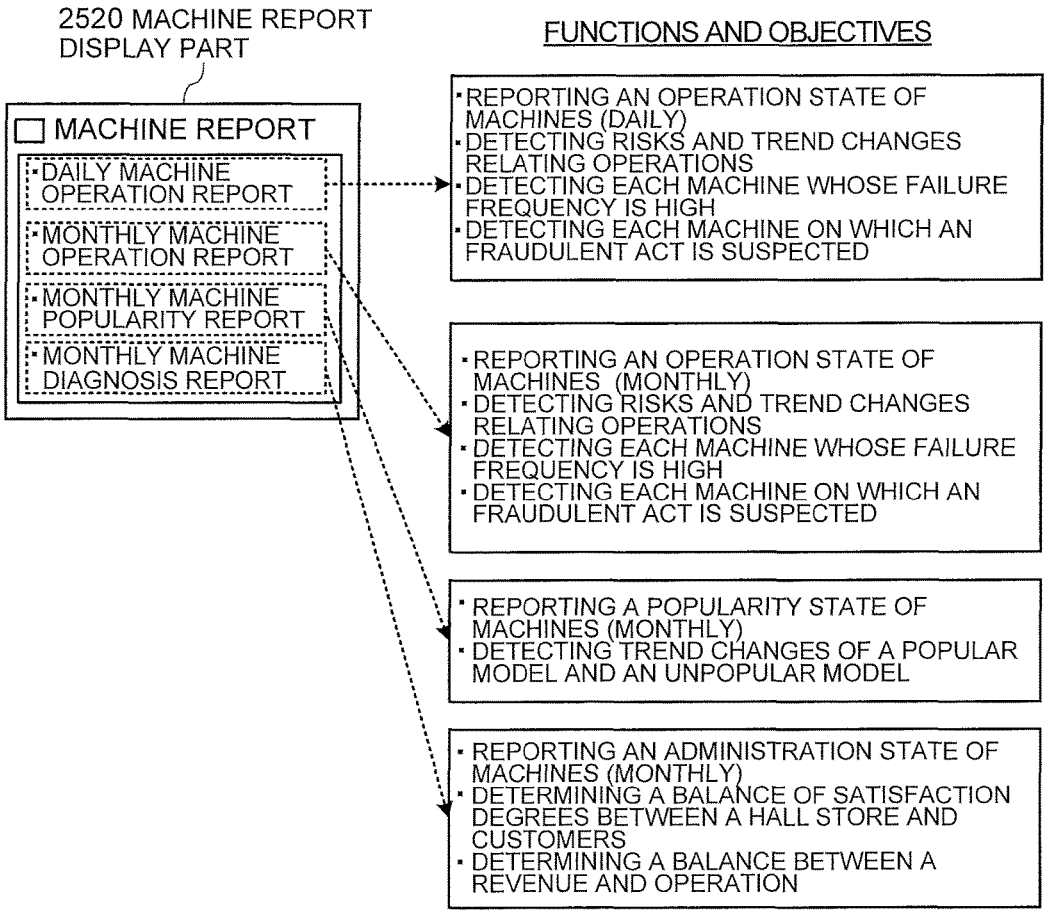
FIG. 35 is a diagram explaining a machine report of the menu screen displayed in the game information analysis system.

FIG. 35 is a diagram explaining functions and objectives of respective reports which can be selected by the machine report display part 2520 among the display parts of the menu screen 2500.

As shown in FIG. 35, as the reports which can be selected by the machine report display part 2520, there are a daily machine operation report, a monthly machine operation report, a monthly machine popularity report, and a monthly machine diagnosis report.

Here, an objective of the daily machine operation report is to report a daily operation state of machines (in this example, slot machines), and a variety of pieces of data which allow risks and trend changes related to the operation to be detected are displayed. In addition, data for detecting each machine whose failure frequency is high and data for detecting each machine on which a fraudulent act is suspected are displayed (ranking of machines (caution-needed machines), each of which is targeted for the fraudulent act or has the possibility of being targeted therefor, and the like are displayed). An objective of the monthly machine operation report is to report a monthly operation state of the machines, and a variety of pieces of data which allow risks and trend changes related to the operation to be detected are displayed. In addition, data for detecting each machine whose failure frequency is high and data for detecting each machine on which the fraudulent act is suspected are displayed (the ranking of the caution-needed machines and the like are displayed).

In addition, an objectives of the monthly machine popularity report is to report a monthly popularity state of the machines, and data for detecting trend changes of a popular model and an unpopular model is displayed. An objective of the monthly machine diagnosis report is to report a monthly administration state of the machines, and data for determining a balance between a degree of satisfaction of a hall store and degrees of satisfaction of customers is displayed. In addition, data for determining a balance between a revenue and operation is displayed.

Figure 36:
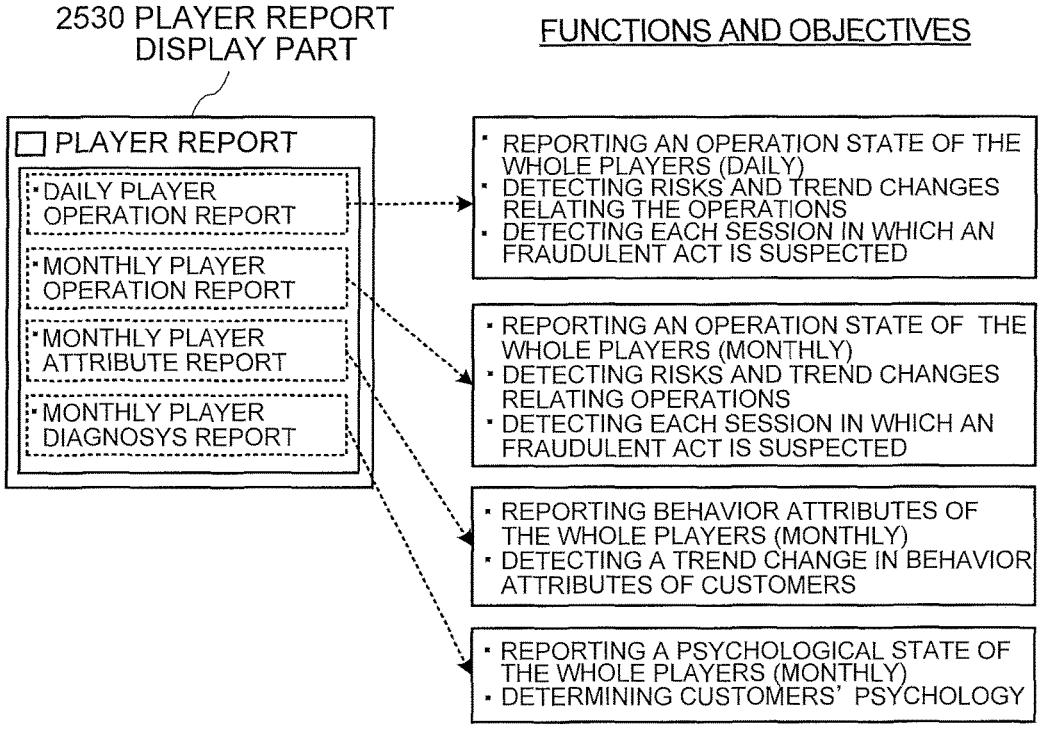
FIG. 36 is a diagram explaining a player report of the menu screen displayed in the game information analysis system.

FIG. 36 is a diagram explaining functions and objectives of respective reports which can be selected by the player report display part 2530 among the display parts of the menu screen 2500.

As shown in FIG. 36, as the reports which can be selected by the player report display part 2530, there are a daily player operation report, a monthly player operation report, a monthly player attribute report, and a monthly player diagnosis report.

Here, an objective of the daily player operation report is to report a daily operation state of the whole players, and a variety of pieces of data which allow risks and trend changes related to the operation to be detected are displayed. In addition, data which allows each game section (each caution-needed session) in which the fraudulent act is suspected to be detected is displayed (ranking of caution-needed machines and the like are displayed). An objective of the monthly player operation report is to report of a monthly operation state of the whole players, and a variety of pieces of data which allow risks and trend changes related to the operation to be detected are displayed. In addition, data which allows each player (including members and non-members) who is suspected of committing a fraudulent act, each caution-needed session in which a fraudulent act is suspected, and the like to be detected is displayed (ranking of Winloss values of caution-needed players, ranking of caution-needed machines, and the like are displayed). An objective of the monthly player attribute report is to report monthly behavior attributes of the whole players, and a variety of pieces of data which allow trend changes in behavior attributes of customers to be detected are displayed. An objective of the monthly player diagnosis report is to report monthly psychological states of the whole players, and a variety of pieces of data for determining customer psychology are displayed. It is to be noted that the Winloss is calculated by an equation: Winloss=an investment money amount by a player (IN)−a payout amount by a slot machine (OUT).

Figure 37:
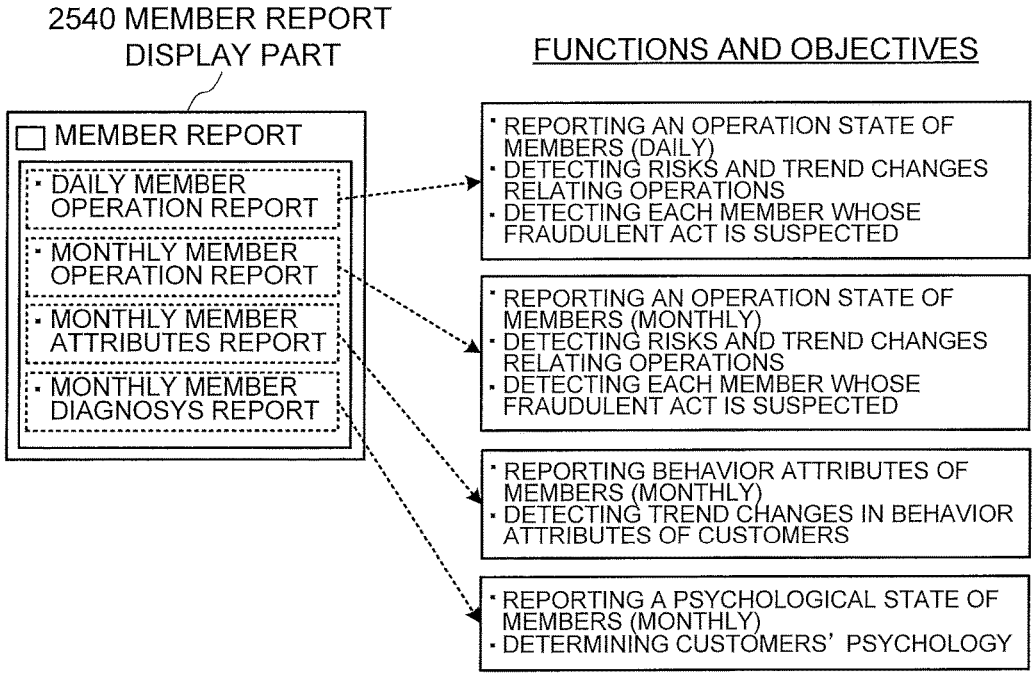
FIG. 37 is a diagram explaining a member report of the menu screen displayed in the game information analysis system.

FIG. 37 is a diagram explaining functions and objectives of respective reports which can be selected by the member report display part 2540 among the display parts of the menu screen 2500.

As shown in FIG. 37, as the reports which can be selected by the member report display part 2540, there are a daily member operation report, a monthly member operation report, a monthly member attribute report, and a monthly member diagnosis report.

Here, an objective of the daily member operation report is to report a daily operation state of members, and a variety of pieces of data which allow risks and trend changes related to the operation to be detected are displayed. In addition, data which allows each member who is suspected of committing the fraudulent act to be detected is displayed (ranking of Winloss values of caution-needed members and the like are displayed). An objective of the monthly member operation report is to report a monthly operation state of members, and a variety of pieces of data which allow risks and trend changes related to the operation to be detected are displayed. In addition, data which allows each member who is suspected of committing the fraudulent act to be detected is displayed (the ranking of Winloss values of caution-needed members and the like are displayed). An objective of the monthly member attribute report is to report monthly behavior attributes of members, and a variety of pieces of data which allow trend changes in behavior attributes of customers to be detected are displayed. An objective of the monthly member diagnosis report is to report a monthly psychological state of members, and a variety of pieces of data for determining customer psychology are displayed.

Figure 38:
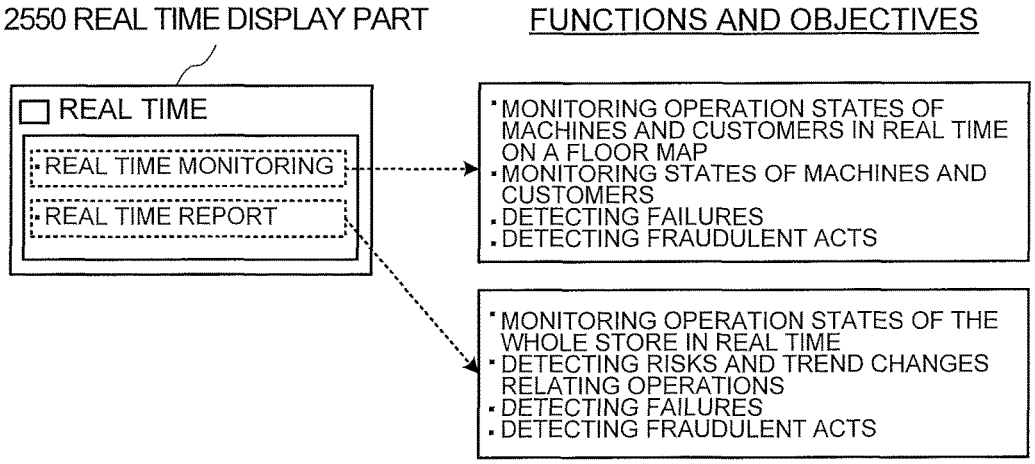
FIG. 38 is a diagram explaining real time monitoring of the menu screen displayed in the game information analysis system.

FIG. 38 is a diagram explaining functions and objectives of respective reports which can be selected by the real time display part 2550 among the display parts of the menu screen 2500.

As shown in FIG. 38, as the report which can be selected by the real time display part 2550, there are real time monitoring and a real time report.

Here, an objective of the real time monitoring is to monitor operation states of machines and customers in real time on a floor map, and a monitoring screen for the states of machines and customers is displayed and in addition, data which allows failure to be detected and the fraudulent act to be detected is displayed. An objective of the real time report is to report an operation state of the whole hall store in real time, and data which allows risks and trends related to the operation to be detected is displayed, and in addition, data which allows failure to be detected and the fraudulent act to be detected is displayed.

FIG. 39 shows contents of the report displayed when the real time monitoring which can be selected by the real time display part 2550 is selected. As shown in FIG. 39, in the real time monitoring, a session, an event, a meter, a temperature, a humidity, a voltage, and a phone call are displayed by, for example, a Web browser executed on the client terminal 2011 as one Web page on the display of the client terminal 2011. In addition, as options, a camera angle, temperature evaluation, and a phone call line are displayed.

Here, for example, the session generates and displays a store visiting state of a player, an alert related to a caution-needed machine, an alert related to a caution-needed player, and the like. The event displays machine statuses (for example, states of a stacker, a jackpot, a hand pay, maintenance, and the like). The meter detects a caution-needed machine, for example, by meter data transmitted from each of the slot machines 2014 and displays a state thereof. The temperature displays distribution of machine temperatures. The humidity displays distribution of machine humidity. The voltage displays distribution of machine voltages. The phone call displays phone call statuses. In addition, the camera angle displays monitoring cameras in a hall store and ranges of visual fields. The temperature evaluation displays a temperature map of the whole floor. The phone call line displays an image of phone call lines.

Figure 40:
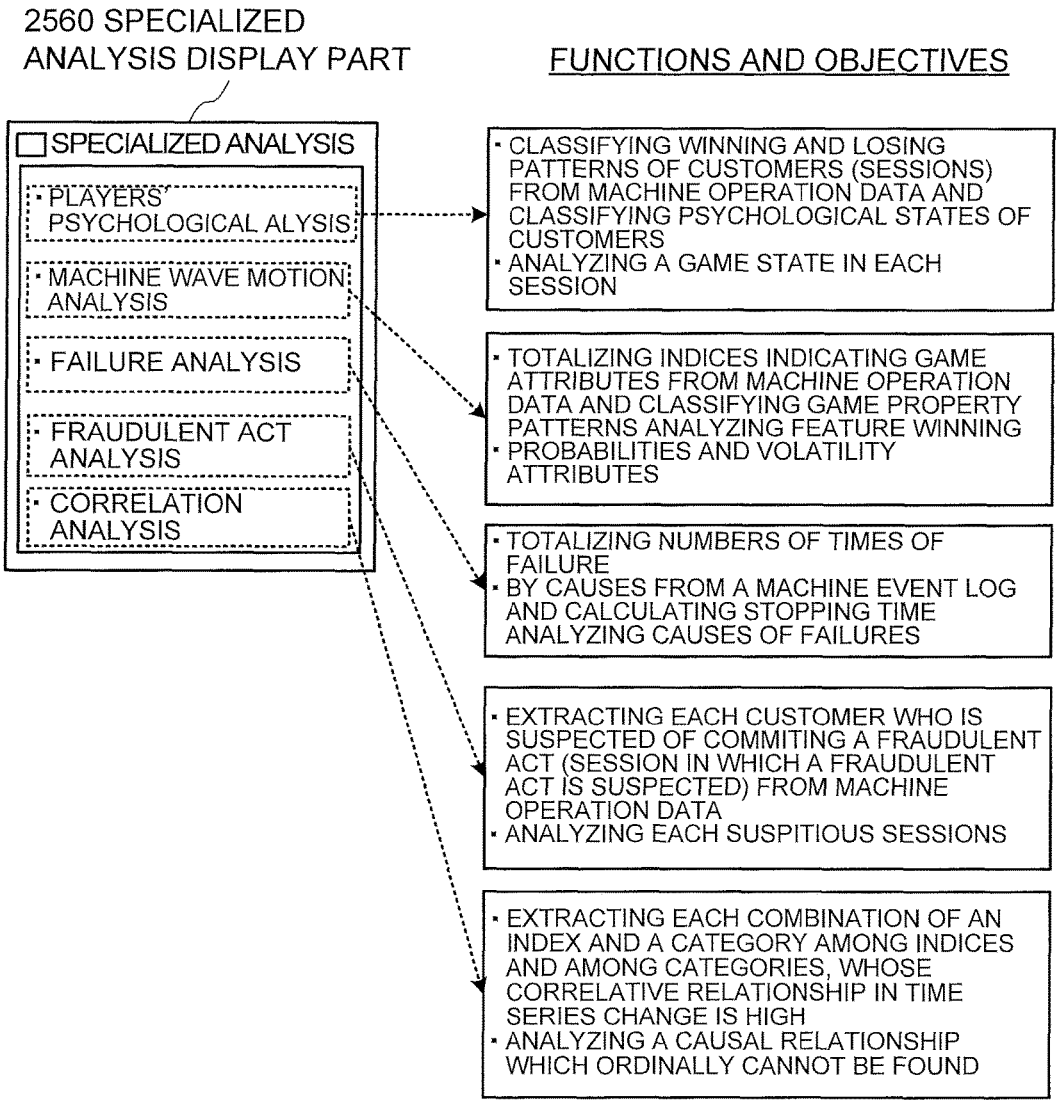
FIG. 40 is a diagram explaining a specialized analysis of the menu screen displayed in the game information analysis system.

FIG. 40 is a diagram explaining functions and objectives of respective reports which can be selected by the specialized analysis display part 2560 among the display parts of the menu screen 2500.

As shown in FIG. 40, as the reports which can be selected by the specialized analysis display part 2560, there are a player psychological analysis, a machine wave motion analysis, a failure analysis, a fraudulent act analysis, and a correlation analysis.

Here, an objective of the player psychological analysis is to analyze winning and losing patterns of customers (sessions) from machine operation data and to classify psychological states of customers, and data which allows a game state in each session to be analyzed is displayed. An objective of the machine wave motion analysis is to totalize indices indicating game attributes from the machine operation data and to classify game property patterns, and data which allows feature winning probabilities and volatility attributes to be analyzed is displayed. An objective of the failure analysis is to totalize numbers of times of failure classified by causes from a machine event log and to calculate stopping time, and data which allows failure causes to be analyzed is displayed. An objective of the fraudulent act analysis is to extract each caution-needed player and each caution-needed machine from the machine operation data, and data which allows each caution-needed session to be analyzed is displayed. An objective of the correlation analysis is to extract each combination of an index and a category among indices and among categories, whose correlative relationship in time series change is high, and data which allows a causal relationship, which ordinarily cannot be found, to be analyzed is displayed.

FIG. 41 shows contents of the report displayed when the fraudulent act analysis which can be selected by the specialized analysis display part 2560 is selected. As shown in FIG. 41, in the fraudulent act analysis, a fraudulent act analysis report is displayed by, for example, a Web browser executed on the client terminal 2011 as one Web page on the display of the client terminal 2011.

Here, for example, the fraudulent act analysis report displays a monthly caution-needed session list, caution-needed machine list, and caution-needed member list.

Besides, as a display part of the menu screen 2500, there is the system management display part 2580 which is selected to conduct setting or the like for the game information analysis system 2001. As functions which can be selected by the system management display part 2580, as shown in FIG. 34, there are data management, group management, user management, and access management.

The data management is selected, for example, to conduct setting for game information or the like received from the hall management server 2013, and the group management is selected, for example, to conduct setting for grouping of the client terminal 2011, the analysis server 2012, and the hall management server 2013.

In addition, the user management is selected, for example, to register and manage a user of the client terminal 2011 which receives an analysis result provided from the analysis server 2012. The access management is selected, for example, to conduct setting a range of analysis results or the like which can be referenced, for example, when a registered user references an analysis result by using the client terminal 2011, in accordance with the user and the client terminal 2011.

[Use Case Related To Game Information Analysis System]

Next, with reference to FIG. 42 to FIG. 44, a manner in which a user of a game information analysis system 2001 can uses this game information analysis system 2001 will be described as use cases with respect to supposed users.

FIG. 42 is a diagram showing the supposed users of the present game information analysis system 2001 and representative use cases of said users. The users who are supposed to use the game information analysis system 2001 are broadly classified into four. A first user is an owner of a hall store. The owner is a person who performs operational management of a hall store. As the use cases of the owner, for example, there are management of operation indices of the whole hall store, sales risk management, an administration balance diagnosis, and the like.

A second user is a machine keeper. The machine keeper is a person who undertakes operational management of machines (in this example, slot machines). As the use cases of machine keeper, for example, there are grasping of machine popularity trends, machine maintenance management, fraudulent act countermeasures, and the like.

A third user is a marketer. The marketer is a person who ensures customers of a hall store and performs sales promotion. As the use cases of the marketer, for example, there are grasping of customer trends, planning of promotion projects, marketing research, and the like.

A fourth user is an operator. The operator is a person who performs operation work for machines and other apparatuses in a hall store. As the use cases of the operator, for example, there are, monitoring of operation indices, monitoring of visiting states of customers, monitoring related to machine operation, and the like.

Figure 43:
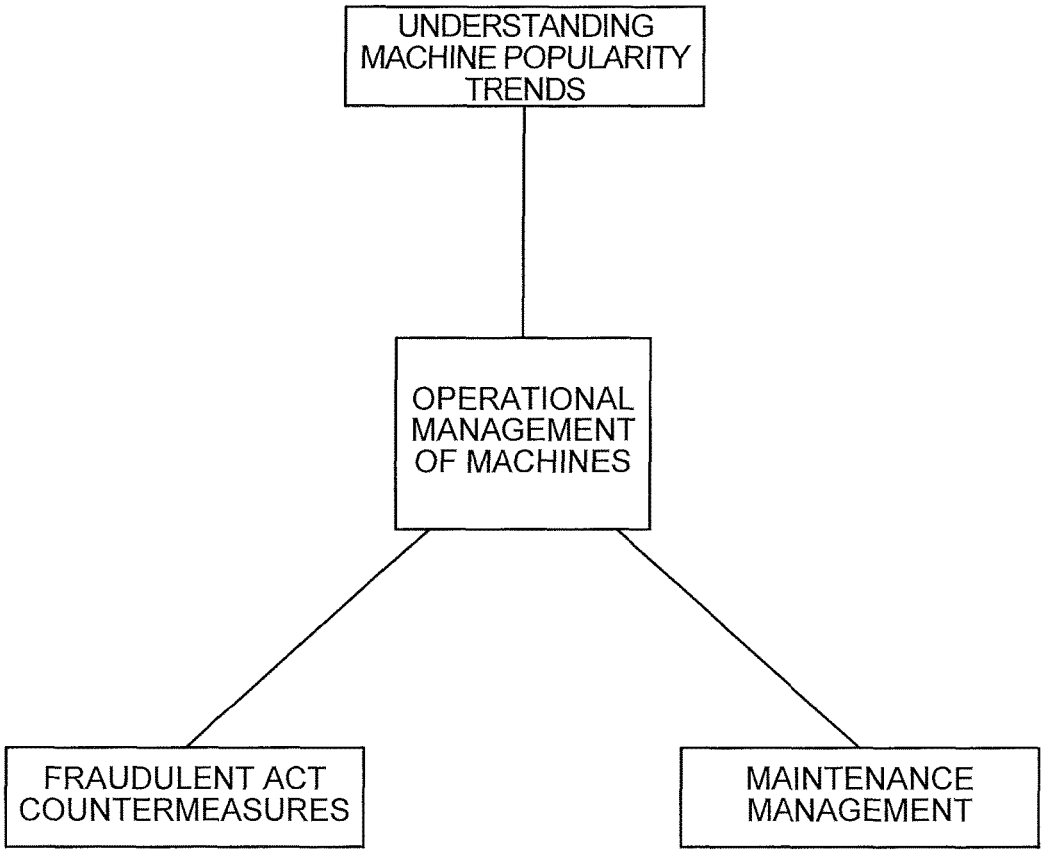
FIG. 43 is a diagram exemplifying relationship of a use case related to a machine keeper in the game information analysis system.

FIG. 43 is a diagram exemplifying relationship of the use cases related to the machine keeper. In the center of the work of the machine keeper, there is the operational management of machines, and the operational management includes: individual work of grasping of machine popularity trends; individual work of maintenance management; and individual work of fraudulent act countermeasures, and for each individual work, functions of the game information analysis system 2001 can be effectively utilized.

Figure 44:
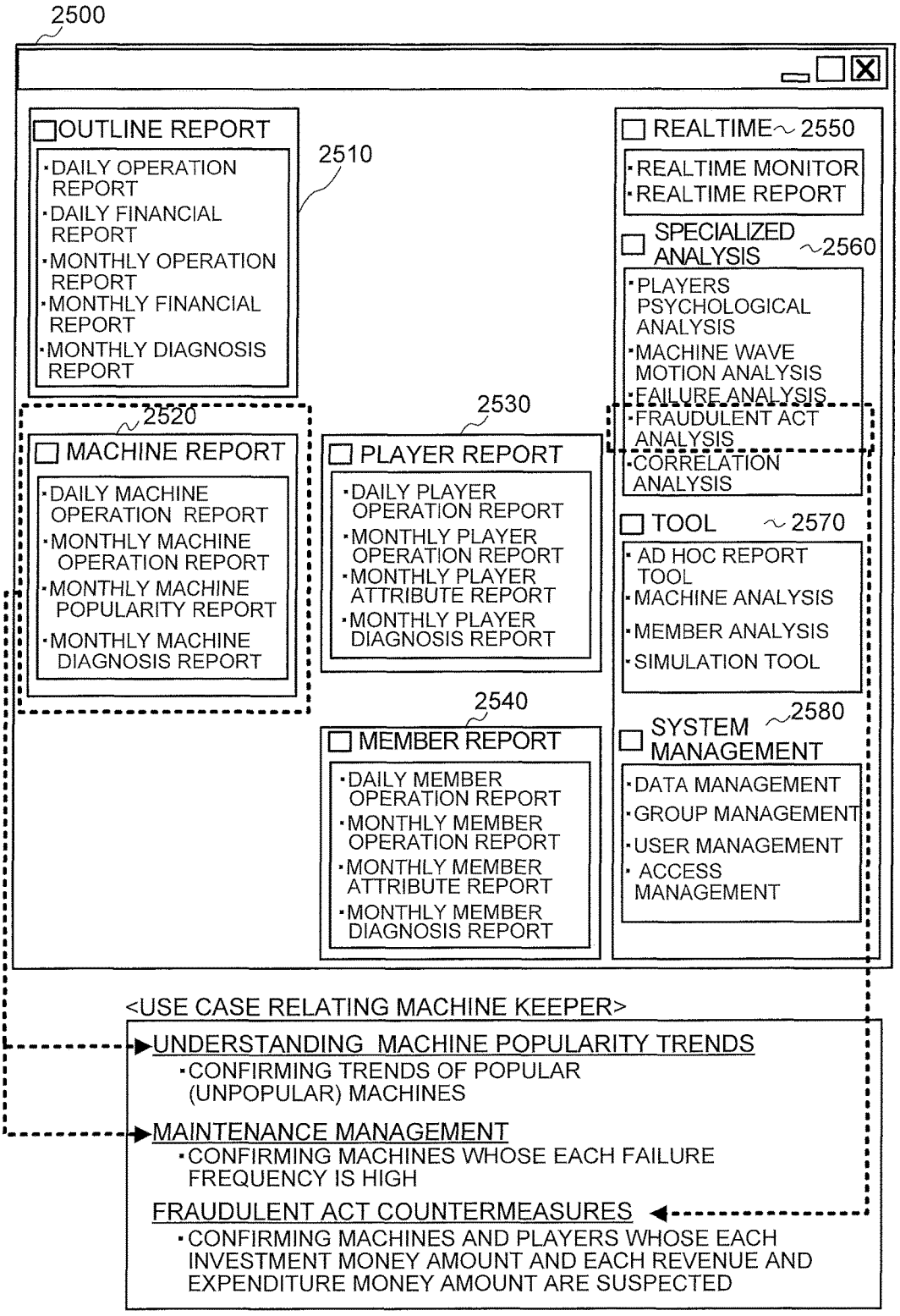
FIG. 44 is a diagram exemplifying the menu screen and the relationship of the use case related to the machine keeper in the game information analysis system.

FIG. 44 is a diagram showing the menu screen 2500 displayed on the display of the client terminal 2011 in the game information analysis system 2001 and showing which functions among the functions of this menu screen 2500 are effectively utilized in the use cases related to the machine keeper. As shown in FIG. 44, in the use cases related to the machine keeper, the variety of reports included in the machine report displayed by the machine report display part 2520 and the fraudulent act analysis displayed by the specialized analysis display part 2560 can be utilized.

In addition, as described with reference to FIG. 43, as the individual work related to the machine keeper, there are the individual work of grasping of the machine popularity trends and the individual work of the maintenance management, and the individual work of the fraudulent act countermeasures. The grasping of the machine popularity trends includes, for example, confirmation of trends of popular (unpopular) machines or the like (the above-described machine report is utilized); the maintenance management includes, for example, confirmation of machines whose each failure frequency is high or the like (the above-described machine report is utilized); and the fraudulent act countermeasures include confirmation of caution-needed machines and caution-needed players, on each of which and whose each investment money amount and each revenue and expenditure money amount are suspected or the like (the above-described fraudulent act analysis is utilized).

By the report of the fraudulent act countermeasures or the like, the machine keeper can efficiently find sessions, in each of which an investment money amount and a revenue and expenditure money amount have become abnormal, and can take improvement measures, for example, to reinforce monitoring of caution-needed machines and caution-needed players. As described above, by employing the game information analysis system 2001, the fraudulent act countermeasures can be managed, and losses caused by the fraudulent act can be minimized.

[Menu Configuration and Indices in Game Information Analysis System]

Next, with reference to FIG. 45 to FIG. 50, a configuration of a menu screen, indices, and categories which a game information analysis system 2001 provides and utilizes will be described.

FIG. 45 is a table organized as a list explaining basic indices provided by the game information analysis system 2001, together with obtainment and totalization methods. An input money amount (IN) shows a money amount inputted by a player. A paid-out money amount (OUT) shows a money amount paid out by a slot machine. A jackpot money amount (JP) shows a jackpot money amount paid out by a slot machine. A play sales money amount (Winloss) shows a sales money amount based on a difference between the input money amount and the paid-out money amount. A number of games (Games) shows a number of games played on a slot machine. A playing time period shows a time period from game start to game termination on a slot machine. A session is a unit of a series of games which a player plays with one BET amount (referred to as a "game section" as appropriate), and a session number shows a number of sessions.

The input money amount, the paid-out money amount, the jackpot money amount, and the number of games are data obtained from a hall management server (data transmitted from a slot machine). The play sales money amount, the playing time period, and the number of sessions are pieces of information calculated from the data or the like obtained from the hall management server. In addition, the number of games may be calculated from the data or the like obtained from the hall management server.

FIG. 46 is a table organized as a list explaining machine basic indices provided by the game information analysis system 2001, together with obtainment and totalization methods. As the machine basic indices, there are, for example, an operation ratio, stopping time, failure time, hand pay time, other stopping time, a number of operation days/machine, a number of machines (registered number), actually measured POs, an average BET per game, a number of times of a failure event, a number of times of a non-failure event, and a Hold ratio (Hold (%)).

For example, the operation ratio is an operation ratio of each of the machines (in this example, slot machines) and is calculated based on a playing time period/business hours. The stopping time is service stopping time other than the failure topping time. The failure time is service stopping time by a failure of a machine. The actually measured PO is a PO ratio in a time period or a game section and is obtained by an expression (OUT+IN)/IN×100. The Hold ratio is obtained by an expression (1−(OUT+JP)/IN)×100.

FIG. 47 is a table organized as a list explaining player basic indices provided by the game information analysis system 2001, together with obtainment and totalization methods. As the player basic indices, there are, for example, a number of members, a number of times of store visiting, intervals of store visiting, a number of days elapsed from the latest store visiting day, a number of store visiting members, a member ratio (%), and a customer satisfaction degree score.

Each of FIG. 48 and FIG. 49 is a table organized as a list with respect to machine categories provided by the game information analysis system 2001, together with classification definitions and remarks. As the machine categories, there are, for example, denominations, themes, vendors, locations, set payout ratios (%), the latest operation day, game type classes (game kinds), game type classes (with or without a link), game type classes (with or without a progressive jackpot), game type classes (display shapes), game type classes (a number of reels), game type classes (a number of lines), game type classes (a number of BETs per line), game type classes (bonus attributes), game type classes (table game kinds), game type classes, jackpot interval classes (intervals of jackpots of ×100 times or more), jackpot average multiplier classes (each average multiplier of ×100 times or more), low multiplier PO classes (POs excluding POs of ×100 times or more), feature hit interval classes, feature average multiplier classes, normal PO classes, machine user definitions, and caution need ranks.

FIG. 50 is a table organized as a list with respect to player categories provided by the game information analysis system 2001, together with classification definitions and remarks. As the player categories, there are, for example, player types (members or non-members), player ranks, sex, nationalities, ages, the latest operation day, member classification, game types, member user definitions, and caution need ranks.

[Game Information Analysis System Enabling Connection with the Existing Game System]

As described above, the game information analysis system 2001 is connected to a game system, obtains game information including machine operation data and the like (for example, IN/OUT information in each game and the like) from said game system, and conducts game analyses from said game information so as to determine not only a money amount of revenue and expenditure (simple winning or losing) of a player as a customer but also a psychological state of a player in games.

There is a case where the game system connected to the game information analysis system 2001 is designed and developed, independently of the game information analysis system 2001. For example, it is a case where the game information analysis system 2001 newly receives game information in the existing game system manufactured by other company, thereby conducting analyses.

The analysis server 2012 of the game information analysis system 2001 receives the game information from a hall management server 2013 and slot machines 2014 already operating in the existing game system as mentioned above. In such a case, the analysis server 2012 can be configured to grasp a protocol and a format of data transmitted from the hall management server 2013 of the game system and to receive the data so as to correspond thereto.

As described above, the game information analysis system 2001 can detect each session and can realize representation or the like using candlestick charts of game attributes. Therefore, also from the existing game system connected, basically, by using the game information related to IN/OUT, effective analyses of the game information can be conducted. In addition, by using the past game information (for example, machine operation data) accumulated by the existing game system, analyses of the same game information can be conducted.

By using the past game information accumulated by the existing game system, player attributes including a psychological state of a player, machine attributes, and the like can be analyzed. Thus, for example, even in a case where the game information analysis system 2001 is introduced halfway to said existing game system, for a while, without obtaining the game information from each of the slot machines and conducting the analysis, player attributes and machine attributes at the present time can be immediately grasped (by the past accumulated data), and from the moment at which the use of the game information analysis system 2001 is started, outputting or the like of effective analysis reports is enabled.

[Analysis System for Detecting Abnormality Caused on Gaming Machines]

Figure 51:
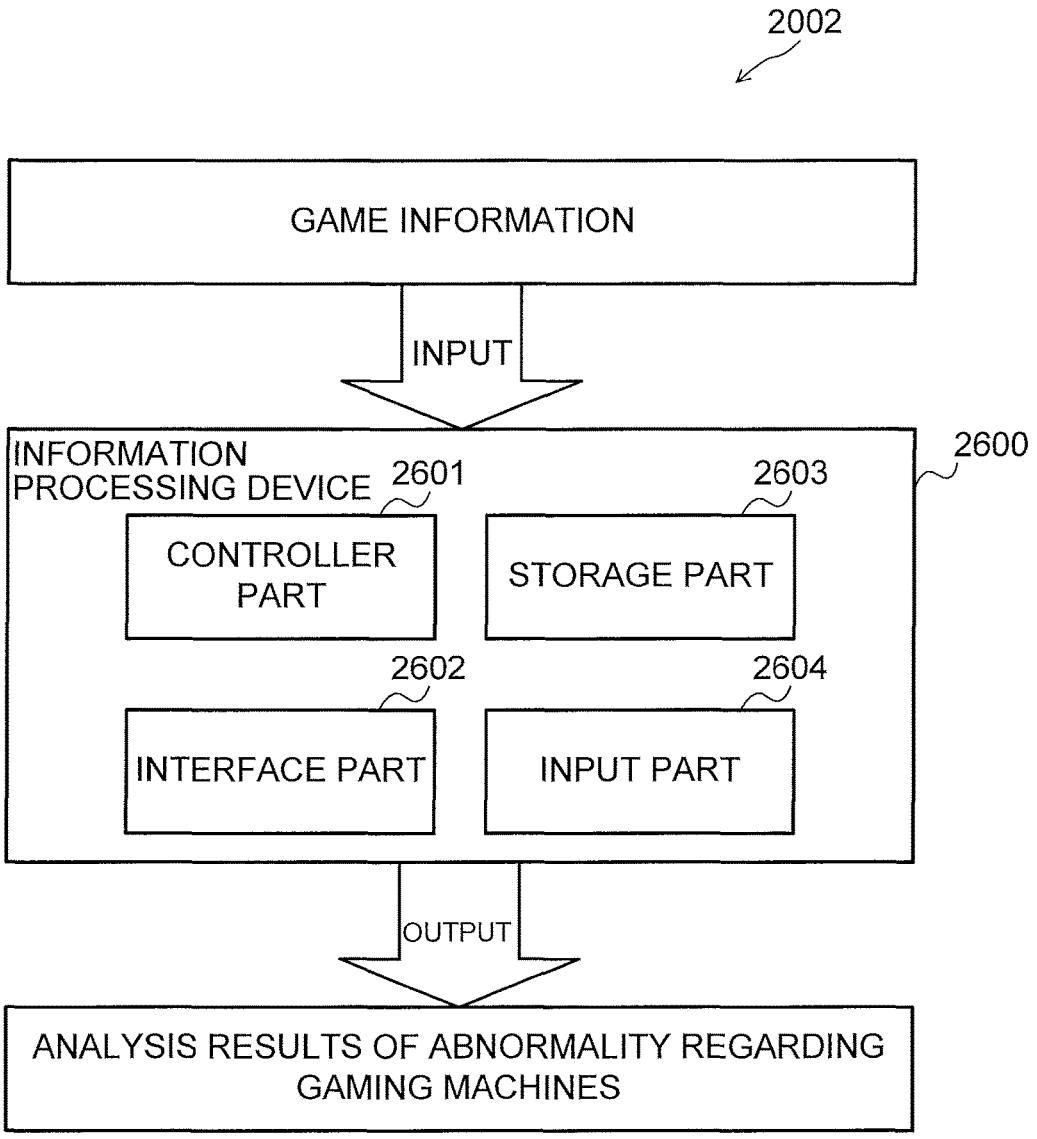
FIG. 51 is a diagram showing one example of a configuration in which abnormality caused on a gaming machine is detected.

FIG. 51 is a diagram showing one example of a configuration (an analysis system 2002) for detecting abnormality caused on gaming machines.

The analysis system 2002 has an information processing device 2600. In the analysis system 2002, game information is inputted to the information processing device 2600, the game information is analyzed by the information processing device 2600, and an analysis result is outputted from the information processing device 2600. The information processing device 2600 is configured to be operable to detect the abnormality caused on the gaming machines (caution-needed machines, caution-needed players, and the like).

The information processing device 2600 has a controller part 2601, an interface part 2602, a storage part 2603, and an input part 2604.

The controller part 2601 is configured to be operable to control the interface part 2602 and the storage part 2603. The controller part 2601 is configured to be operable to execute image analysis processing and the like. A CPU (Central Processing Unit), an MCU (Micro-Control Unit), a motherboard, a GPU (Graphics Processing Unit), a video card (graphics board), or the like functions as the controller part 2601. It is to be noted that separately from the controller part 2601, a display control part which is configured to be operable to control image displaying on a display part such as a display may be provided.

The interface part 2602 is configured to be operable to communicate with apparatuses connected to a network. Equipment for communication including wired communication and wireless communication (for example, a wired LAN, a wireless LAN, a communication module for mobile phone communication, or the like) or the like functions as the interface part 2602.

The storage part 2603 is configured to be operable to store a variety of pieces of information (programs, tables, and the like for controlling the analysis system 2002). A ROM (Read Only Memory), a RAM (Random Access Memory), a silicon disk, a hard disk, or the like functions as the storage part 2603.

For example, the CPU reads out the programs and table data stored in the ROM or the like to the RAM and executes the programs and table data, thereby realizing the respective functions of the controller part 2601, the interface part 2602, and the input part 2604.

The input part 2604 is configured to be operable to input a variety of pieces of information to the information processing device 2600 based on a user operation. An input output interface such as a USB terminal, a physical button, a physical keyboard, a mouse, a joystick, a user interface displayed on a liquid crystal touch panel, or the like functions as the input part 2604.

Each of FIG. 52 and FIG. 53 is a diagram showing one example of game information (a game information history). The game information history is game information which is transmitted from a slot machine 2014 via a hall management server 2013 to an analysis server 2012 and is stored in an analysis database 2282.

The game information history includes pieces of information pertinent to game start date and time, game termination date and time, a player ID, a machine ID, an input money amount, a paid-out money amount, a winning ratio per input money amount, and the like. It is to be noted that the game information history may include identification information which allows a series of games to be identified (for example, from the insertion of a membership card to taking-out thereof).

The winning ratio per input money amount (classified by input money amounts) is calculated for games in one game section. More specifically, the winning ratio per input money amount is calculated by "a total number of wins in one game section which are targeted for the calculation/a total number of games in the one game section which are targeted for the calculation×100".

For example, in NO. 1 to NO. 34 shown in FIG. 52, since the input money amount is "1", NO. 1 to NO. 34 are identified as one game section, and since in NO. 1 to NO. 3, game outcomes are "losing" and in NO. 4 and NO 5, game outcomes are "winning", a winning ratio in NO. 5 is calculated as 40% (=2/5×100).

For example, by using the game information history, what investment and payout are conducted in respective games on a specific slot machine 2014 can be grasped in real time at appropriate timing. In addition, for example, by using the game information history, what investment a specific player makes and what payout the specific player receives in the respective games can be grasped in real time at appropriate timing.

It is to be noted that the information stored as the game information history is not limited to the winning ratio per input money amount. For example, a winning ratio per BET number may be adopted, instead of the winning ratio per the input money amount. In this case, the game section is identified by the BET number. In addition, for example, a winning ratio per line number (a winning ratio per winning line number) may be adopted, instead of the winning ratio per the input money amount. In this case, the game section is identified by the number of lines.

In addition, although in this example, the respective records in the game information history are sorted in ascending order of pieces of data of start date and time for each player ID and each machine ID, the present invention is not limited thereto. For example, the respective records therein may be sorted simply in ascending order of pieces of data of start date and time. In addition, for example, the respective records in the game information history may be arranged in the order of registration of the records, and no sorting for the respective records may be made.

[Fraudulent Act Analysis Service]

Figure 54:
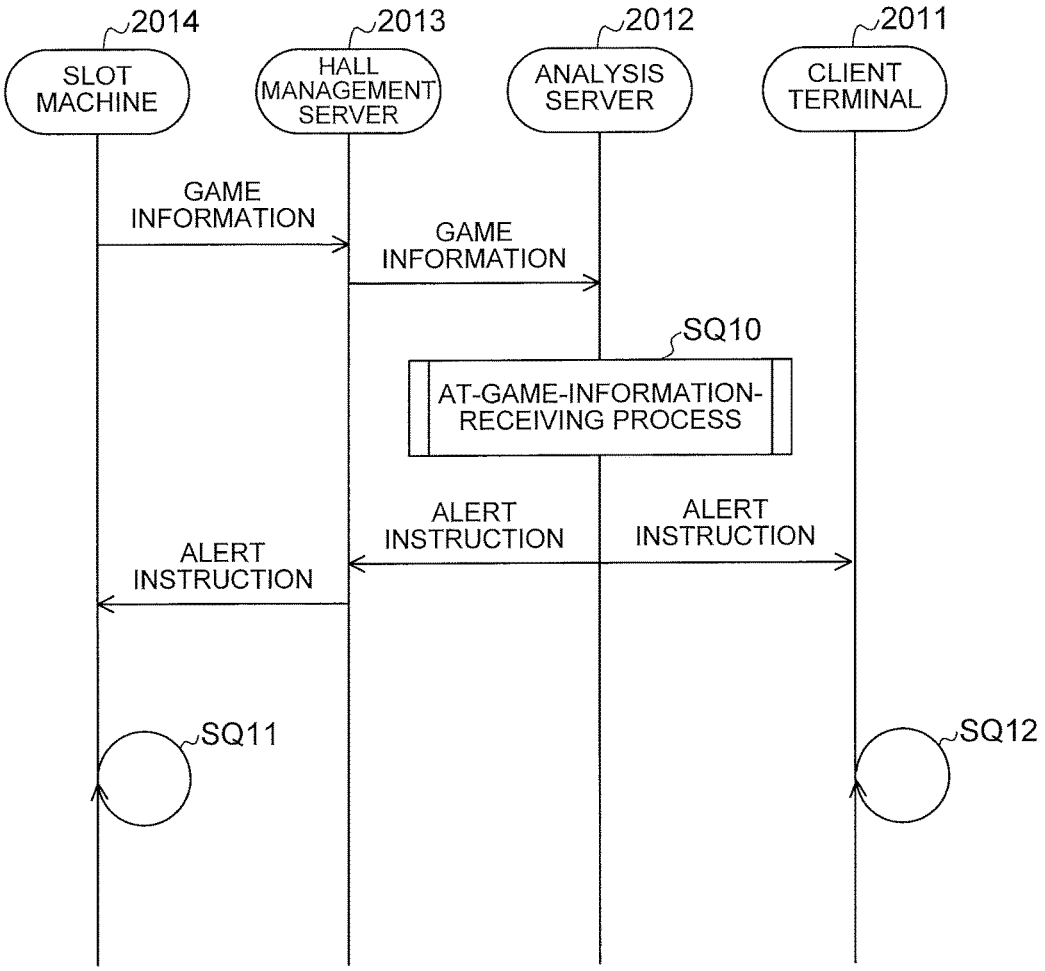
FIG. 54 is a diagram showing one example of a sequence showing a flow of fraudulent act analysis service.

FIG. 54 is a diagram showing one example of a sequence showing a flow of fraudulent act analysis service. The main flow of the fraudulent act analysis service for conducting a fraudulent act analysis in real time by using this sequence will be described. It is to be noted that although the below description is made by citing a fraudulent act as an example, the same configuration can be adopted also with respect to an act related to machine exploits.

In the fraudulent act analysis service, each slot machine 2014 transmits game information to a hall management server 2013. Upon receiving the game information, the hall management server 2013 stores the game information in a predetermined storage region and transmits the game information to an analysis server 2012.

More specifically, the hall management server 2013 transmits to the analysis server 2012 the game information which includes information pertinent to one game (a player ID, a machine ID, game start time, game termination time, an input money amount calculated based on a number of BETs, a paid-out money amount calculated based on a number of payout, and the like). It is to be noted that the input money amount may be the number of BETs or the paid-out money amount may be the number of payout. In addition, the game information includes eject operation information of an IC card 1500, cashout operation information, eject operation information of a membership card, seating/non-seating information by facial authentication, and the like.

It is to be noted that in the communication of a variety of pieces of information (game information, the later-described alert instruction, the later-described analysis request, the later-described analysis result, and the like), identification information (an identification code, an IP address of a transmission source, and the like) which allows a transmission source to be identified is included or the identification information is transmitted together with the variety of pieces of information. A reception destination transmits information requested by the transmission source based on the identification information which allows the transmission source to be identified.

Upon receiving the game information, the analysis server 2012 conducts an at-game-information-reception process (SQ10). Although the details thereof will be described later, in the at-game-information-reception process, the fraudulent act analysis is conducted, thereby allowing a caution-needed session and the like to be detected. Upon detecting the caution-needed session (a fraudulent act or the like) in the fraudulent act analysis, the analysis server 2012 displays an alert (a WEB page or the like) on a display 2205 and transmits alert instructions to the slot machine 2014 and a client terminal 2011.

Upon receiving the alert instruction, the slot machine 2014 notifies on a PTS terminal 1700 or the like that abnormality (the fraudulent act or the like) caused on the machine has been detected (SQ11).

Upon receiving the alert instruction, the client terminal 2011 notifies on a display 2105 or the like that that the abnormality (the fraudulent act or the like) caused on the machine has been detected (SQ12).

The fraudulent act analysis service is not limited to the above-described contents. For example, the configuration may be arranged such that the hall management server 2013 transmits the game information to the analysis server 2012 for each game start notification and each game termination notification which are transmitted from the slot machine 2014, and at the point in time when the pieces of information pertinent to one game have been obtained, the analysis server 2012 conducts the fraudulent act analysis.

Figure 55:
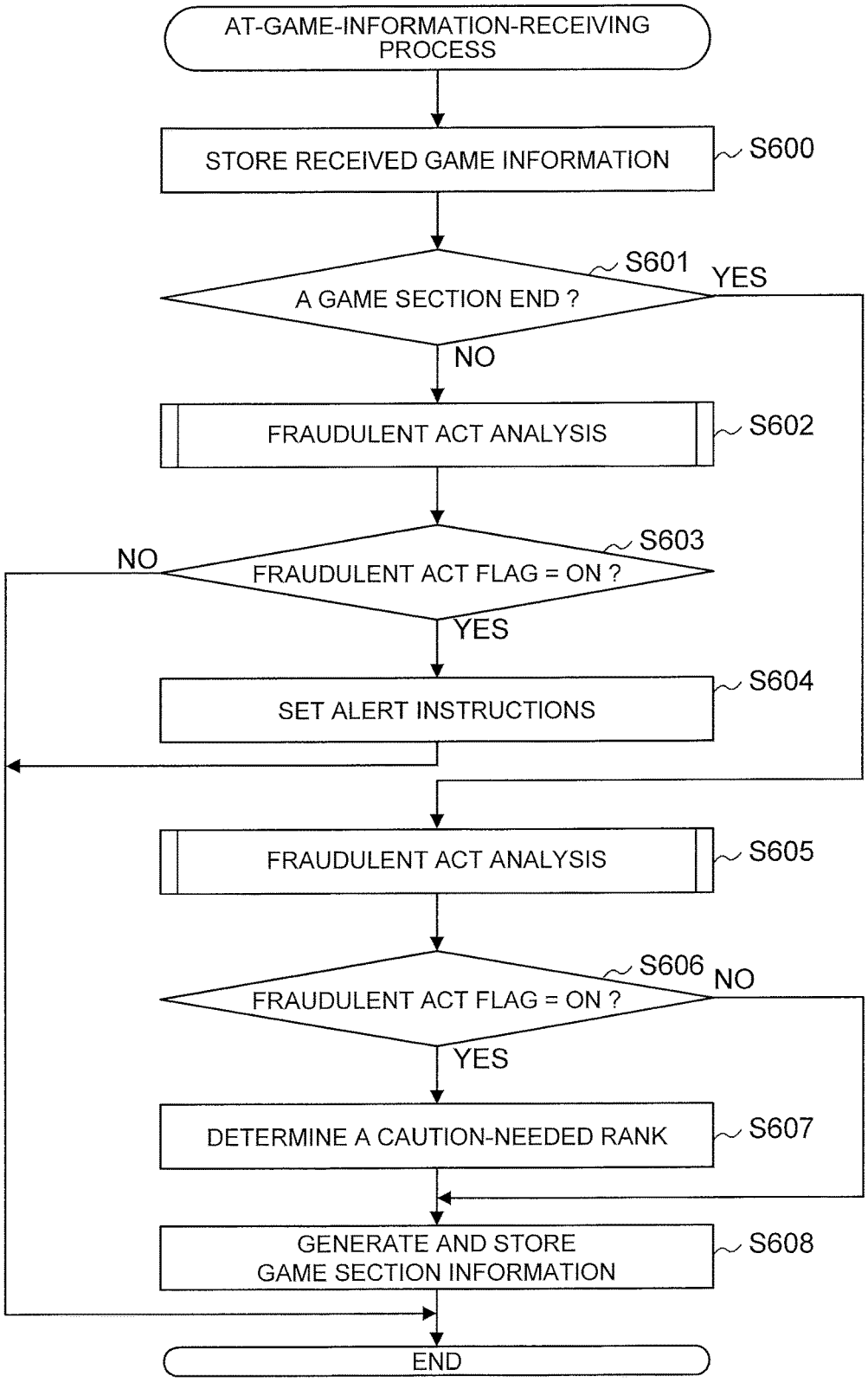
FIG. 55 is a flowchart showing one example of an at-game-information-reception process.

FIG. 55 is a flowchart showing one example of the at-game-information-reception process.

At S600, a CPU 2201 stores the received game information as a game information history in a predetermined region of an analysis database 2282.

At S601, the CPU 2201 determines whether or not a game section has been completed. More specifically, the CPU 2201 determines whether or not an input money amount has been changed and whether or not gaming has been terminated (whether or not an IC card 1500 has been ejected, whether or not a membership card has been ejected, seating/non-seating by facial authentication, or whether or not cashing-out has been conducted). When determining that the game section has been completed, the CPU 2201 shifts the processing to S605, and when determining that the game section has not been completed, the CPU 2201 shifts the processing to S602.

At S602, the CPU 2201 conducts the fraudulent act analysis. Although the details thereof will be described later, in the fraudulent act analysis, upon determining that the fraudulent act has been committed, a fraudulent act flag indicating that the fraudulent act has been committed is set to be on.

At S603, the CPU 2201 determines whether or not the fraudulent act flag is on. When determining that the fraudulent act flag is on, the CPU 2201 shifts the processing to S604, and when determining that the fraudulent act flag is off, the CPU 2201 finishes the at-game-information-reception process.

At S604, the CPU 2201 sets the alert instructions in a predetermined storage region. The alert instructions set in the predetermined storage region are transmitted to the client terminal 2011 and the slot machine 2014 at predetermined timing. It is to be noted that the configuration may be arranged such that an alert is displayed on the display 2205 of the analysis server 2012. After completing the processing at S604, the CPU 2201 finishes the at-game-information-reception process.

At S605, the CPU 2201 conducts the fraudulent act analysis.

At S606, the CPU 2201 determines whether or not the fraudulent act flag is on. When determining that the fraudulent act flag is on, the CPU 2201 shifts the processing to S607, and when determining that the fraudulent act flag is off, the CPU 2201 shifts the processing to S608.

At S607, the CPU 2201 determines a caution-needed rank. More specifically, with respect to a game section (session) in which it is determined that the fraudulent act has been committed, based on Winloss, the CPU 2201 determines the caution-needed rank. For example, the CPU 2201 calculates the caution-needed rank based on a value of Winloss/BET amount.

At S608, the CPU 2201 generates game section information and stores the game section information in a predetermined storage region. More specifically, when the CPU 2201 calculates a winning ratio in the game section and determines the caution-needed rank so as to include the calculated winning ratio, the CPU 2201 generates the game section information so as to include also the caution-needed rank (one example is shown in FIG. 57). Additionally, when the fraudulent act has been detected, the caution-needed rank is associated with a machine ID and a player ID. Thus, for example, when the fraudulent act has been detected, since the machine ID which allows the slot machine 2014 to be identified is stored, it is made possible to grasp the slot machine 2014 on which the fraudulent act has been committed and to take measures such as removal of said slot machine 2014. It is to be noted that although also when the act of a machine exploit has been detected, basically, the same is applied thereto, it is further made possible to take measures such as removal of machines whose models are the same as one another.

It is to be noted that although the configuration in which the generation of the game section information is triggered by the completion of the game section (in real time) is described, the present invention is not limited thereto. For example, a configuration in which the generation of the game section information is triggered by the termination of gaming may be adopted. In addition, for example, a configuration in which the game section information is generated on a regular basis may be adopted. In addition, for example, a configuration in which the generation of the game section information is triggered by an operation performed by a machine keeper or the like may be adopted.

Figure 56:
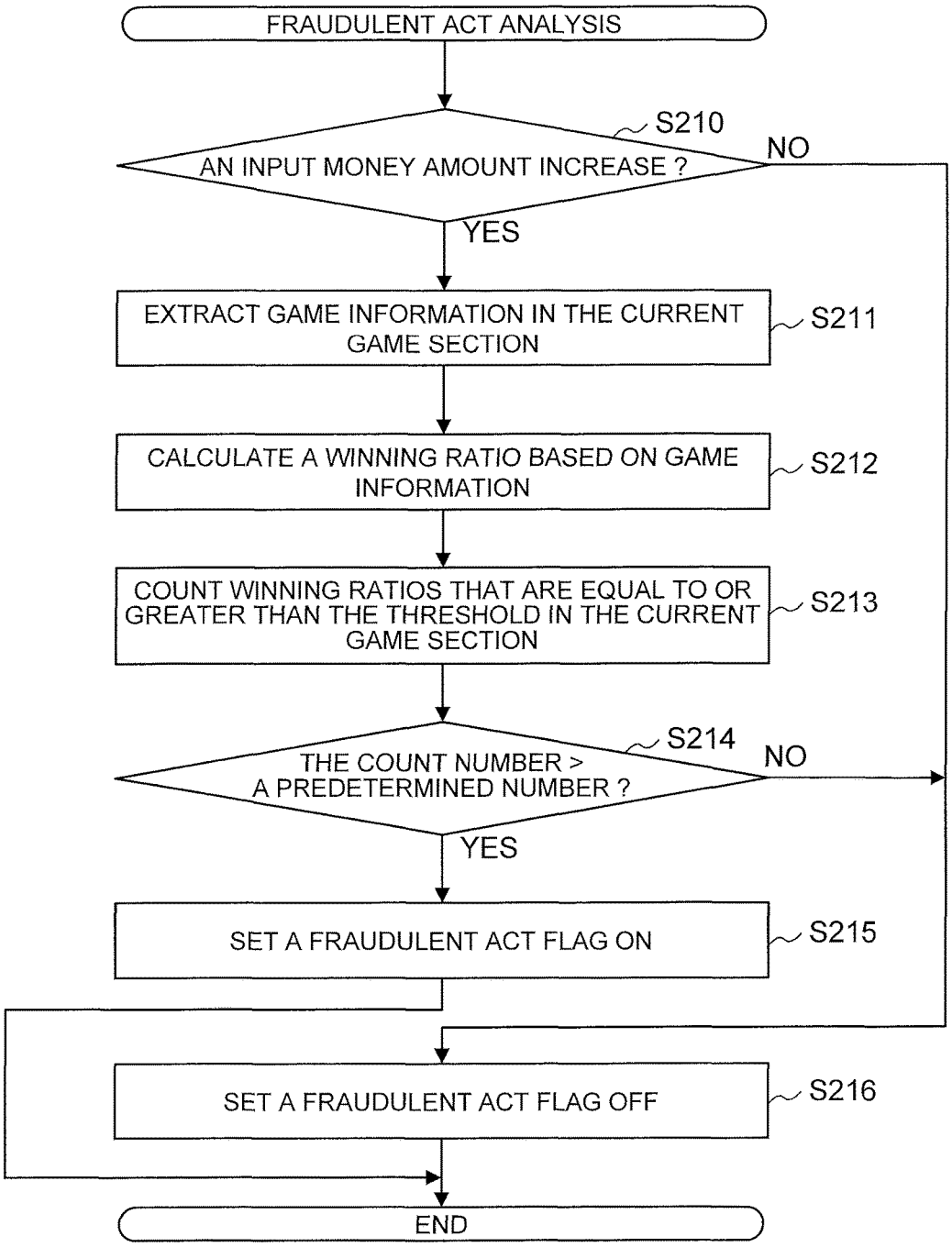
FIG. 56 is a flowchart showing one example of the fraudulent act analysis.

FIG. 56 is a flowchart showing one example of the fraudulent act analysis.

At S210, the CPU 2201 references the game information history and determines whether or not an input money amount is increased in the current game section from that in the previous game section. It is to be noted that the processing step at S210 corresponds to a determination processing part of the present invention. When determining that the input money amount is increased, the CPU 2201 shifts the processing to S211, and when determining that the input money amount is not increased, the CPU 2201 shifts the processing to S216.

At S211, the CPU 2201 extracts game information in the current game section. More specifically, based on the received game information, the CPU 2201 identifies a player ID, a machine ID, and an input money amount and extracts a series of pieces of game information in the current game section from the past game information (game information history) associated with the identified player ID, machine ID, and input money amount. It is to be noted that the processing step at S211 corresponds to a section processing part of the present invention.

At S212, based on the extracted game information, the CPU 2201 calculates a winning ratio. More specifically, the CPU 2201 calculates the winning ratio after respective games in the current game section for which the extraction is made.

At S213, the CPU 2201 counts winning ratios with respect to the current game section, which are greater than or equal to a threshold value (for example, 80%).

At S214, the CPU 2201 determines whether or not the count number exceeds a predetermined number (for example, "5"). When determining that the count number exceeds the predetermined number, the CPU 2201 shifts the processing to S215, and when determining that the count number does not exceed the predetermined number, the CPU 2201 shifts the processing to S216.

At S215, the CPU 2201 sets the fraudulent act flag to be on, finishing the fraudulent act analysis.

At S216, the CPU 2201 sets the fraudulent act flag to be off, finishing the fraudulent act analysis.

For example, if replacement with a fraudulent ROM or the like is made on the slot machine 2014, when abnormality on the slot machine 2014, which is caused by the replacement, cannot be detected, it is likely to continue suffering losses by conducting the subsequent games. In addition, for example, if a fraudulent act using radio waves, magnetic forces, or the like is committed, when abnormality on the slot machine 2014 cannot be detected, it is likely to continue suffering losses caused by said fraudulent act. In addition, for example, if the act of an exploit on the slot machine 2014 is found, when the abnormality on the slot machine 2014 cannot be detected, it is likely to continue suffering losses caused by said act of an exploit.

The present inventors have comprehended the various situations described above and have focused attention on the situation in which when an input money amount is increased, a loss becomes large. The present inventors have arrived at the configuration in which in a case where a winning ratio is greater than or equal to the threshold value when the input money amount is increased, it is detected that the abnormality has been caused on the slot machine 2014.

By adopting the above-described configuration, since based on the change in the input money amount and the winning ratios, the abnormality caused on the slot machine 2014 is detected, even if the replacement with the fraudulent ROM or the like is made, the fraudulent act using the radio waves, magnetic forces, or the like is committed, or the act of an exploit is found, it is made possible to detect the abnormality caused on the slot machine 2014.

In addition, by conducting the determination at S214, it is made possible to avoid the detection as the fraudulent act (a caution-needed session, a caution-needed player, or a caution-needed machine) made when a winning ratio happens to be high, thereby allowing the abnormality caused on the slot machine 2014 to be more accurately detected.

It is to be noted that the configuration in which the abnormality caused on the slot machine 2014 is more accurately detected is not limited to the above-described contents. For example, a configuration in which in addition to or instead of the determination at S214, it is determined whether or not winning ratios obtained when a number of games in the current game section is a predetermined number (for example, 10 games) are greater than or equal to a threshold value (for example, 70%) may be adopted.

FIG. 57 is a diagram showing one example of the game section information. The game section information is stored in the analysis database 2282 for each game section (session).

The game section information includes start time and termination time of a game section (session), identification IDs, player IDs, machine IDs, play time, BET totals, Win-loss, BET/Game, winning ratios, and information pertinent to caution-needed ranks.

[Fraudulent Act Search Service]

Figure 58:
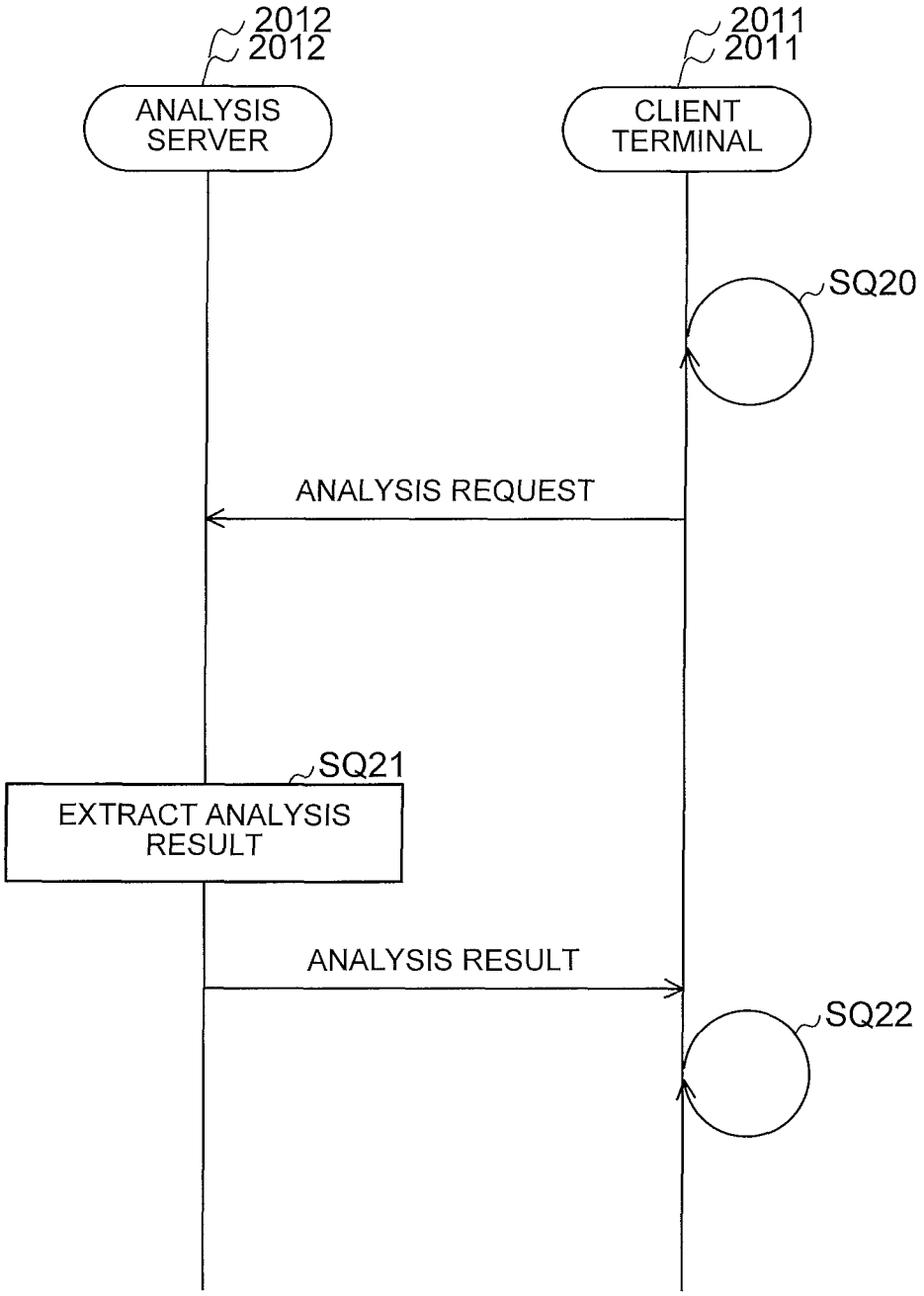
FIG. 58 is a diagram showing one example of a sequence showing a flow of fraudulent act search service.

FIG. 58 is a diagram showing one example of a sequence showing a flow of fraudulent act search service. The main flow of the fraudulent act search service which provides a fraudulent act analysis result based on a user operation by a machine keeper or the like by using this sequence will be described.

A client terminal 2011 displays a menu screen 2500 on a display 2105 and accepts an input operation by a machine keeper or the like (SQ20). Hereinafter, a case where a fraudulent act analysis of a specialized analysis display part 2560 is selected will be described as an example.

When a menu for the fraudulent act analysis is selected, extraction conditions related to the fraudulent act analysis result are inputted, and the fraudulent act analysis result is requested, the client terminal 2011 transmits, to an analysis server 2012, an instruction (analysis request) indicating that the fraudulent act analysis result is requested. It is to be noted that a configuration in which the extraction conditions are transmitted at timing different from the timing of the analysis request may be adopted.

The analysis request includes extraction conditions for the fraudulent act analysis result (an extraction target, an extraction period, and the like). It is to be noted that as the extraction target, all, a floor, a bank, a machine (for example, all machines, a vendor, a theme, and a machine ID), a player (for example, all players, a member, sex, nationality, ages, and a player ID), and the like can be specified. In addition, as the extraction period, the current day, the current month, the current year, a desired period, and the like can be specified.

Upon receiving the analysis request, the analysis server 2012 conducts analysis result extraction (SQ21). The analysis server 2012 extracts information, which meets the extraction conditions, from game section information, reads out a variety of pieces of information related thereto (machine category information, player category information, a game information history, and the like), and generates an analysis result (a WEB page or the like). The analysis server 2012 transmits the generated WEB page to the client terminal 2011 at predetermined timing.

Upon receiving the analysis result, the client terminal 2011 displays the analysis result on the display 2105 (SQ22). The analysis result will be described later, with one example thereof (an example in which as the extraction condition, a period from Oct. 1, 2014 to Oct. 31, 2014 is inputted) shown in FIG. 59 to FIG. 62.

It is to be noted that the fraudulent act search service is not limited to the above-described contents. For example, the analysis server 2012 may display the menu screen 2500 on the display 2205 and accept the input operation by the machine keeper or the like. In this case, as in the above description, the analysis server 2012 extracts the analysis result in accordance with the extraction conditions, reads out the variety of pieces of information related thereto, generates the WEB page, and displays the WEB page on the display 2205.

FIG. 59 is a diagram showing one example of a report (a fraudulent act analysis report <list>) displayed by the specialized analysis display part 2560. In FIG. 59, an example in which a caution-needed session list is selected is shown. In the fraudulent act analysis report <list> shown in FIG. 59, statistics of caution-needed sessions, the caution-needed session list, and the like are displayed.

In the statistics of the caution-needed sessions, a number of sessions of the caution-needed sessions, a total of BETs, and Winloss are displayed. In addition, in the caution-needed session list, session start date and time, session termination date and time, an identification ID (session ID), a player ID, a machine ID, play time (h), a total of BETs, Winloss, BET/Game, and a winning ratio are displayed. It is to be noted that other item such as a caution-needed rank may be displayed.

In this example, the caution-needed sessions are listed in descending order of won amounts (ascending order of values of Winloss). However, the present invention is not limited to the configuration in which the caution-needed sessions are listed in the descending order of won amounts in a fixed manner A configuration in which when a machine keeper or the like clicks any of the items, the displaying order is changed may be adopted.

It is to be noted that the items displayed in the fraudulent act analysis report are not limited to the above-described contents. For example, the number of displayed items may be decreased, or the items shown in FIG. 48 to FIG. 50 or the like and the items stored in an analysis database 2282 or the like may be appropriately added.

FIG. 60 is a diagram showing one example of a report (fraudulent act analysis report <list>) displayed by the specialized analysis display part 2560. FIG. 60 shows an example in which a caution-needed machine list is selected. In the fraudulent act analysis report <list>, statistics of caution-needed machines, the caution-needed machine list, and the like are displayed.

In the statistics of the caution-needed machines, a number of machines of the caution-needed machines and Winloss are displayed. In addition, in the caution-needed machine list, a machine ID, a vendor, a theme, and Winloss are displayed.

In this example, the caution-needed machines are listed in descending order of won amounts (ascending order of values of Winloss). However, the present invention is not limited to the configuration in which the caution-needed machines are listed in the descending order of won amounts in a fixed manner A configuration in which when a machine keeper or the like clicks any of the items, the displaying order is changed may be adopted.

It is to be noted that the items displayed in the fraudulent act analysis report are not limited to the above-described contents. For example, the number of displayed items may be decreased, or the items shown in FIG. 48 and FIG. 49 or the like and the items stored in the analysis database 2282 or the like may be appropriately added.

FIG. 61 is a diagram showing one example of a report (a fraudulent act analysis report <list>) displayed by the specialized analysis display part 2560. In FIG. 61, an example in which a caution-needed member list is selected is shown. In the fraudulent act analysis report <list>, statistics of caution-needed members, the caution-needed member list, and the like are displayed.

In the statistics of the caution-needed members, a number of members of the caution-needed members and Winloss are displayed. In addition, in the caution-needed member list, a player ID, sex, nationality, age, and Winloss are displayed.

In this example, the caution-needed members are listed in descending order of won amounts (ascending order of values of Winloss). However, the present invention is not limited to the configuration in which the caution-needed members are listed in the descending order of won amounts in a fixed manner A configuration in which when a machine keeper or the like clicks any of the items, the displaying order is changed may be adopted.

It is to be noted that the items displayed in the fraudulent act analysis report are not limited to the above-described contents. For example, the number of displayed items may be decreased, or the items shown in FIG. 50 or the like and the items stored in the analysis database 2282 or the like may be appropriately added.

Figure 62:
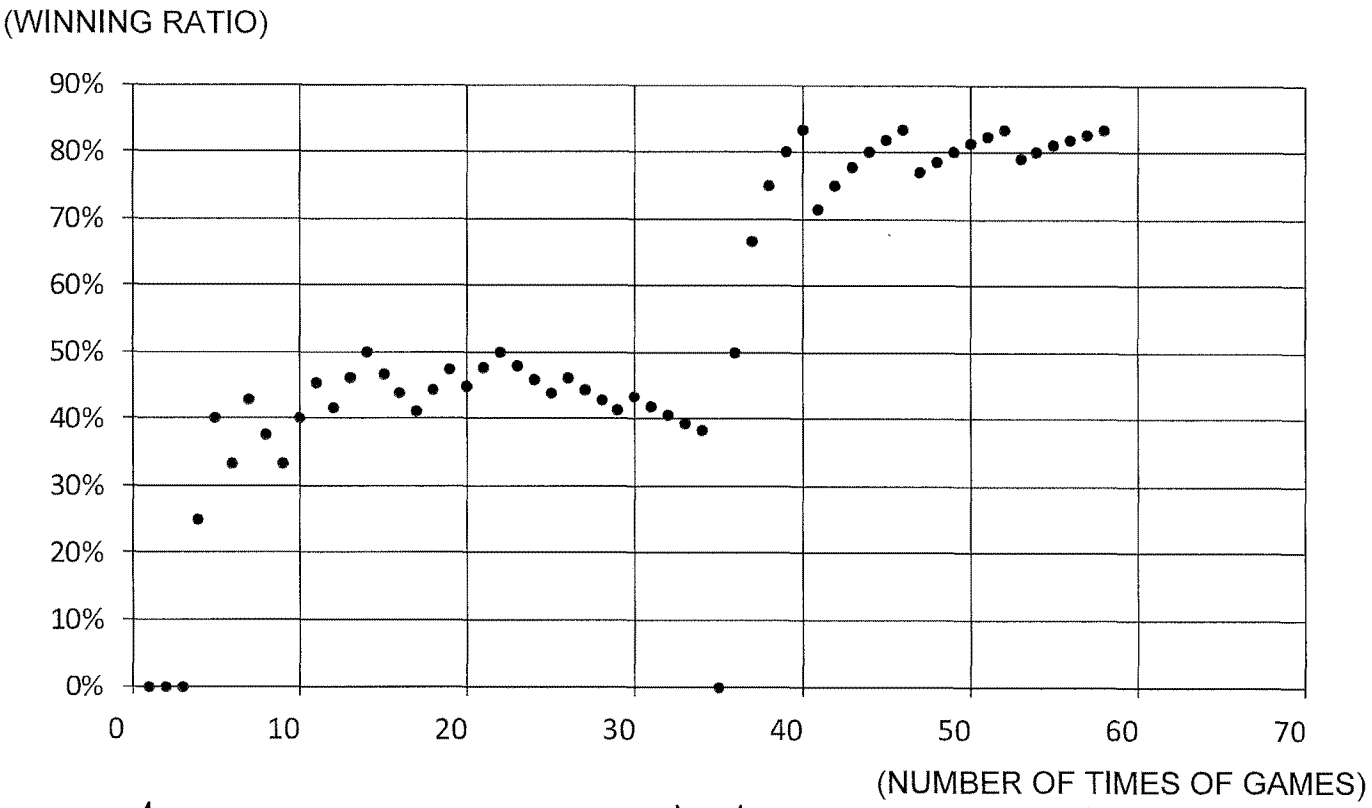
FIG. 62 is a diagram showing one example of a report.

FIG. 62 is a diagram showing one example of a report (a fraudulent act analysis report <a relationship between a BET change and a winning ratio>) displayed by the specialized analysis display part 2560. The fraudulent act analysis report <a relationship between a BET change and a winning ratio> shown in FIG. 62 is displayed when any of the identification IDs shown in FIG. 59 is clicked.

In the fraudulent act analysis report <a relationship between a BET change and a winning ratio>, winning ratios after respective games in a game section with the selected identification ID (in this example, a game section with a BET amount "100") and winning ratios after respective games in a game section previous to said game section (in this example, a game section with a BET amount "1") are shown.

By utilizing the fraudulent act analysis report, it is made possible for a machine keeper or the like to quickly and appropriately grasp the relationship between a BET change and a winning ratio.

<First Modified Example>

Figure 63:
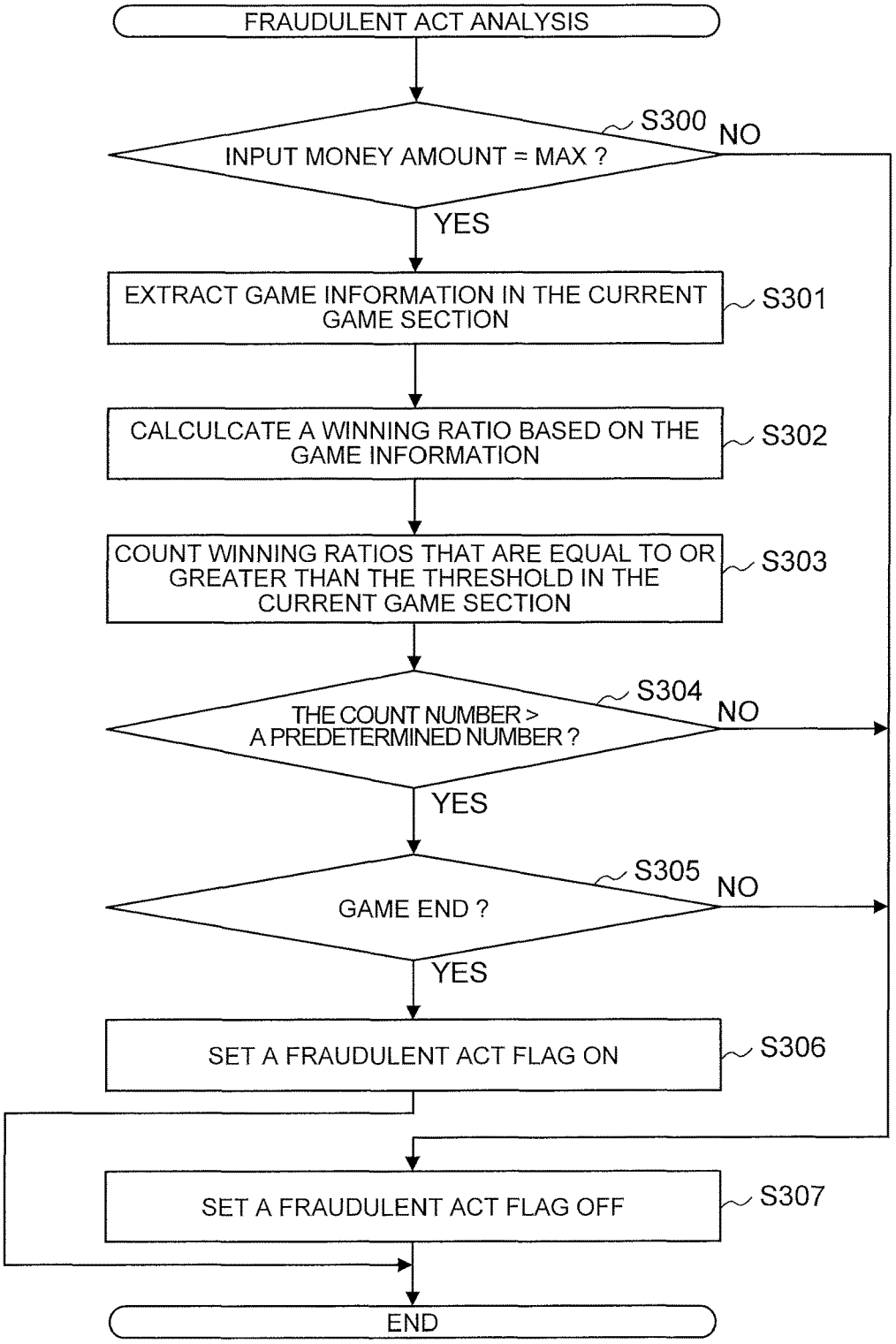
FIG. 63 is a flowchart showing one example of a fraudulent act analysis.

FIG. 63 is a flowchart showing one example of a fraudulent act analysis. The fraudulent act analysis shown in FIG. 63 is conducted, instead of the fraudulent act analysis shown in FIG. 56.

Since each processing at S301 to S304, S306, and S307 is the same as that at S211 to S216, the description thereof is omitted.

At S300, a CPU 2201 determines whether or not an input money amount is increased to its maximum. At this time, the CPU 2201 references machine category information (information shown in a machine category shown in each of FIG. 48 and FIG. 49), calculates a maximum BET amount (a maximum input money amount) in one game from a denomination and a game type class (a number of lines), and identifies the maximum input money amount. It is to be noted that a configuration in which the maximum input money amount is previously calculated and is stored in a predetermined storage region may be adopted.

When determining that the input money amount is increased to its maximum, the CPU 2201 shifts the processing to S301, and when determining that the input money amount is not increased to its maximum, the CPU 2201 shifts the processing to S307.

At S305, the CPU 2201 determines whether or not gaming has been terminated (whether or not an IC card 1500 has been ejected, whether or not a membership card has been ejected, seating/non-seating by facial authentication, and whether or not cashout has been conducted). When determining that the gaming has been terminated, the CPU 2201 shifts the processing to S306, and when determining that the gaming has not been terminated, the CPU 2201 shifts the processing to S307.

It is to be noted that the fraudulent act analysis is not limited to the above-described contents. For example, in FIG. 63, the determination at S305 may be omitted. In addition, for example, in FIG. 56, after the determination at S214, the determination at S305 may be added.

By conducting the above-described processing, when the input money amount (BET amount) is increased so as to increase a paid-out money amount paid out at one time and a fraudulent act is efficiently committed, said fraudulent act can be detected, thereby allowing the fraudulent act to be more efficiently detected.

In addition, by conducting the above-described processing, when though a winning ratio attained when the input money amount is increased is greater than or equal to a threshold value, a fraudulent act doer obtains a targeted profit and withdraws, the fraudulent act is detected, thereby allowing the fraudulent act to be more appropriately detected.

<Second Modified Example>

Figure 64:
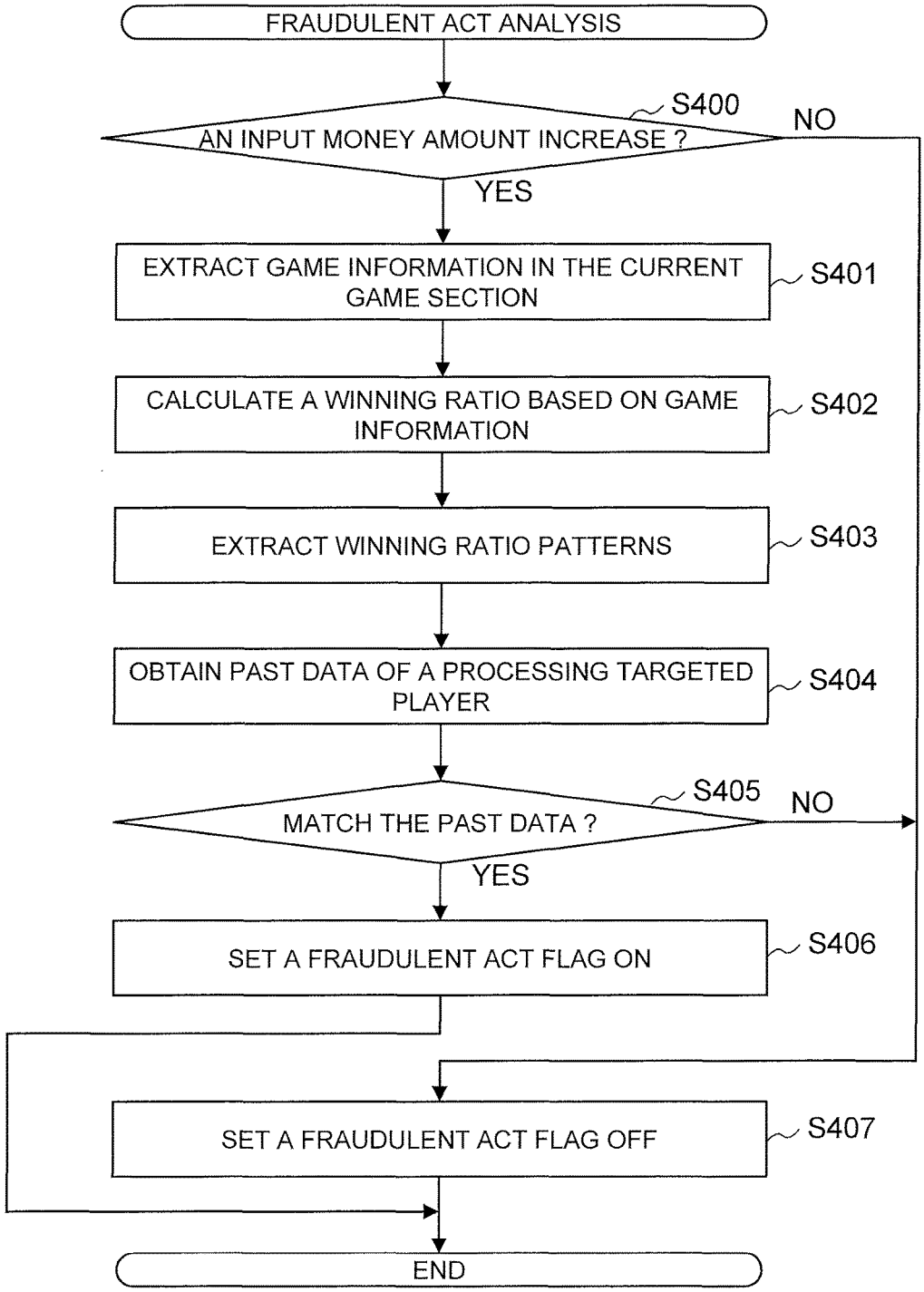
FIG. 64 is a flowchart showing one example of the fraudulent act analysis.

FIG. 64 is a flowchart showing one example of a fraudulent act analysis. The fraudulent act analysis shown in FIG. 64 is conducted, instead of the fraudulent act analysis shown in FIG. 56.

Since each processing at S400, S401, S402, S406, and S407 is the same as that at S210, S211, S212, S215, and S216, the description thereof is omitted.

Figure 65:
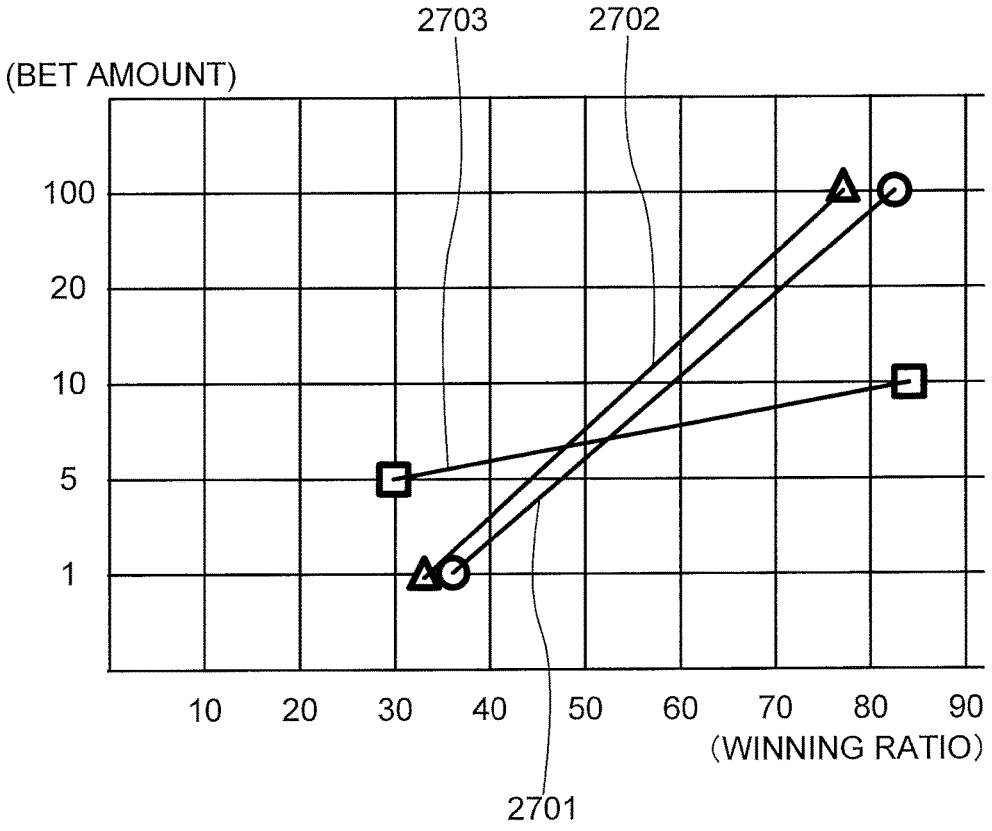
FIG. 65 is a diagram showing one example of winning ratio patterns.

At S403, a CPU 2201 extracts current winning ratio patterns. More specifically, the CPU 2201 extracts winning ratio patterns (feature vectors) in a current game section and a previous game section. It is to be noted that one example of the winning ratio patterns is shown in FIG. 65. It is to be noted that the processing step at S403 corresponds to a processing part of the present invention for extracting winning ratios.

At S404, the CPU 2201 obtains past data (game section information or a game information history) of a player who is targeted for the processing.

At S405, the CPU 2201 determines whether or not a winning ratio pattern or winning ratio patterns similar to the current winning ratio pattern is or are present in the past data. For example, when determining that a degree or degrees of similarity between the current winning ratio pattern(s) and one winning ratio pattern or a plurality of winning ratio patterns in the past is or are larger than a predetermined value, the CPU 2201 determines that the similar winning ratio pattern or winning ratio patterns are present in the past data. When determining that the winning ratio pattern or winning ratio patterns similar to the current winning ratio pattern(s) is or are present in the past data, the CPU 2201 shifts the processing to S406, and when determining that the winning ratio pattern or winning ratio patterns similar to the current winning ratio pattern(s) is or are not present in the past data, the CPU 2201 shifts the processing to S407. It is to be noted that the processing step at S405 corresponds to a detection processing part of the present invention.

By conducting the above-described processing, when an input money amount is increased and the current winning ratio pattern(s) is or are similar to the past winning ratio pattern(s), a fraudulent act is detected, thereby allowing the fraudulent act to be more accurately detected. In addition, in the fraudulent act analysis shown in FIG. 64, the larger an amount of the accumulated past data is, the more accurately the detection is enabled.

It is to be noted that the data obtained at S404 is not limited to the past data of a player who is targeted for the processing. For example, a configuration in which the past data related to said machine is obtained may be adopted. In addition, for example, a configuration in which the past data related to all machines whose models are the same as that of said machine is obtained may be adopted. Through the addition of the above-mentioned configurations or the replacement with the above-mentioned configurations, it is made possible for a machine keeper or the like to more accurately grasp whether or not the machine or machines on which the exploits are made.

FIG. 65 is a diagram showing one example of the winning ratio patterns. In FIG. 65, a current winning ratio pattern 2701, the past winning ratio pattern 2702, and the past winning ratio pattern 2703 are shown. It is to be noted that the number of the past winning ratio patterns is not limited to two, and there may be a case where the number thereof is one or is greater than or equal to three.

The degree of similarity of each of the winning ratio patterns can be calculated by employing a variety of methods. In this example, since each of the winning ratio patterns is a line segment, for example, in a case where a point of a BET amount "1" of each of the winning ratio patterns is defined to be a starting point and a point of a BET amount "100" of each of the winning ratio patterns is defined to be an end point, the degree of similarity can be calculated as follows. A starting point of the current winning ratio pattern 2701 and a starting point of the past winning ratio pattern 2702 are superposed on each other and an end point of the current winning ratio pattern 2701 and an end point of the past winning ratio pattern 2702 are connected with each other, and an area A thereby formed is obtained. The more approximate to "0" the area A is, the higher the degree of similarity is. For example, when "0<an area A<a predetermined value" is satisfied, it can be determined that the winning ratio patterns are similar to each other. It is to be noted that when the area A is "0", it may be determined that the winning ratio patterns are similar to each other, or when the area A is "0" and a length of the current winning ratio pattern 2701 and a length of the winning ratio pattern 2702 coincide with each other, it may be determined that the winning ratio patterns are similar to each other (including a case where the winning ratio patterns coincide with each other). Alternatively, the similarity may be obtained from inclinations of the winning ratio patterns.

The above-described contents of the method is merely one example, and in consideration of an amount of the past data, a shape of each of the winning ratio patterns, and the like, other heretofore known method can be adopted as appropriate.

<Third Modified Example>

Figure 66:
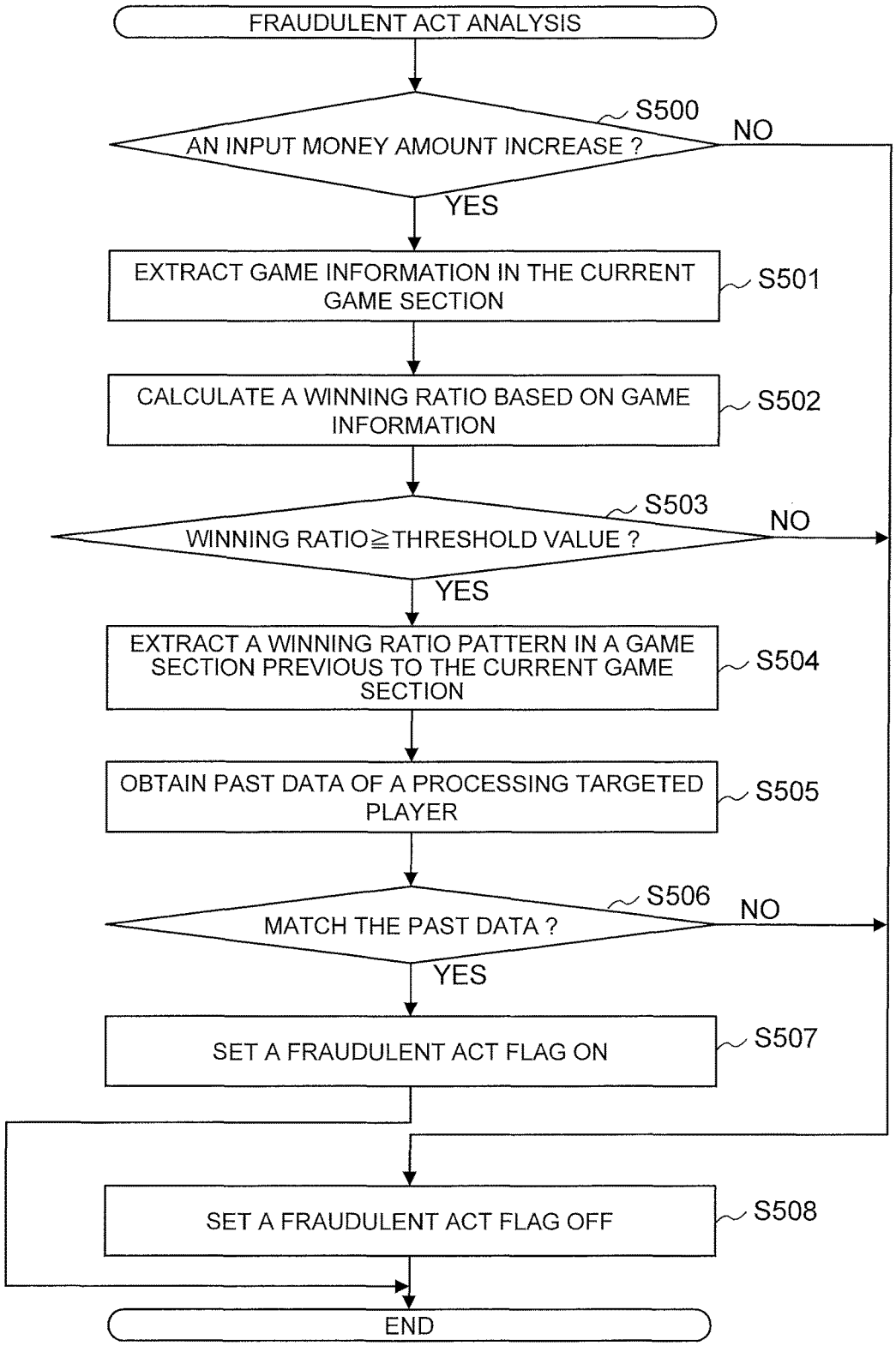
FIG. 66 is a flowchart showing one example of the fraudulent act analysis.

FIG. 66 is a flowchart showing one example of a fraudulent act analysis. The fraudulent act analysis shown in FIG. 66 is conducted, instead of the fraudulent act analysis shown in FIG. 56.

Since each processing at S500, S501, S507, and S508 is the same as that at S210, S211, S215, and S216, the description thereof is omitted.

At S502, based on extracted game information, a CPU 2201 calculates a winning ratio in a current game section. It is to be noted that when a number of games in the current game section is less than a predetermined number (for example, "10"), it is determined that the determination is impossible and the winning ratio is set to "−1(%)".

At S503, the CPU 2201 determines whether or not a winning ratio is greater than or equal to a threshold value (for example, 80%). When determining that the winning ratio is greater than or equal to the threshold value, the CPU 2201 shifts the processing to S504, and when determining that the winning ratio is not greater than or equal to the threshold value, the CPU 2201 shifts the processing to S508.

At S504, the CPU 2201 extracts a winning ratio pattern in a game section previous to the current game section. More specifically, the CPU 2201 extracts one or a plurality of winning ratio patterns (feature vector(s)) from when gaming is started up to the current game section. At this time, when a number of games in the game section is less than a predetermined number (for example, "10"), the CPU 2201 sets a winning ratio in said game section to "−1(%)" and extracts the winning ratio pattern(s).

At S505, the CPU 2201 obtains past data (game section information or a game information history) of a player who is targeted for the processing.

At S506, the CPU 2201 determines whether or not a winning ratio pattern or winning ratio patterns similar to the extracted winning ratio pattern(s) is or are in the past data. For example, when determining that a degree or degrees of similarity between the extracted winning ratio pattern(s) and one winning ratio pattern or a plurality of winning ratio patterns in the past is or are larger than a predetermined value, the CPU 2201 determines that the similar winning ratio pattern or winning ratio patterns is or are present in the past data. When determining that the winning ratio pattern or winning ratio patterns similar to the extracted winning ratio pattern(s) is or are in the past data, the CPU 2201 shifts the processing to S507, and when determining that the winning ratio pattern or winning ratio patterns similar to the extracted winning ratio pattern(s) is or are not in the past data, the CPU 2201 shifts the processing to S508.

It is to be noted that the extraction of the winning ratio pattern(s) is not limited to the above-described contents. For example, a configuration in which winning ratio patterns in predetermined game sections (for example, two) immediately previous to the current game section are extracted may be adopted.

By adopting the above-described configuration, when an input money amount is increased, gaming is conducted in a predetermined gaming procedure prior to increasing the input money amount, and the predetermined winning ratio patterns appear, the fraudulent act is detected, thereby allowing the fraudulent act to be more appropriately detected.

The above-described configurations can be combined as appropriate. Hereinafter, the above-described configurations will be described from various aspects.

In recent years, in order to reduce a loss inflicted by a fraudulent act or the like to gaming machines installed in a game facility such as a casino, a game facility side has been conducting the examination and introduction of gaming machines for which countermeasures thereagainst have been taken.

For example, a gaming machine capable of reducing a risk of fraudulent intrusion into the gaming machine from the outside is disclosed (refer to U.S. Unexamined Patent Application Publication No. 2016/0005266).

However, on the above-mentioned gaming machine, if some measure is taken and replacement with a fraudulent ROM or the like is made, when abnormality on the gaming machine, which is caused by the replacement, cannot be detected, it is likely to continue suffering losses by conducting the subsequent games.

In view of the above-described regard, the below-described configurations have been made. An object thereof is to provide an analysis system which is operable to detect the abnormality caused on a gaming machine.

An analysis system (a game information analysis system 2001, an analysis system 2002, or the like) according to a first aspect of the above-described embodiment includes:

a storage device (a hall management server 10, a hall management server 2013, a storage device 2380, an external storage device 2034, an analysis server 2012, a storage device 2280, an external storage device 2204, an analysis database 2282, an information processing device 2600, a storage part 2603, or the like) for storing a bet amount (a BET number, a BET amount, a BET money amount, an input money amount, an investment money amount, or the like) and a payout amount (a to-be-paid-out number, a payout amount, a to-be-paid-out money amount, or the like) which are transmitted from a gaming machine (a gaming machine, a slot machine 1010, a slot machine 2014, or the like); and an information processing device (an analysis server 2012, a CPU 2201, a game information analysis part 2255, an information processing device 2600, a controller part 2601, or the like) being operable to calculate a winning ratio based on the bet amount and the payout amount which are stored in the storage device, and the information processing device detects that abnormality has been caused on the gaming machine (for example, detects a fraudulent act or detects a machine exploit act), when a winning ratio after increasing the bet amount is greater than or equal to a threshold value (for example, 80%).

The present inventors have focused attention on the situation in which a loss becomes large when a bet amount is increased, and therefore, in the above-described configuration, the abnormality caused on the gaming machine is detected when the winning ratio upon increasing the bet amount is greater than or equal to the threshold value.

By adopting the above-described configuration, since based on the change in the bet amount and the winning ratio, the abnormality caused on the gaming machine is detected, even in a case where the replacement with a fraudulent ROM or the like is made or in other case, it is made possible to detect the abnormality caused on the gaming machine.

In addition, by adopting the above-described configuration, since the abnormality caused on the gaming machine can be efficiently detected, it is made possible to reduce a load exerted on the analysis system.

In the present analysis system, further, the information processing device detects that abnormality has been caused on the gaming machine, when a winning ratio after changing the bet amount to a maximum is greater than or equal to a threshold value (for example, 80%). It is to be noted that the threshold value used for the determination of the winning ratio after changing the bet amount and the threshold value used for the determination of the winning ratio after changing the bet amount to the maximum may be the same as each other or may be different from each other.

In the present configuration, even in a case where the bet amount is increased so as to increase a payout amount paid out at one time and a fraudulent act or the like is efficiently committed, the abnormality caused on the gaming machine is detected.

By adopting the above-described configuration, it is made possible to more efficiently detect the abnormality caused on the gaming machine.

In the present analysis system, further, the information processing device detects that abnormality has been caused on the gaming machine, when a number of times at which the winning ratio after increasing the bet amount is determined to be greater than or equal to the threshold value has reached a predetermined number of times (for example, five times).

By adopting the above-described configuration, since when the number of times at which the winning ratio after increasing the bet amount is determined to be greater than or equal to the threshold value has reached the predetermined number of times, the abnormality caused on the gaming machine is detected, it is made possible to more accurately detect the abnormality caused on the gaming machine.

In the present analysis system, further, the information processing device detects that abnormality has been caused on the gaming machine, when a past winning ratio pattern being similar to a current winning ratio pattern is present.

By adopting the above-described configuration, since when the current winning ratio pattern(s) is or are similar to the past winning ratio pattern(s), the abnormality caused on the gaming machine is detected, it is made possible to more accurately detect the abnormality caused on the gaming machine.

In the present analysis system, further, when the information processing device has detected that the abnormality has been caused on the gaming machine, the information processing device transmits (stores), to the storage device, identification information (a machine ID or the like) which allows the gaming machine to be identified.

By adopting the above-described configuration, it is made possible to grasp gaming machines, on each of which the fraudulent act has been committed, gaming machines, on each of which an exploit act has been committed, and the like and to take measures such as removal of gaming machines whose models are the same as one another.

In the present analysis system, further, the storage device receives, from the gaming machine, and stores gaming termination information (for example, eject operation information of an IC card 1500, cashout operation information, eject operation information of a membership card, seating/non-seating information by facial authentication, or the like), and the information processing device detects that abnormality has been caused on the gaming machine, when the winning ratio upon increasing the bet amount is greater than or equal to the threshold value and gaming is determined to be terminated.

The present inventors have focused attention on the situation in which when a fraudulent act doer or the like has obtained a target profit, the fraudulent act doer or the like withdraws without hesitation. Thus, the present inventors have arrived at the configuration in which the information processing device detects that the abnormality has been caused on the gaming machine when the gaming is determined to be terminated even though the winning ratio upon increasing the bet amount is greater than or equal to the threshold value.

By adopting the above-described configuration, it is made possible to more accurately detect the abnormality caused on the gaming machine.

In the present analysis system, further, the information processing device detects that abnormality has been caused on the gaming machine, when a winning ratio after increasing the bet amount from a first bet amount (for example, an input money amount "1") to a second bet amount (for example, an input money amount "100") is greater than or equal to a threshold value (for example, 80%) and a past winning ratio pattern being similar to a winning ratio pattern before increasing the bet amount from the first bet amount to the second bet amount is present.

In the above-described configuration, when the bet amount is increased, gaming is conducted in a predetermined gaming procedure before increasing the bet amount, and a predetermined winning ratio pattern appears, the abnormality caused on the gaming machine is detected.

By adopting the above-described configuration, it is made possible to more accurately detect the abnormality caused on the gaming machine.

In the present analysis system, further, the information processing device instructs the gaming machine to notify that the abnormality caused on the gaming machine has been detected (an alert instruction or the like).

An information processing device (an analysis server 2012, an information processing device 2600, or the like) according to a second aspect of the above-described embodiment includes:

a storage device (a storage device 2280, an external storage device 2204, and analysis database 2282, an information processing device 2600, a storage part 2603, or the like) for storing a bet amount (a BET number, a BET amount, a BET money amount, an input money amount, an investment money amount, or the like) and a payout amount (a to-be-paid-out number, a payout amount, a to-be-paid-out money amount, or the like) which are transmitted from a gaming machine (a gaming machine, a slot machine 1010, a slot machine 2014, or the like); and a controller (a CPU 2201, a game information analysis part 2255, a controller part 2601, or the like) being operable to calculate a winning ratio based on the bet amount and the payout amount which are stored in the storage device, and the controller detects that abnormality has been caused on the gaming machine (for example, detects a fraudulent act or detects a machine exploit act), when a winning ratio after increasing the bet amount is greater than or equal to a threshold value (for example, 80%).

By adopting the above-described configuration, it is made possible to detect the abnormality caused on the gaming machine.

In addition, by adopting the above-described configuration, since the abnormality caused on the gaming machine can be efficiently detected, it is made possible to reduce a load exerted on the information processing device.

Although the above-described embodiment is described by citing the game facility as the example, the present invention is not limited thereto. The present invention is applicable to other facilities other than an amusement facility such as the game facility. For example, the present invention is applicable to commercial facilities such as shopping centers including a department store and an outlet mall and in addition to the above-mentioned commercial facilities and the game facility, the present invention is applicable to a commercial complex which is a building or a region in which a plurality of facilities such as restaurants and movie theaters are concentrated. In addition, for example, the present invention is applicable to facilities such as hotels, airports, and stations.

Hereinabove, the embodiment of the present invention is described. However, the specific example is merely exemplified, the present invention is not particularly limited thereto, and appropriate design modifications and variations of the specific configuration of the parts and the like are possible. In addition, the effects described in the embodiment of the present invention are merely the most favorable effects coming from the present invention, and the effects according to the present invention are not limited to the effects described in the embodiment of the present invention.

In addition, in the above-description in details, in order to facilitate understanding of the present invention, the features are mainly described. The present invention is not limited to the embodiments described above in details and is applicable to other embodiments, and a scope of applications thereof is diverse. In addition, the terms and wording used in the present specification are used to accurately describe the present invention and are not used to limit the interpretation of the present invention. In addition, from the concept of the invention described in the present specification, it is considered to be easy for a person skilled in the art to arrive at other configuration, system, method, and the like embraced within the concept of the present invention. Accordingly, in the description in the appended claims, an equivalent constitution must be taken to be embraced within the scope not departing from the scope of a technical idea of the present invention. In addition, the purpose of the abstract is to make it possible that the Patent Office, general public institutions, and technical personnel and the like who do not have a thorough knowledge of patents, legal terms, or technical terms and are involved in the technical field to which the present invention belongs can make prompt determination by conducting a simple search on the technical contents and essence of the present application. Accordingly, it is not intended that the abstract limits the scope of the invention which should be evaluated by the description in the scope of claims. In addition, in order to sufficiently understand the object of the present invention and the particular effects of the present invention, it is desirable that the present invention is interpreted by sufficiently taking into consideration the documents and the like which have already been disclosed.

In the above description in details, processes executed by a computer are included. The above description and expressions are given for the purpose of allowing a person skilled in the art to most efficiently understand the prevent invention. In the present specification, each step used to derive one result should be understood as a process which is not self contradictory. In addition, at each step, transmission and reception of an electrical or magnetic signal, recoding thereof, and the like are conducted. In a process at each step, such a signal is represented by bits, a value, a symbol, characters, a term, a numeral, and the like. However, it should be kept in mind that these are used simply because they are convenient to facilitate understanding. In addition, there may be a case where a process at each step is described with expressions which are common to those describing human behavior. In principle, however, each process described in the present specification is executed by a variety of devices. In addition, other configuration required to execute each step is made apparent by the above description.

REFERENCE SIGNS LIST

2001 game information analysis system
2011 client terminal
2012 analysis server
2013 hall management server
2014 slot machine
2600 information processing device

What is claimed is:

1. A fraud analysis system that detects potential fraud at a wagering-type gaming machine, the analysis system comprising:

an information processing device including:

a central processing unit (CPU), an interface that electronically communicates with the wagering-type gaming machine and a database via a computer network, and a non-transitory memory storing computer implementable instructions read by the CPU, which cause the CPU to perform operations comprising:

storing, in the database, wagering-type gaming machine information transmitted from the wagering-type gaming machine, including information pertaining to a bet amount and a payout amount made at the wagering-type gaming machine;

after the bet amount at the wagering-type gaming machine is increased during a gaming session, extracting wagering-type gaming machine information corresponding to the gaming session and receiving the extracted wagering-type gaming machine information from the database;

calculating a winning ratio based on the bet amount and the payout amount made during the gaming session and stored in the database;

comparing the winning ratio with a predetermined threshold value;

detecting the existence of a probable wagering-type gaming machine abnormality when the winning ratio is found to be greater than or equal to the threshold value; and when a probable abnormality is detected, outputting a signal indicating the probable abnormality.

2. The fraud analysis system according to claim 1, wherein the information processing device detects the existence of a probable abnormality at the wagering-type gaming machine when the winning ratio, after changing the bet amount to a maximum, is greater than or equal to the threshold value.

3. The fraud analysis system according to claim 1, wherein the information processing device detects the existence of a probable abnormality at the wagering-type gaming machine when a number of times at which the winning ratio, after increasing the bet amount is determined to be greater than or equal to the threshold value, reaches a predetermined number of times.

4. The fraud analysis system according to claim 1, wherein the information processing device detects the existence of a probable abnormality at the wagering-type gaming machine when a past winning ratio pattern is determined to be similar to a current winning ratio pattern.

5. The fraud analysis system according to claim 4, wherein the winning ratio pattern is visually characterized on a display as a line segment derived from the bet amount and the winning ratio, and the information processing device detects the existence of a probable abnormality at the wagering-type gaming machine based on a comparison of a line segment corresponding to a current winning ratio pattern and a line segment corresponding to a past winning ratio pattern exhibiting similar properties.

6. The fraud analysis system according to claim 1, wherein the database receives and stores gaming termination information from the wagering-type gaming machine, and the information processing device detects the existence of a probable abnormality at the wagering-type gaming machine when the winning ratio is determined to be greater than or equal to the threshold value upon an increase of the bet amount at the wagering-type gaming machine, and a gaming session is determined to be terminated.

7. The fraud analysis system according to claim 1, wherein the information processing device detects the existence of a probable abnormality at the wagering-type gaming machine when the winning ratio is determined to be greater than or equal to a threshold value after increasing the bet amount from a first bet amount to a second bet amount, and a past winning ratio pattern is similar to a winning ratio pattern existing before increasing the bet amount from the first bet amount to the second bet amount is present.

8. The fraud analysis system according to claim 7, wherein the winning ratio pattern is visually characterized on a display as a line segment derived from the bet amount and the winning ratio, and the information processing device detects the existence of a probable abnormality at the wagering-type gaming machine, based on a comparison of a line segment corresponding to the winning ratio pattern before increasing the bet amount from the first bet amount to the second bet amount and a line segment corresponding to the past winning ratio pattern exhibiting similar properties.

9. The fraud analysis system according to claim 1, wherein upon the information processing device detecting the existence of a probable abnormality at the wagering-type gaming machine, the information processing device transmits, to the database, identification information which allows the wagering-type gaming machine to be identified.

10. The fraud analysis system of claim 1, wherein the wagering-type gaming machine includes:

a value addition mechanism by which a medium of exchange may be added to the wagering-type gaming machines, the value addition mechanism configured to receive and authenticate a currency bill and at least one of a coin, a token, a ticket, or an IC card;

a payout mechanism by which a value corresponding to the medium of exchange may be paid out, the payout mechanism configured to dispense a coin and at least one of a token, a bill, a ticket, or an IC card;

a symbol display device configured to display a game result by variably displaying symbols and then rearranging the symbols; and a controller programmed to execute wagering-type gaming machine processes.

11. The fraud analysis system of claim 1, wherein the winning ratio, which is calculated based on information pertaining to the bet amount and the payout amount at a wagering-type gaming machine, is calculated using real-time information received from the wagering-type gaming machine.

12. The fraud analysis system of claim 1, wherein the winning ratio, which is calculated based on information pertaining to the bet amount and the payout amount at a wagering-type gaming machine, is calculated using historical wagering-type gaming machine information.

13. The fraud analysis system according to claim 1, wherein upon the information processing device detecting the existence of a probable abnormality at the wagering-type gaming machine, the information processing device transmits, to the database, identification information pertaining to a game player.

14. The fraud analysis system of claim 1, wherein the processes of storing, extracting, receiving, calculating, comparing, and outputting occur in real-time in response to the increase in the bet amount at the wagering-type gaming machine during the gaming session.

* * * * *